US006504456B2

(12) United States Patent
Iio et al.

(10) Patent No.: US 6,504,456 B2
(45) Date of Patent: Jan. 7, 2003

(54) COMMUNICATION DEVICE HAVING A SPURIOUS WAVE BLOCKING CIRCUIT FORMED OF A PLURAL FUNDAMENTAL PATTERN

(75) Inventors: Kenichi Iio, Sagamihara (JP); Yohei Ishikawa, Yokohama (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/784,802

(22) Filed: Feb. 15, 2001

(65) Prior Publication Data

US 2001/0024150 A1 Sep. 27, 2001

(30) Foreign Application Priority Data

Feb. 16, 2000 (JP) ..... 2000-037717
Jan. 9, 2001 (JP) ..... 2001-001356

(51) Int. Cl.[7] ..... H01P 1/10
(52) U.S. Cl. ..... 333/202; 333/204
(58) Field of Search ..... 333/202, 204, 333/205, 21 R

(56) References Cited

U.S. PATENT DOCUMENTS 5,023,866 A * 6/1991 De Muro ..... 370/24
5,982,339 A 11/1999 Lalezari et al. ..... 343/872
6,023,209 A * 2/2000 Faulkner et al. ..... 333/238
6,323,740 B1 * 11/2001 Ishikawa et al. ..... 333/21 R

FOREIGN PATENT DOCUMENTS

| | | |
|---|---|---|
| EP | 0975043 A2 | 1/2000 |
| GB | 2322237 A | 8/1998 |
| JP | 2000 101301 | 4/2000 |
| WO | WO 9956338 | 11/1999 |

OTHER PUBLICATIONS

Hesselbarth, J. et al., "Leakage Suppression In Coplanar Waveguide Circuits By Patterned Backside Metallization", 1999 IEEE MIT–S International Microwave Symposium Digest. (IMS). Anaheim, CA, Jun. 13–19, 1999, IEEE MIT–S International Microwave Symposium, New York, NY: IEEE, US, vol. 3, Jun. 13, 1999, pp. 871–874, XP000896777.

* cited by examiner

*Primary Examiner*—Robert Pascal
*Assistant Examiner*—Joseph Chang
(74) *Attorney, Agent, or Firm*—Dickstein Shapiro Morin & Oshinsky LLP

(57) ABSTRACT

Electrodes are formed on the upper and under faces of a dielectric plate. For example, plural fundamental patterns having four ports and a quadrangular shape are arranged thereon. A strip conductor of a two-port circuit is determined so that adjacent two-port circuits of the respective fundamental patterns have a band-stop filter characteristic.

12 Claims, 51 Drawing Sheets

WHEN PLANE B-B' IS OPEN,

WHEN PLANE B-B' IS SHORT-CIRCUITED,

EQUIVALENT CIRCUIT OF CIRCUIT SHOWN IN FIG. 24A

EQUIVALENT CIRCUIT OF CIRCUIT SHOWN IN FIG. 24B

COMMUNICATION DEVICE HAVING A SPURIOUS WAVE BLOCKING CIRCUIT FORMED OF A PLURAL FUNDAMENTAL PATTERN

BACKGROUND OF THE INVENTION

1. Field of the Invention

The present invention relates to a high frequency circuit device such as a waveguide, a resonator, or the like including two parallel plane conductors, and a communication device using the high frequency circuit device.

2. Description of the Related Art

As transmission lines for use in a microwave or millimeter-wave band, different types of transmission lines are employed, such as grounded coplanar transmission lines each containing a dielectric plate having a ground electrode formed substantially on the whole of one face thereof and a coplanar line formed on the other face thereof, grounded slot transmission lines each containing a dielectric plate having a grounded electrode formed on one face thereof and a slot formed on the other face thereof, planar dielectric transmission lines each containing a dielectric plate having slots formed on both of the faces of the dielectric plate, in opposition to each other through the dielectric plate, and so forth.

All of these transmission lines are formed so as to contain two parallel plane conductors. Therefore, there has arisen the problem that if an electromagnetic field is disturbed in input-output portions and bends of the transmission lines, a spurious mode wave such as a so-called parallel plate mode wave or the like is excited between the two parallel plane conductors, and the spurious mode wave is propagated between the plane conductors. In some cases, problematically, interference is caused by the spurious mode leakage wave between the adjacent transmission lines, so that a signal leaks between the lines, and so forth.

FIG. 62 shows an example of the principal propagation mode of a grounded coplanar transmission line and a parallel mode electromagnetic field distribution generated incidentally to the principal propagation mode. In FIG. 62, an electrode 21 is formed substantially on the whole of the lower face of a dielectric plate 20, and a strip conductor 19 and an electrode 22 are formed on the upper face thereof. The electrodes 21 and 22 are used as ground electrodes. These electrodes, the dielectric plate 20, and the strip conductor 19 constitute a grounded coplanar transmission line. In such a grounded coplanar transmission line, an electromagnetic field is disturbed at the end portions thereof, so that an electric field is induced, extending vertically to the electrodes 21 and 22 on the upper and lower faces of the dielectric plate 20, and thereby, a parallel plate mode electromagnetic field is generated as illustrated in FIG. 62. In FIG. 62, solid line arrows, broken lines, and alternate long and two dash lines represent an electric field, a magnetic field, and a current distribution, respectively.

Conventionally, for the purpose of preventing propagation of such an undesired mode wave, through-holes electrically connecting electrodes formed on the upper and lower faces of a dielectric plate, are provided along a transmission line, on both of the sides thereof and at intervals sufficiently short with respect to the propagation mode wavelength. When these through-holes are provided along the propagation direction of a waveguide electrically connecting the electrodes on the upper and lower faces as described above, the through-hole parts act as electrical walls, where propagation of the parallel plate mode wave is prevented. However, in a high frequency range such as a millimeter wave band or the like, it is required to reduce the thickness of the dielectric plate so that generation of higher mode waves can be suppressed. Moreover, it is necessary to greatly reduce the intervals between the through-holes. Accordingly, a high precision production process is required.

In the case in which no through-holes are provided in the dielectric plate, it is conceivable to employ a method of mounting the entire dielectric plate having electrodes formed thereon into a cutoff waveguide. However, the size of the cutoff waveguide must be reduced to be less than half of the guide wavelength. Restrictions on the size of the transmission line become severe.

Moreover, it is also conceivable to employ a method of blocking the propagation of a spurious mode wave in which an electrode is partially removed in the area where the spurious mode wave leaks, so that a magnetic wall is formed. However, in this case, the new problem arises that the area where the electrode is removed acts as a kind of resonator.

The applicant of the present invention has filed Japanese Patent Application No. 11-025873 on a spurious mode wave propagation blocking circuit in which inductors and capacitors are combined to form a lumped-constant circuit and are arranged in a two dimensional form.

SUMMARY OF THE INVENTION

The present invention provides a high frequency circuit device and a communication device which can solve the problems, caused by propagation of a spurious mode wave, similarly to the above Japanese Patent Application No. 11-025873, and in which the pattern can be more reduced in size as compared with the circuit described in Japanese Patent Application No. 11-025873.

To accomplish these results, according to one aspect of the present invention, there is provided a high frequency circuit device which comprises at least two parallel plane conductors, a circuit for exciting an electromagnetic wave, provided between the two plane conductors, and a spurious mode wave propagation-blocking circuit for coupling to a spurious mode wave propagating between the two plane conductors to block the propagation of the spurious mode wave, formed on either or both of the two plane conductors, the spurious mode wave propagation-blocking circuit comprising a plurality of arranged fundamental patterns each made of a strip conductor and constituting a multi-port circuit having at least two ports, the strip conductor of the two-port circuit being determined so that any arbitrary two-port circuit of the respective fundamental patterns has a band-stop filter characteristic.

For example, as shown in FIG. 1, between ports #1 and #4 of a four-port circuit, a circuit is provided which functions as a band-stop filter BEF between the ports #1 and #4, as well as between each adjacent pair of the other ports. That is, band-stop filter circuits are presented between ports #1 and #2, between ports #2 and #3, and between ports #3 and #4, respectively. In FIG. 1, the ground terminals corresponding to the ports #2 and #3 are not shown.

As regards the total reflection condition of a multi-port circuit, as described below, if a circuit between two arbitrary ports satisfies the total reflection condition, irrespective of the symmetry of the circuit, the total reflection condition of the whole of the circuit is satisfied. Thus, by arranging plural polygonal fundamental patterns each constituting such a multi-port circuit as shown in FIG. 1, a spurious mode wave such as a parallel plate mode wave propagating between two plane conductors couples with the patterns, so that propagation of a spurious mode wave can be prevented.

According to a further aspect of the invention, a strip transmission line with an open end, having an electrical length equal to ¼ wavelength at a service frequency is connected in parallel to a strip conductor of the two-port circuit, e.g., as shown in FIG. 2. Thereby, an arbitrary two-port circuit can present a band-stop filter characteristic.

According to a further aspect of the invention, the two-port circuit comprises at least two strip conductors having an electrical length difference equal to a half wavelength and connected in parallel to each other between the two ports of the two-port circuit, e.g., as shown in FIG. 3. In this case, a band-stop filter is configured only by the strip conductors provided between the two arbitrary ports.

According to a further aspect of the invention, a transmission line having a predetermined impedance and a predetermined electrical length is connected to each of the input-output ports of the fundamental pattern. Thereby, the frequency band having the above-described band-stop characteristic can be increased in width. Thus, propagation of a spurious mode wave can be blocked over a wide band.

In a communication device according to an aspect of the present invention, the above-described high frequency circuit device is used as a communication signal propagation section or a communication signal processing section, in combination with transmitting and/or receiving circuits.

BRIEF DESCRIPTION OF THE DRAWING(S)

Figure 7A:
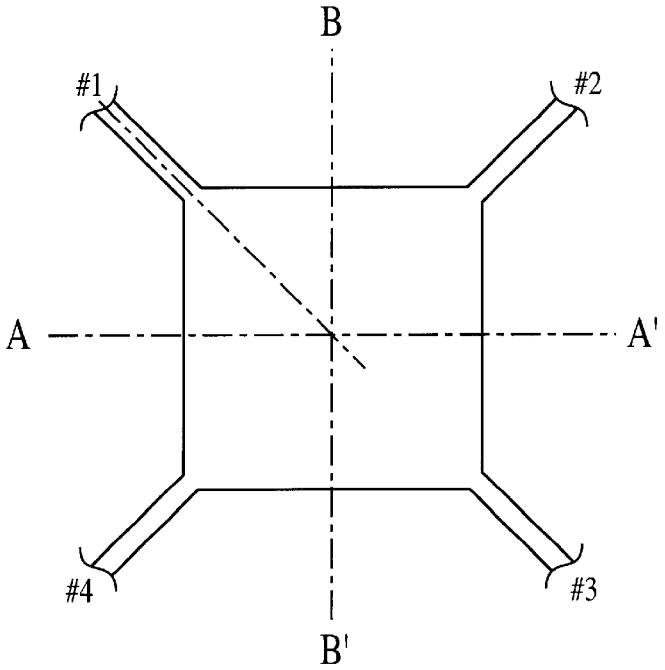
Figure 7B:
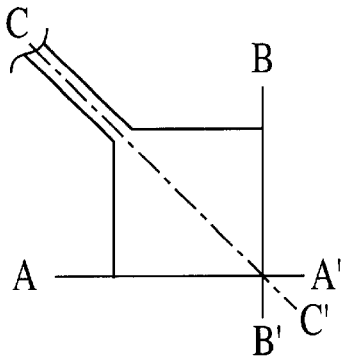
Figure 7C:
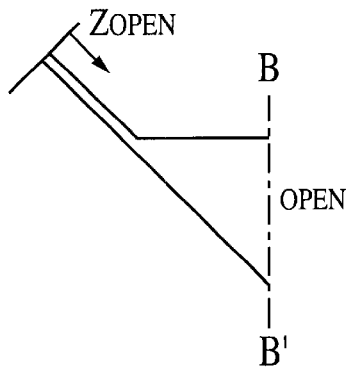
Figure 7D:
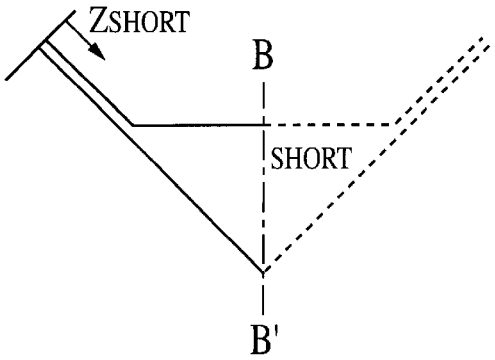
Figure 8A:
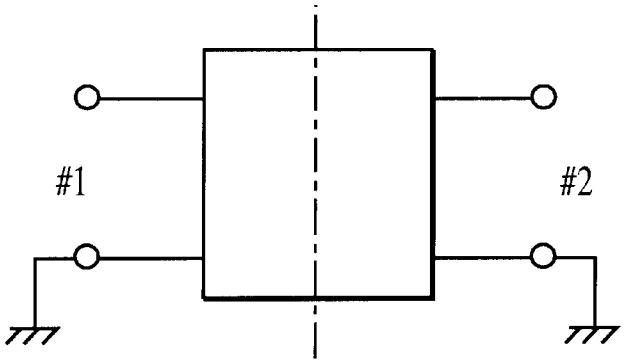
Figure 8B:
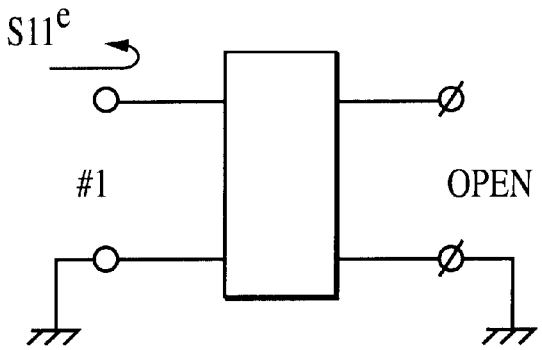
Figure 8C:
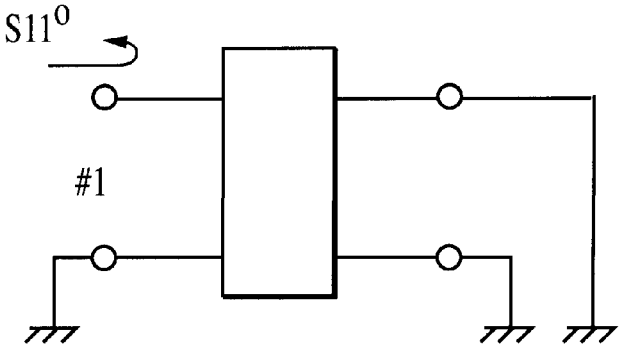
Figure 9A:
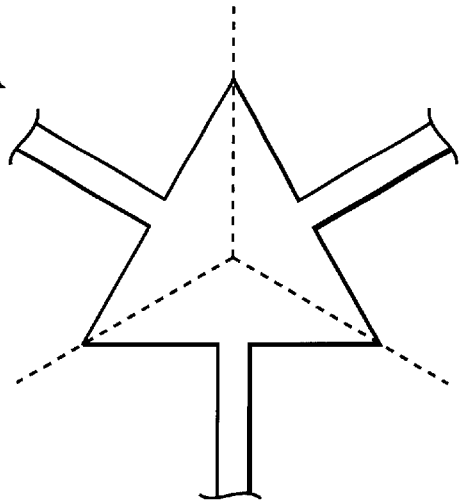
Figure 9B:
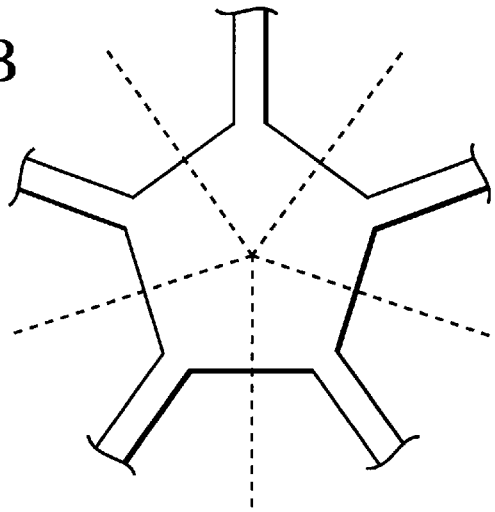
Figure 9C:
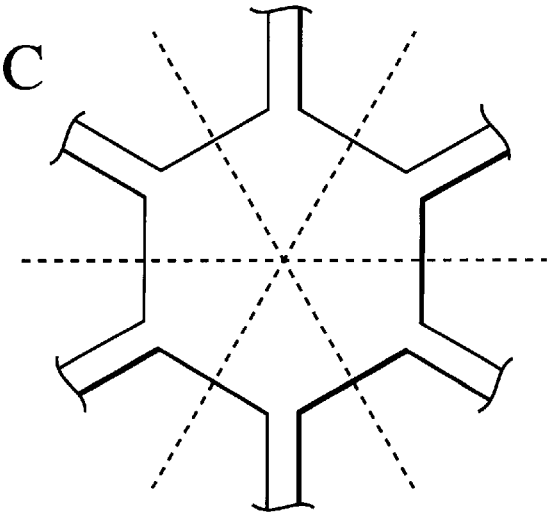
Figure 10A:
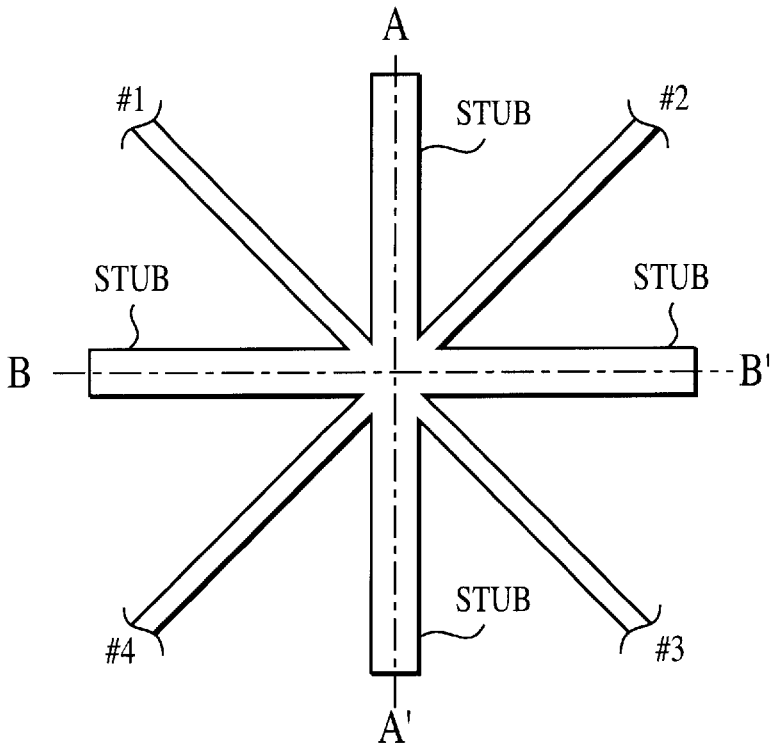
Figure 10B:
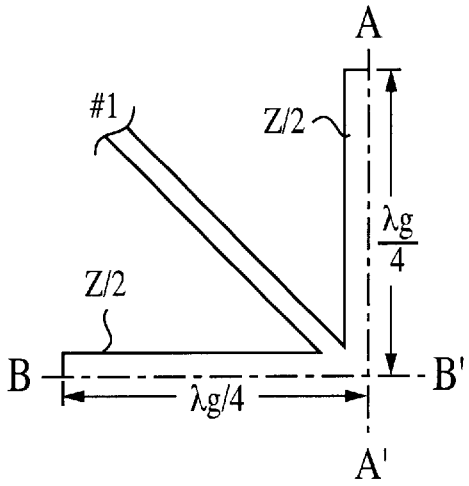
Figure 13:
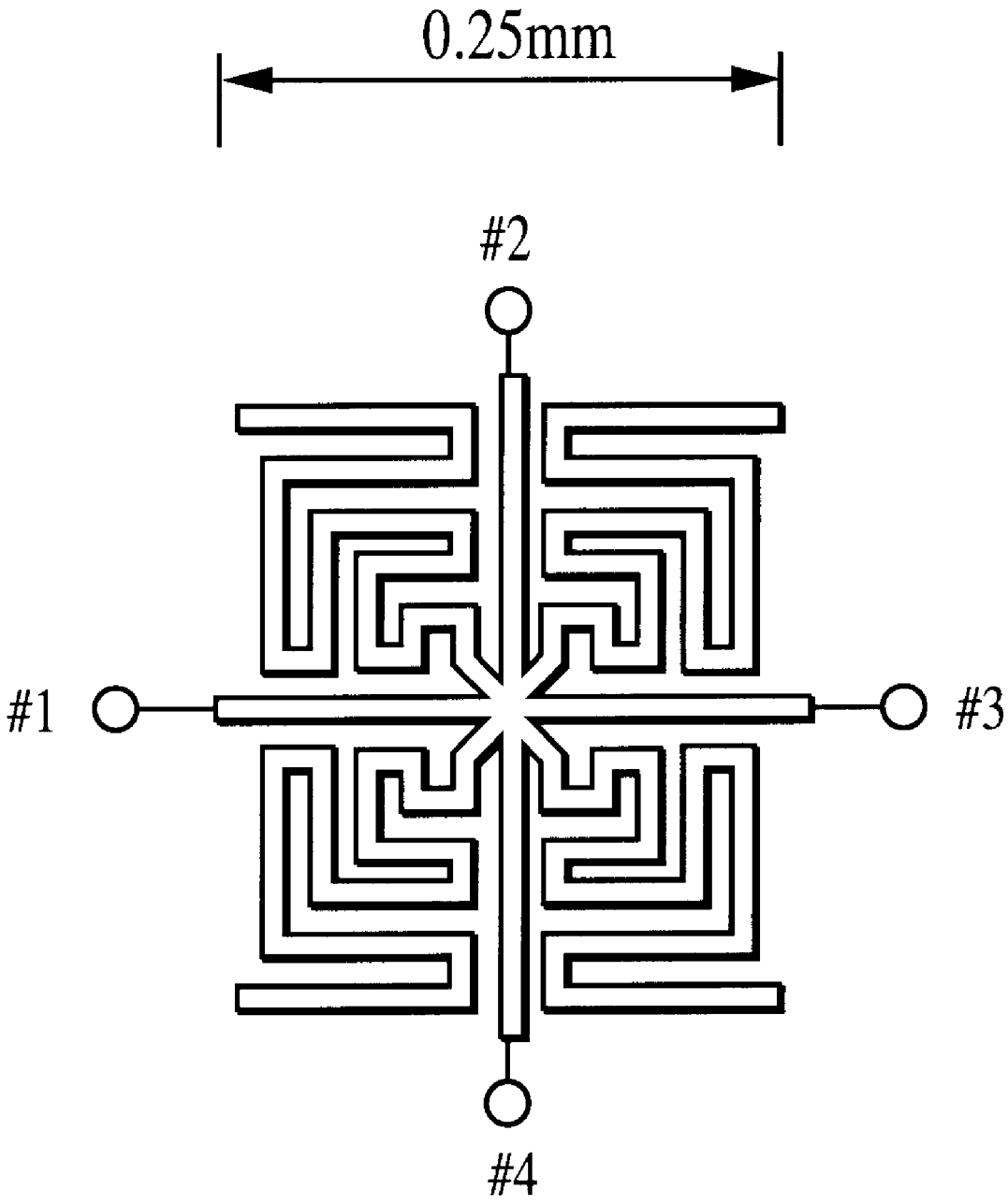
Figure 14A:
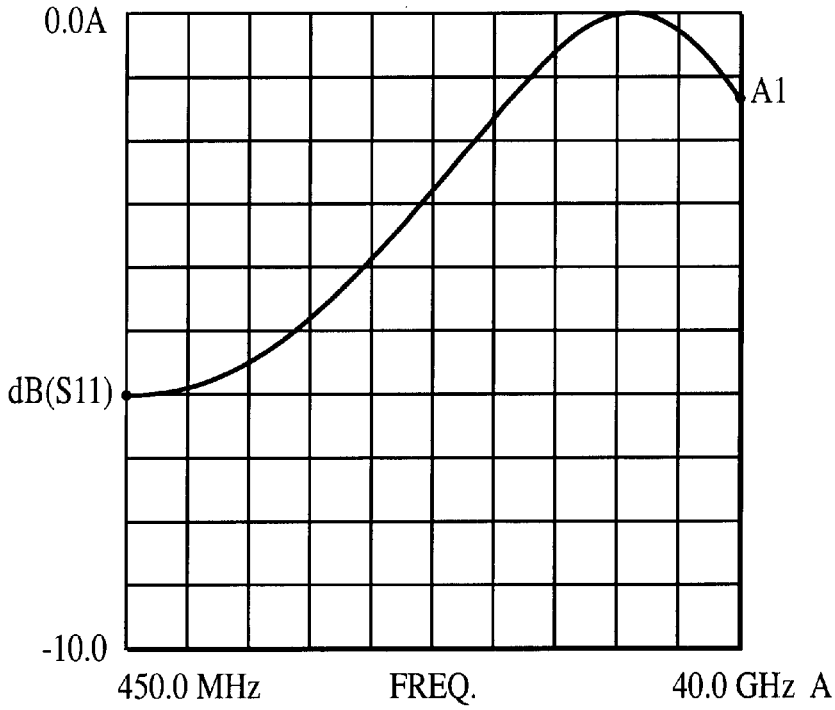
Figure 14B:
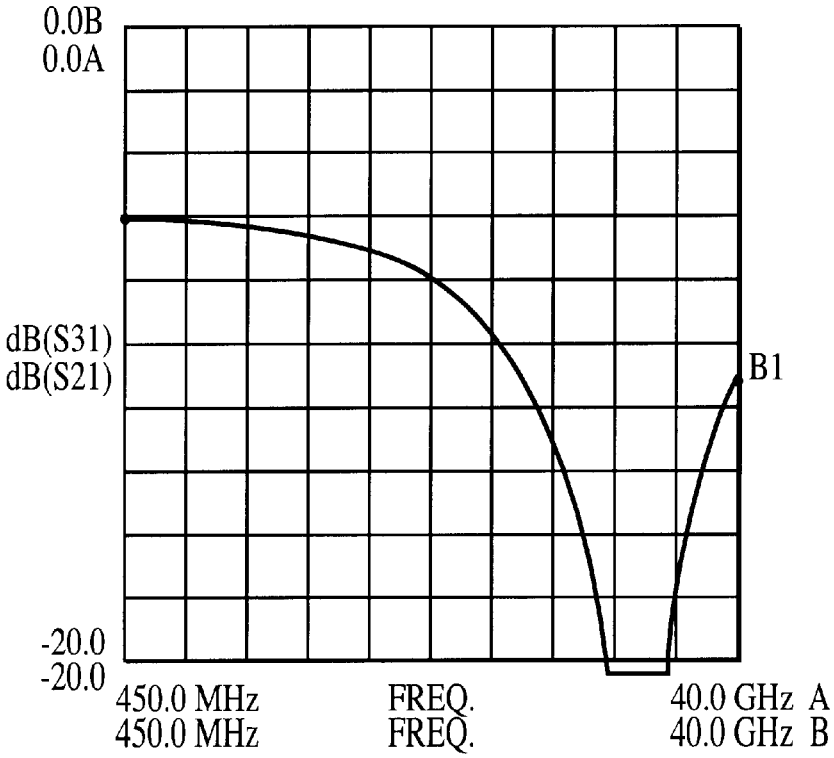
Figure 15A:
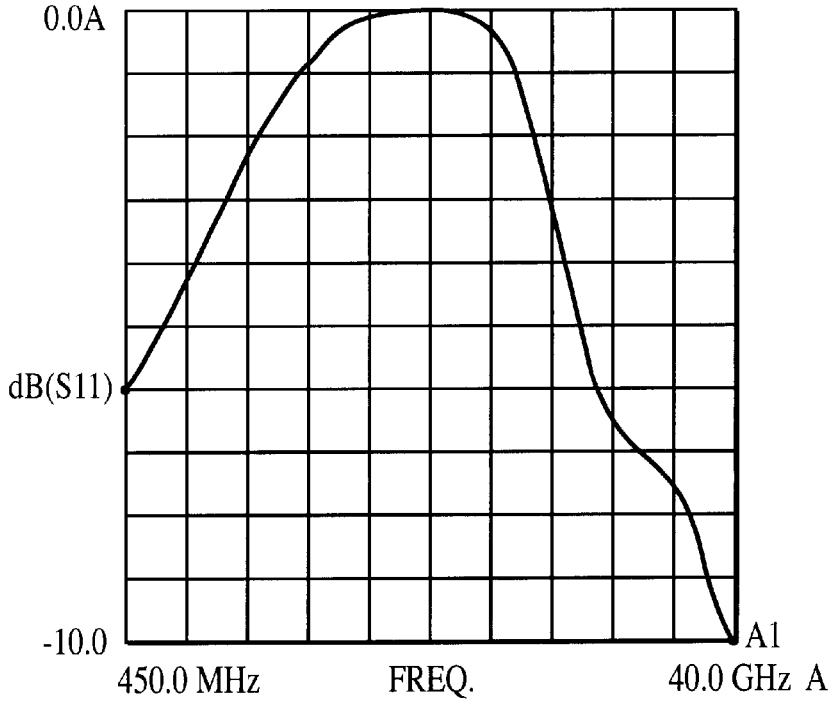
Figure 15B:
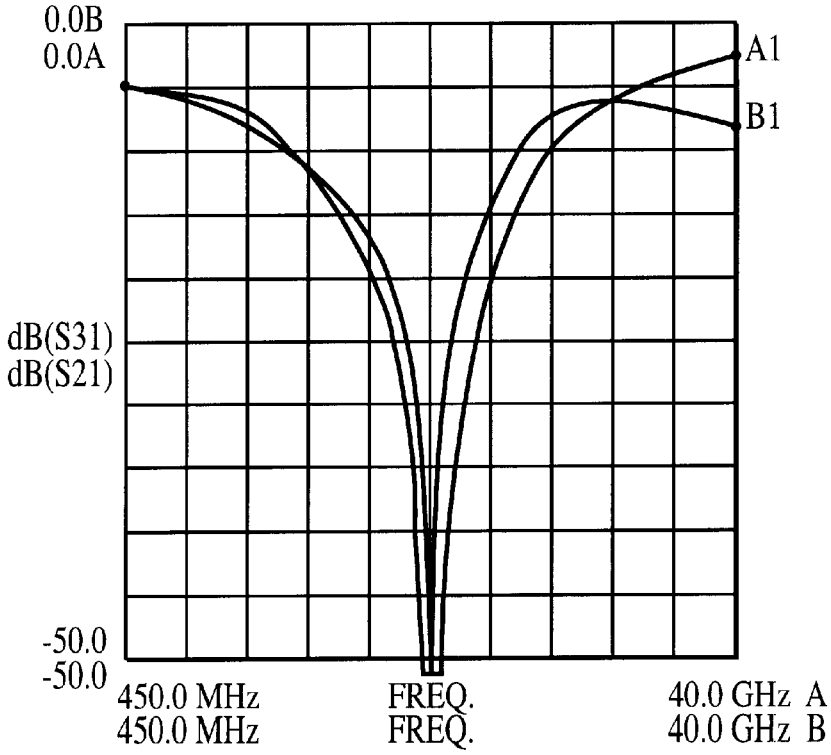
Figure 16:
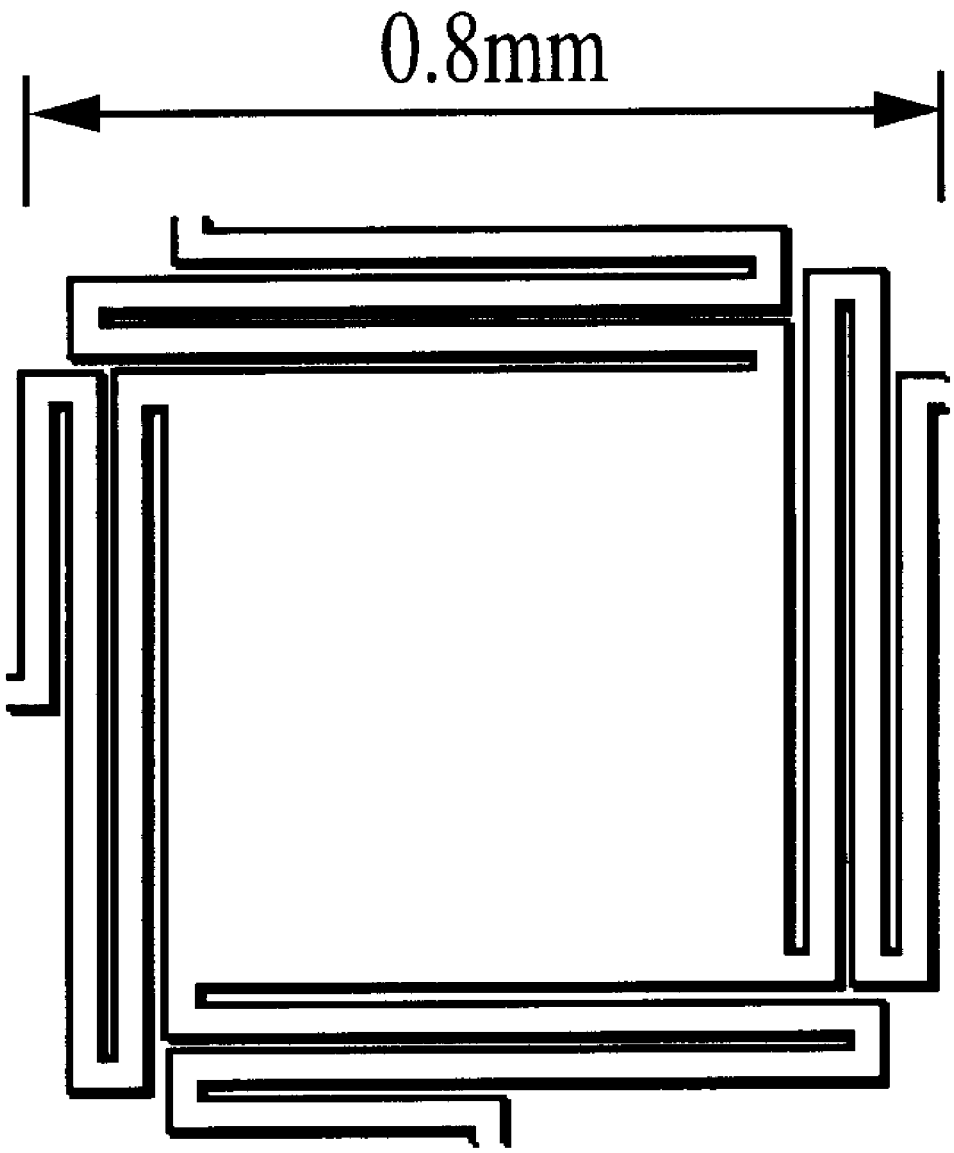
FIG. 16 PRIOR ART
Figure 17A:
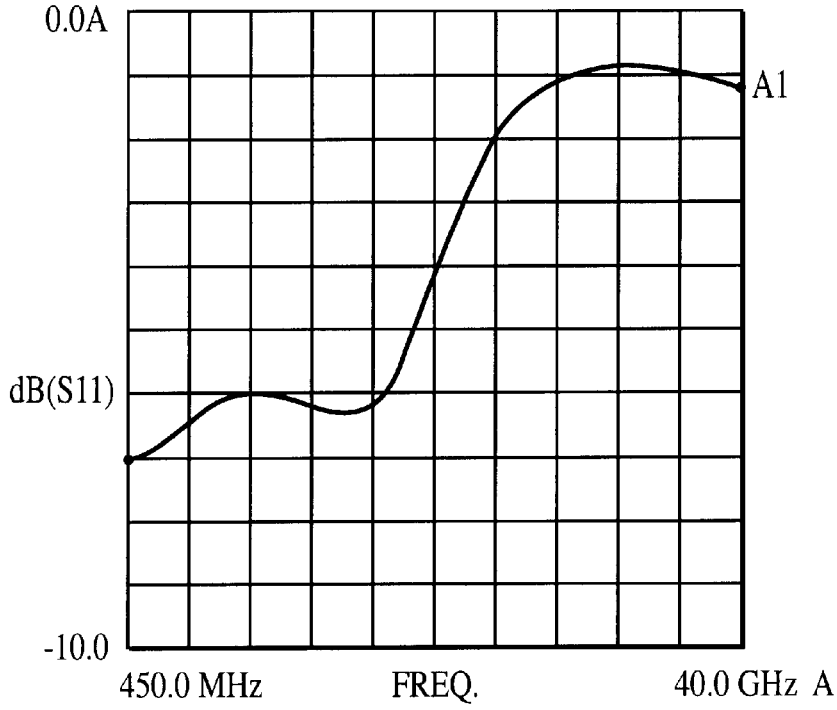
Figure 17B:
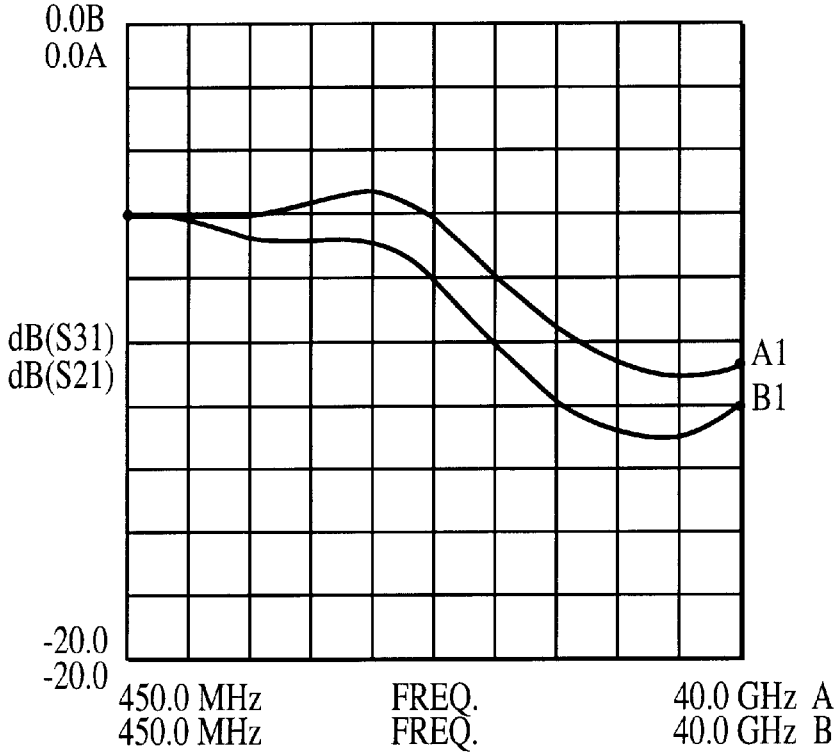
Figure 18:
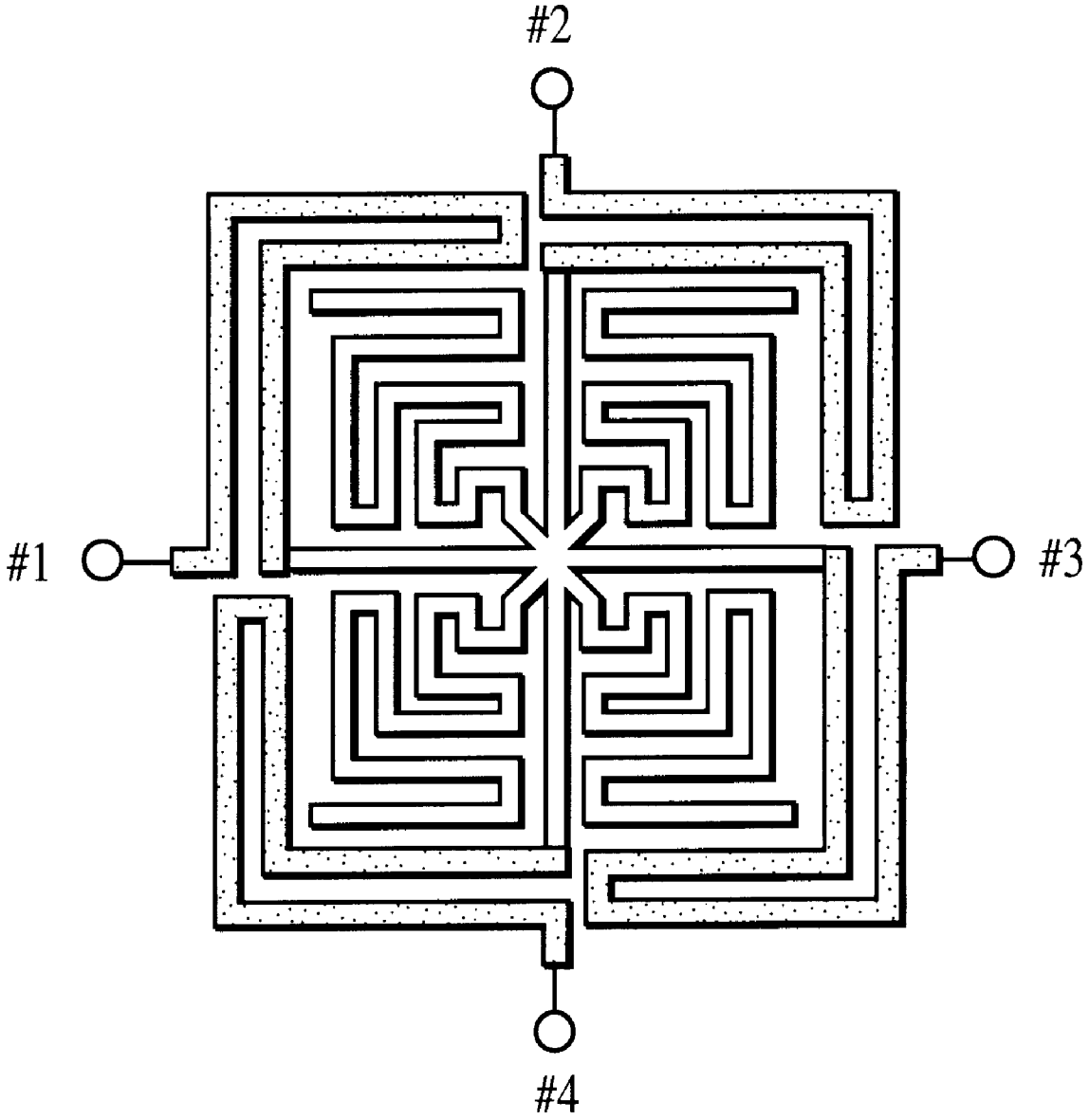
Figure 19A:
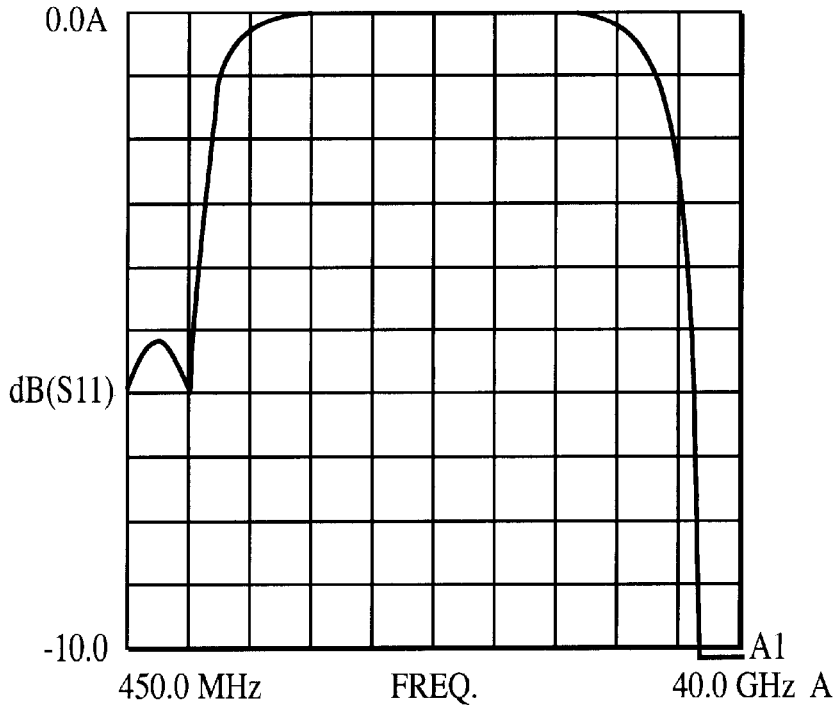
Figure 19B:
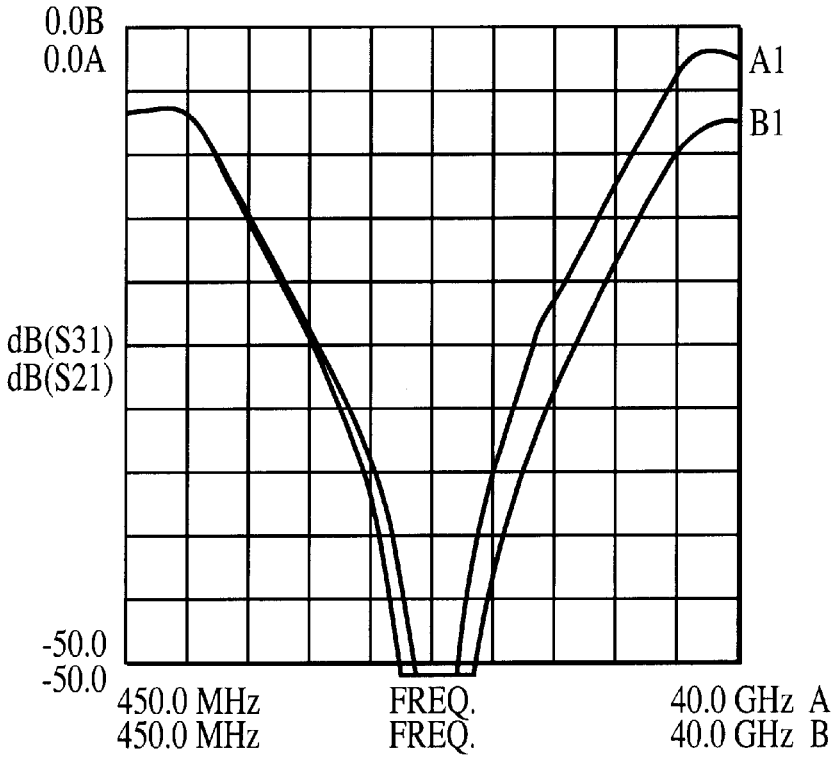
Figure 20:
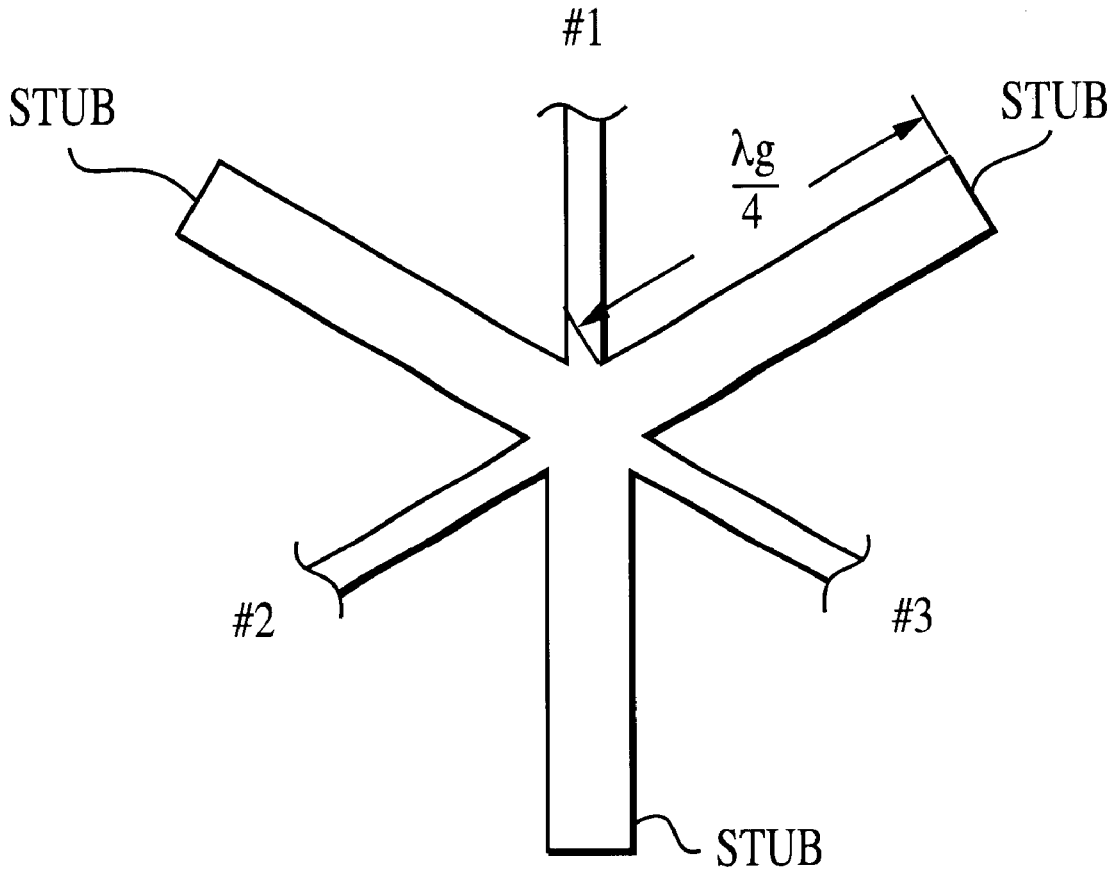
Figure 21A:
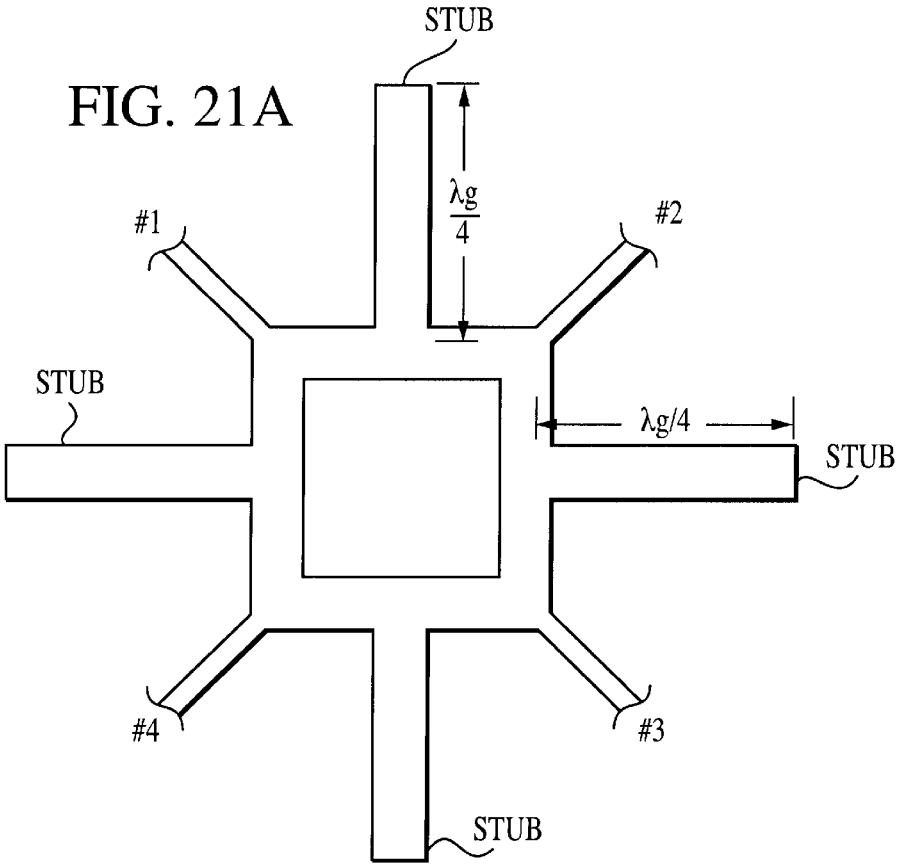
Figure 21B:
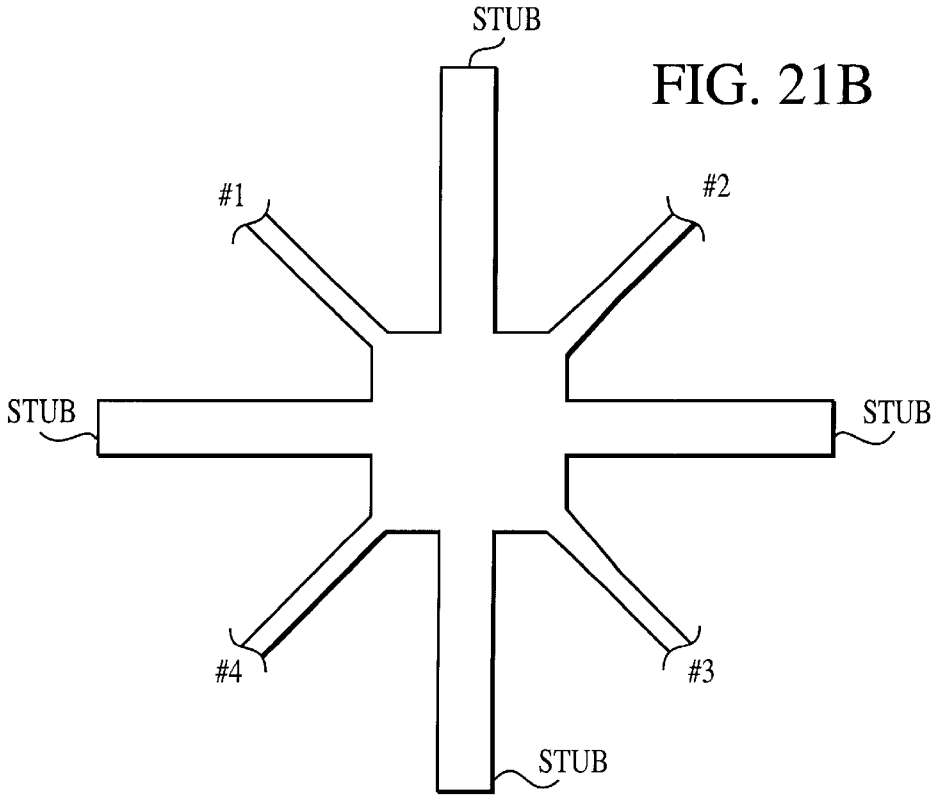
Figure 22:
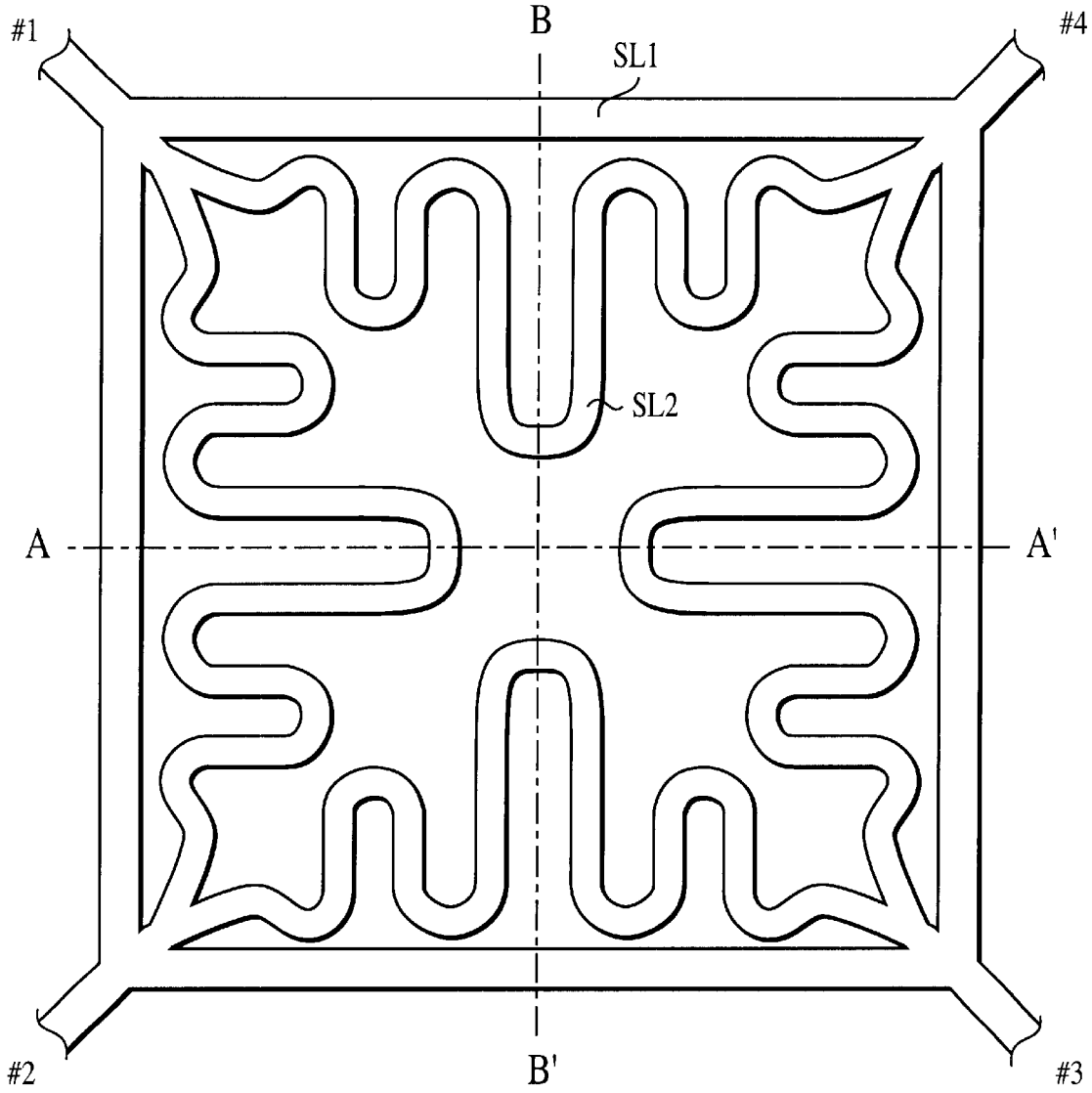
Figure 23:
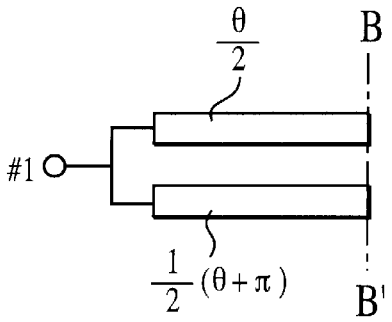
Figure 25:
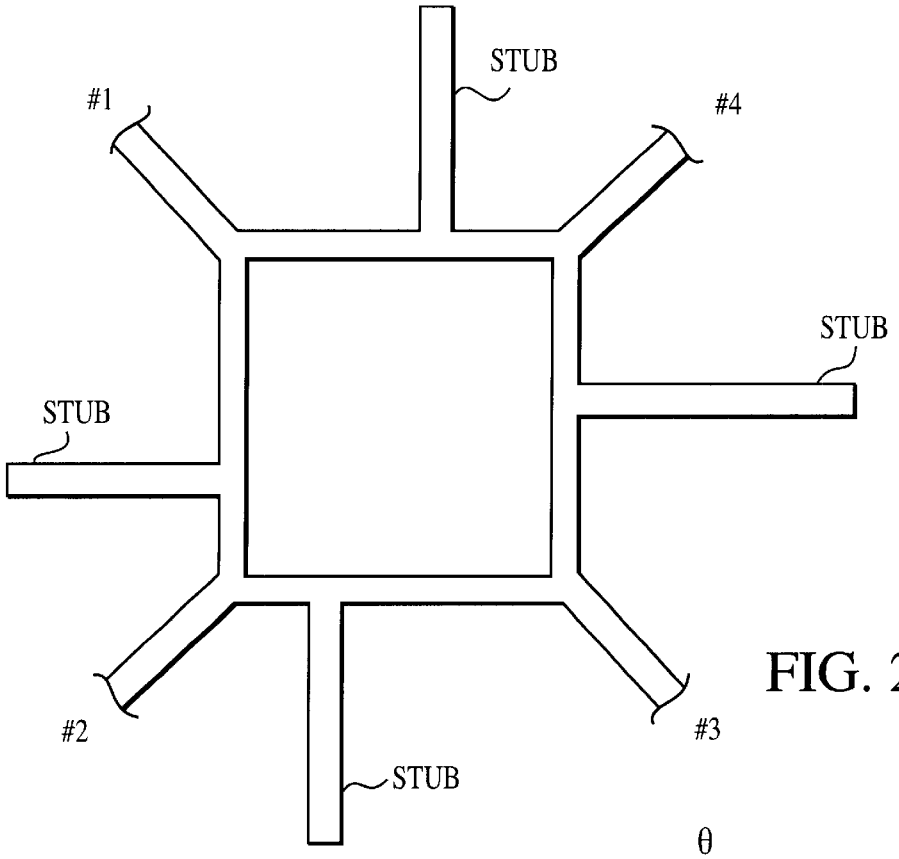
Figure 26:
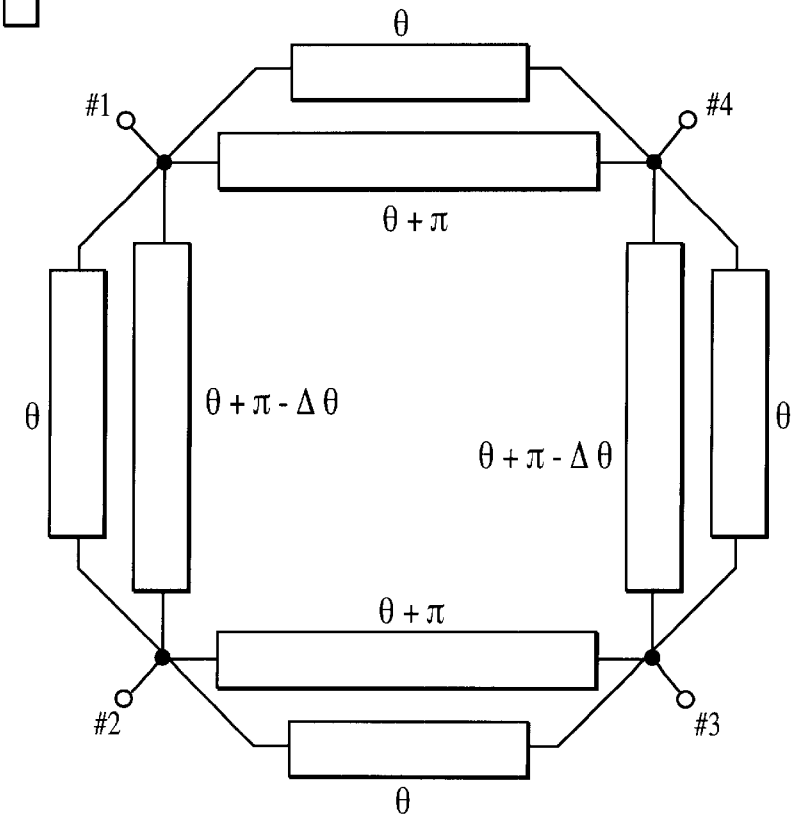
Figure 27A:
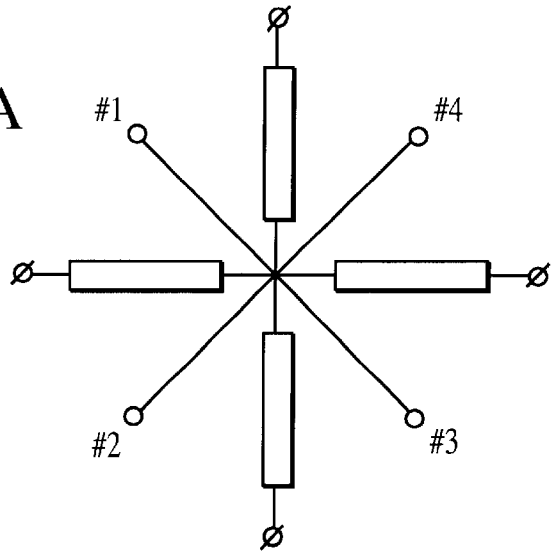
Figure 27B:
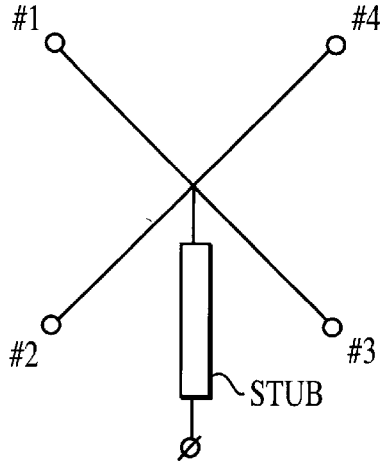
Figure 27C:
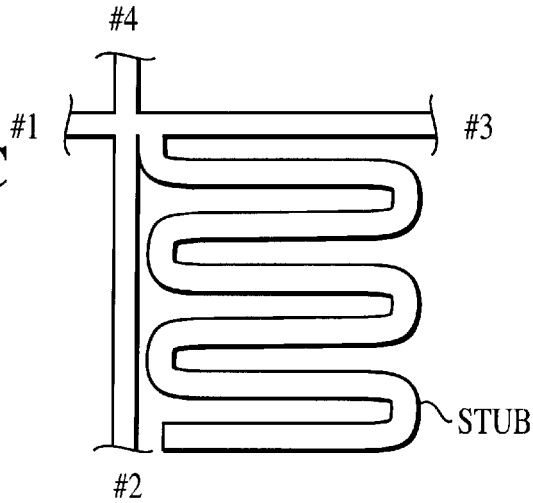

FIGS. 6A, 6B, 6C, and 6D illustrate ¼ circuit parts of the four-port circuit, and four types of characteristic excitation modes, respectively;

FIG. 7A illustrates the fundamental form of the four-port circuit;

FIG. 7B illustrates a ¼ circuit part of the four-port circuit;

FIGS. 7C and 7D illustrate ⅛ circuit parts of the four-port circuit, respectively;

FIGS. 8A, 8B, and 8C illustrate the total reflection condition of a two-port circuit, respectively;

FIGS. 9A, 9B, and 9C illustrate some fundamental forms of multi-port circuits;

FIG. 10A illustrates a fundamental pattern in a spurious mode wave propagation-blocking circuit;

FIG. 10B illustrates the shape and size of a ¼ circuit part of the fundamental pattern;

FIGS. 11A, 11B, 11C, and 11D are equivalent circuit diagrams of the four characteristic excitation modes of the fundamental pattern;

FIGS. 12A to 12E illustrate examples of electric field distributions of various mode waves generated about a stub;

FIG. 13 illustrates an example of a fundamental pattern in a spurious mode wave propagation-blocking circuit;

FIGS. 14A and 14B are graphs showing the frequency characteristics of the parameters produced between two neighboring ports in the fundamental pattern;

FIGS. 15A and 15B illustrate the frequency characteristics of the parameters, obtained when the application frequency for the fundamental pattern is changed;

FIG. 16 illustrates an example of a conventional fundamental pattern as a comparable example;

FIGS. 17A and 17B illustrate the frequency characteristics of the parameters between two neighboring ports of the fundamental pattern;

FIG. 18 illustrates an example of another fundamental pattern in a spurious mode wave propagation-blocking circuit;

FIG. 19 illustrates the frequency characteristic of the parameters produced between two neighboring ports of the fundamental pattern;

FIG. 20 illustrates an example of a fundamental pattern in a three-port circuit;

FIGS. 21A and 21B illustrate modification examples of a fundamental pattern in a four-port circuit;

FIG. 22 illustrates an example of a fundamental pattern in a circuit in which two strip conductors are connected in parallel to each other between two neighboring ports;

FIG. 23 is an equivalent circuit diagram of a ⅛ circuit part of the fundamental pattern;

FIGS. 24A, 24B, 24C, and 24D are equivalent circuit diagrams, obtained when the symmetric plane of the equivalent circuit is open;

FIG. 25 illustrates an example of another fundamental pattern in a four-port circuit;

FIG. 26 is an equivalent circuit diagram of yet another fundamental pattern;

FIGS. 27A and 27B are equivalent circuit diagrams of another fundamental pattern in a four-port circuit, and FIG. 27C shows a strip conductor pattern.

Figure 28:
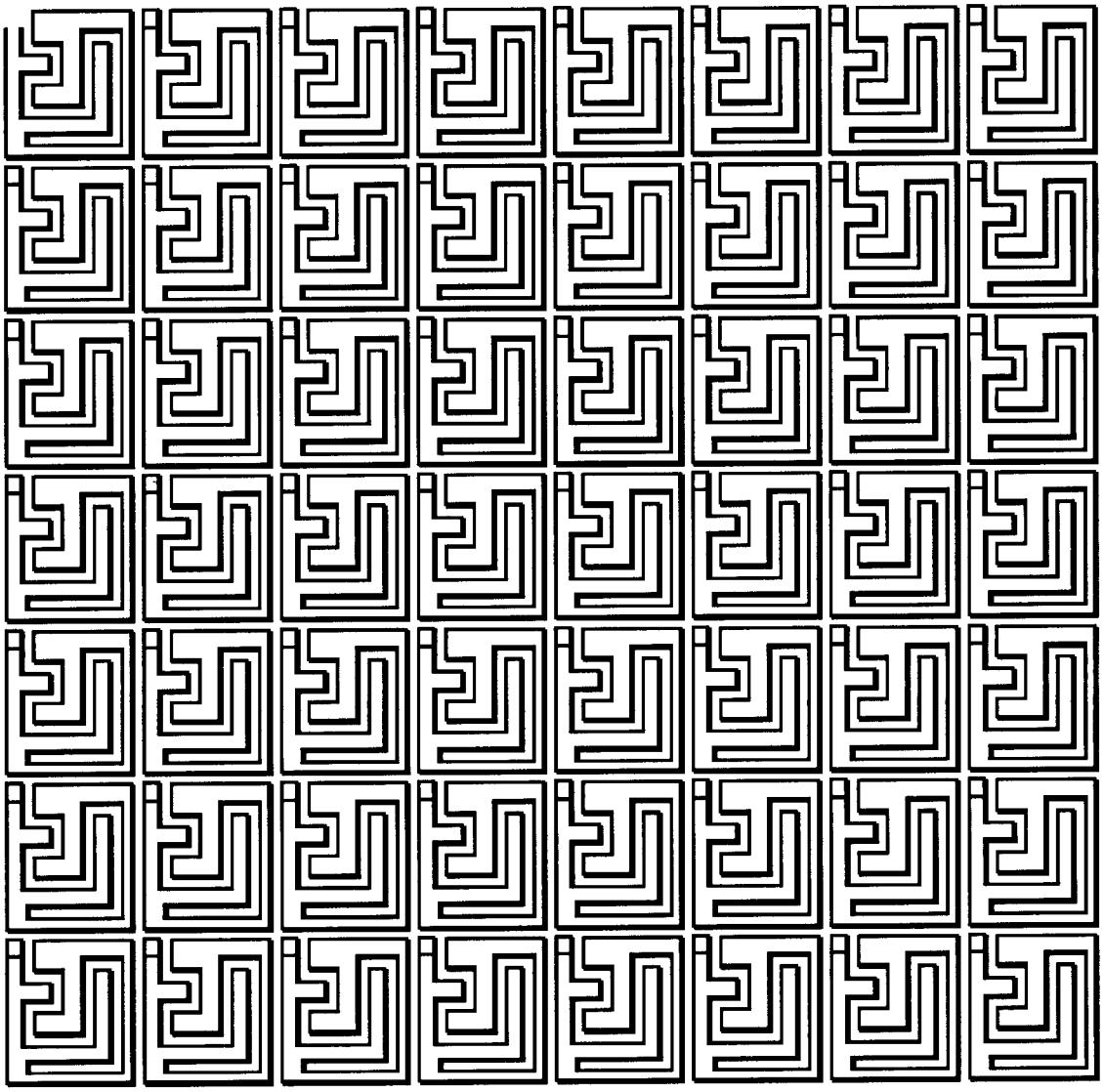
Figure 29A:
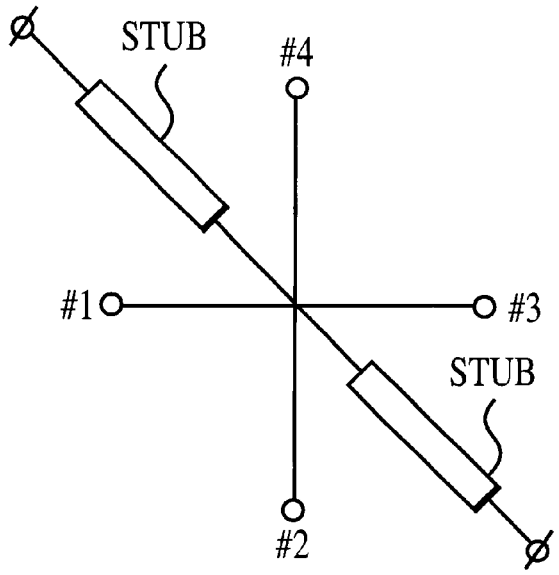
Figure 29B:
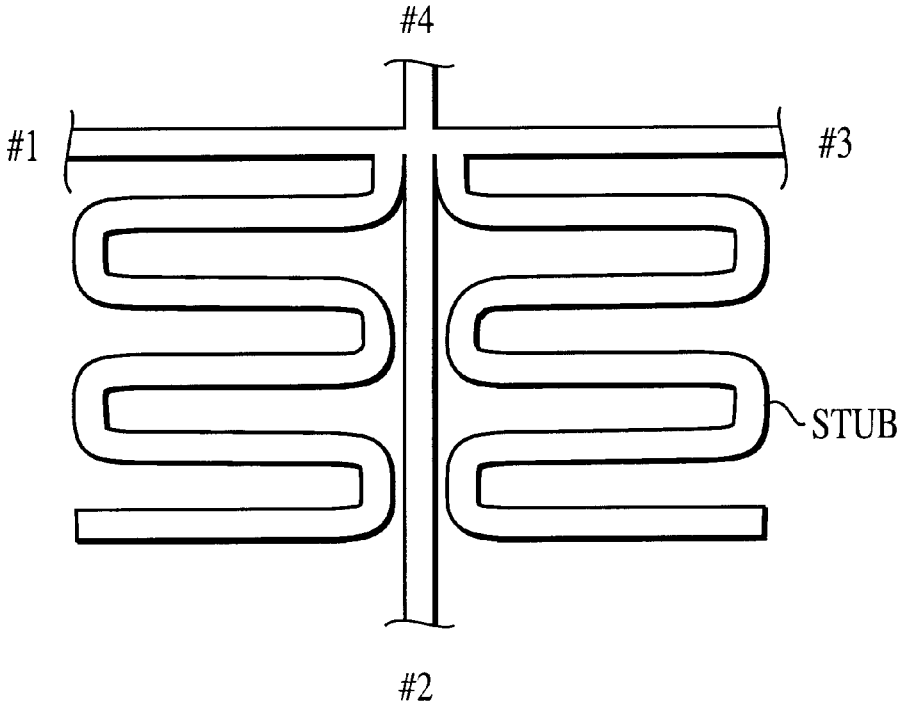
Figure 30A:
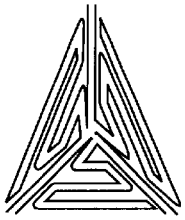
Figure 30B:
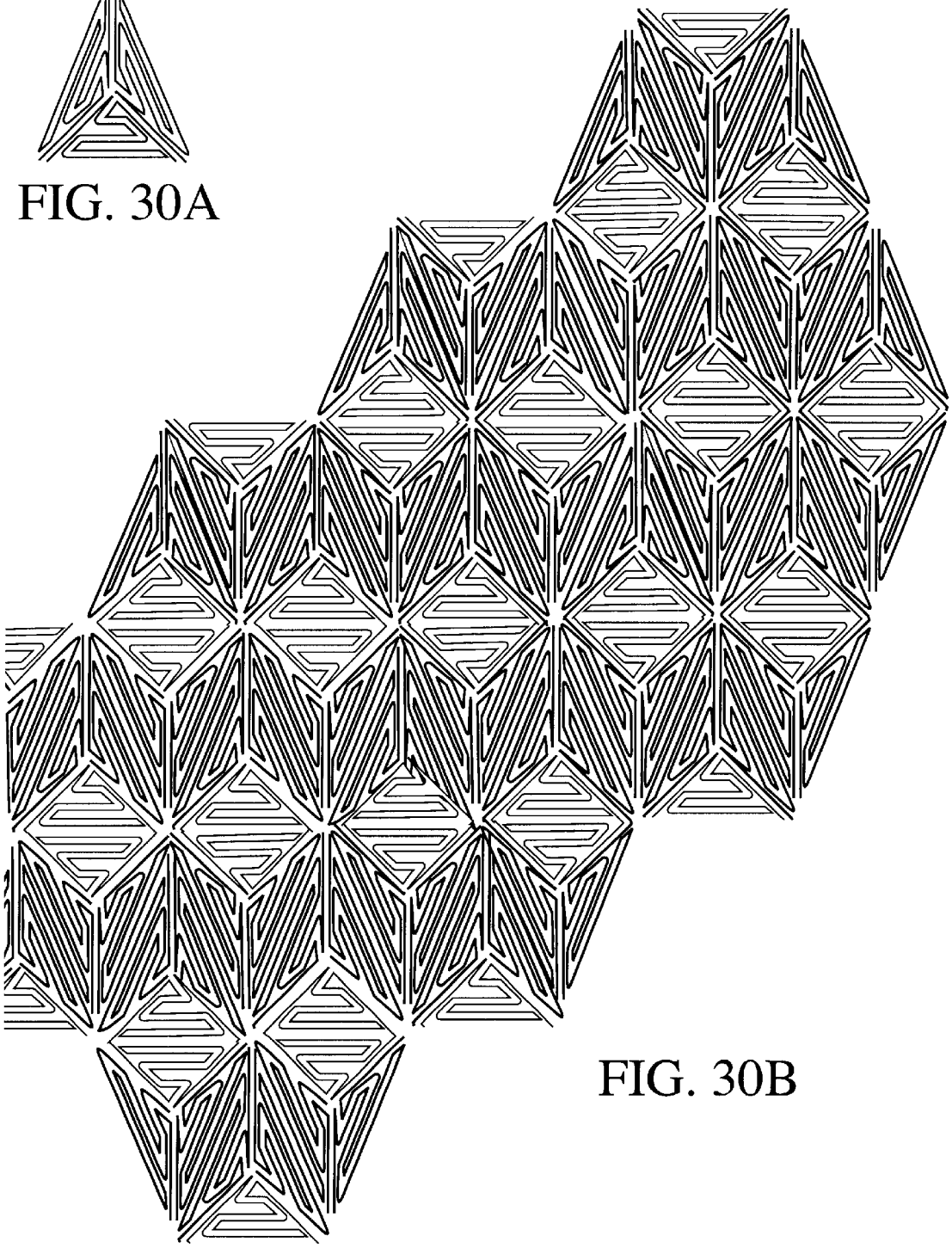
Figure 31:
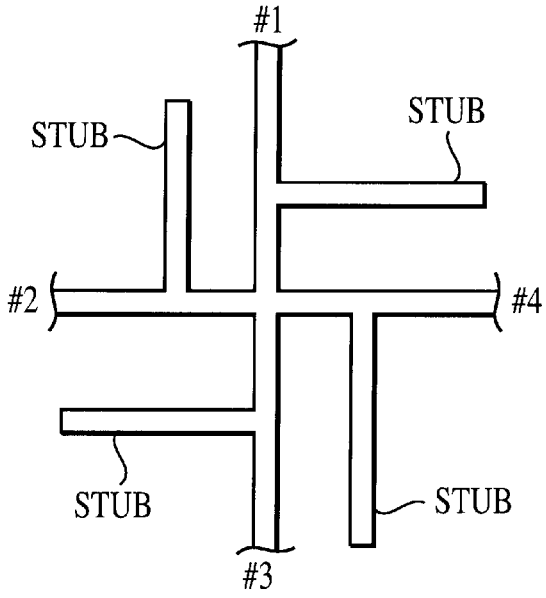
Figure 32:
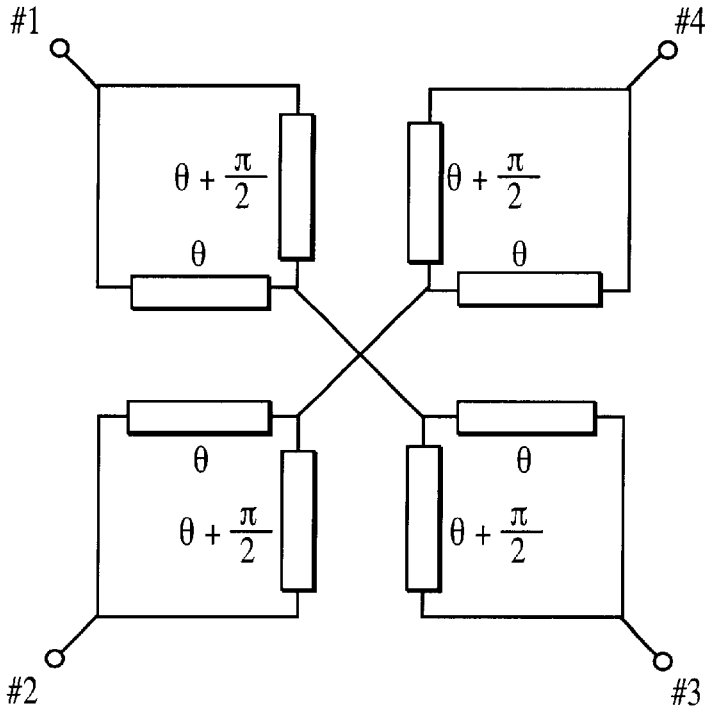
Figure 33:
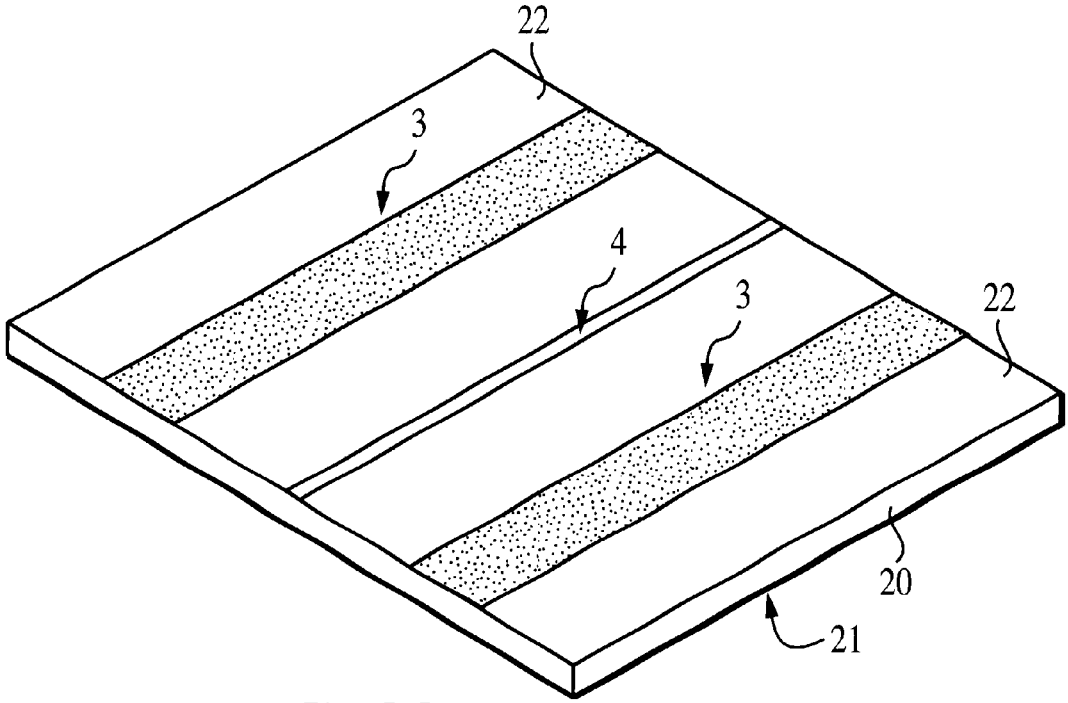
Figure 34:
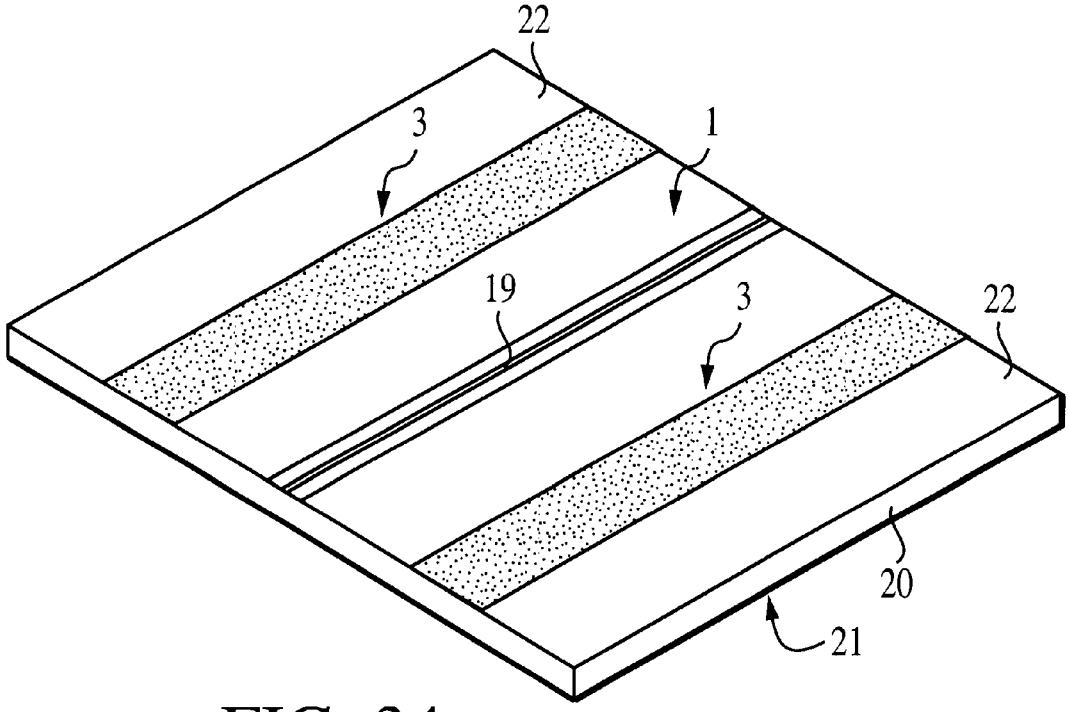
Figure 35A:
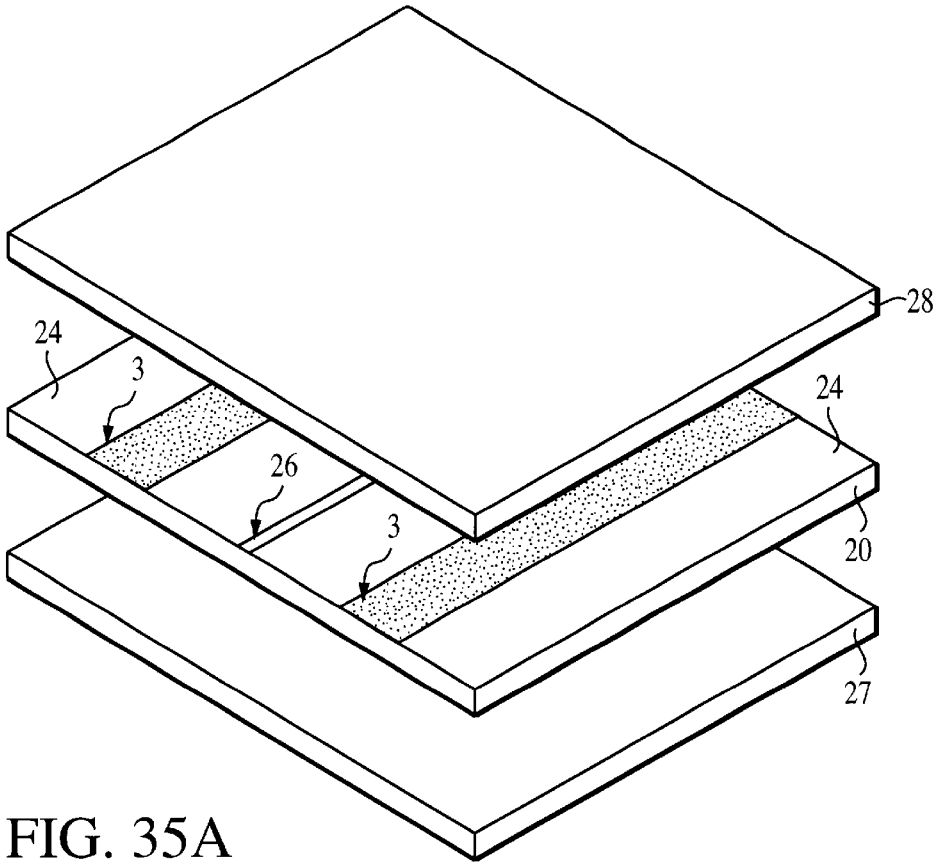
Figure 35B:
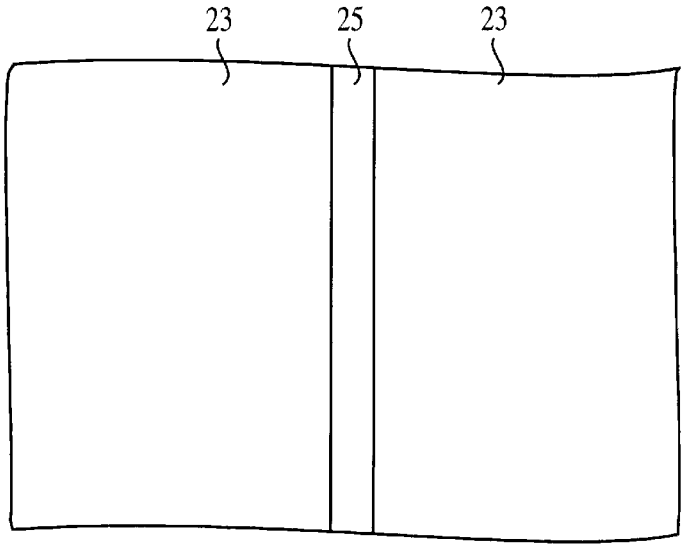
Figure 36A:
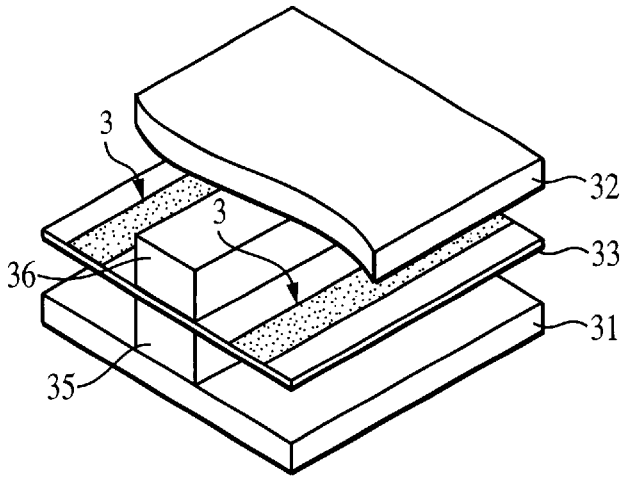
Figure 36B:
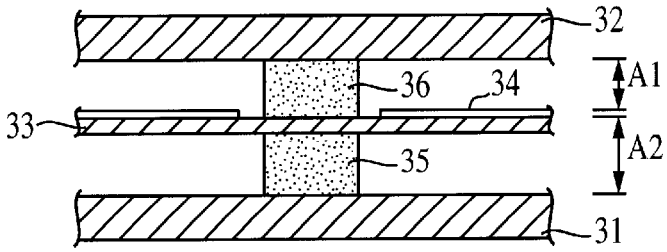
Figure 37:
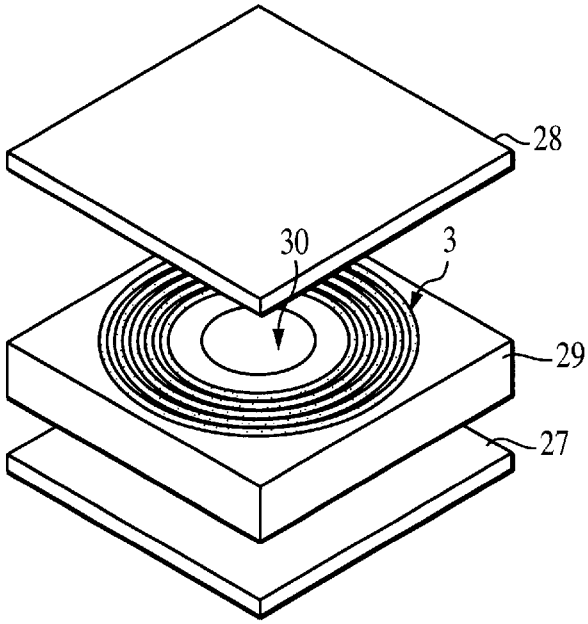
Figure 38:
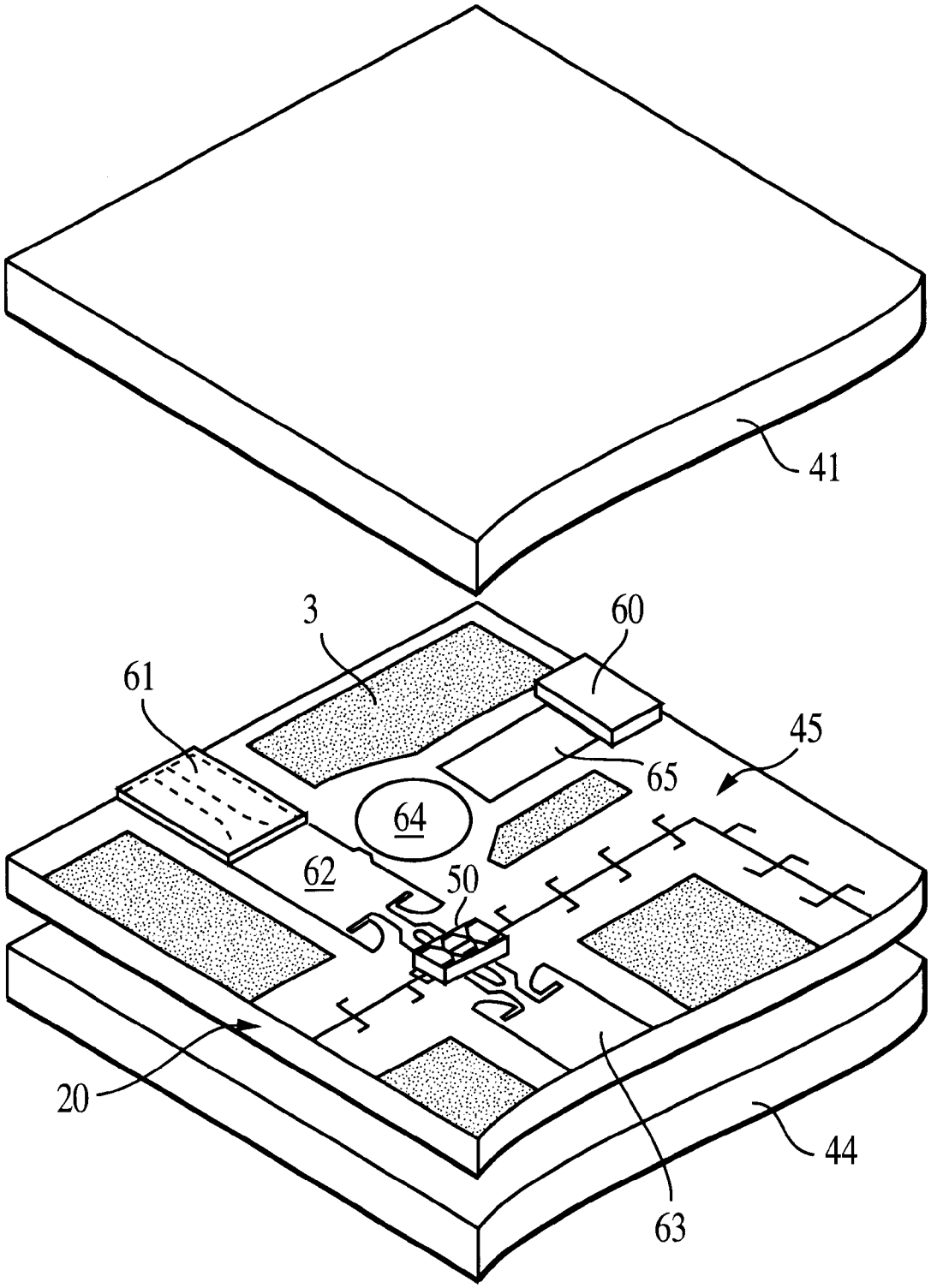
Figure 39A:
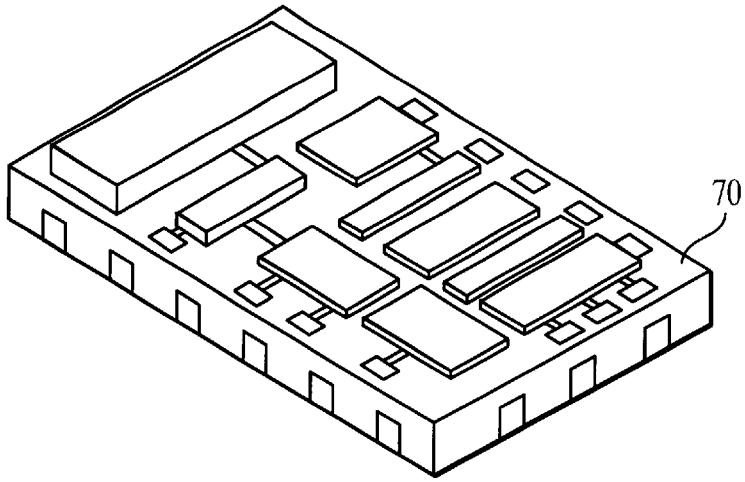
Figure 39B:
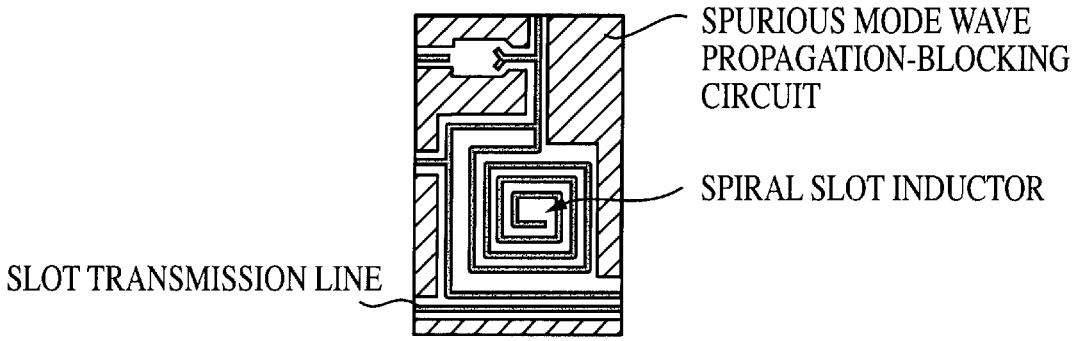
Figure 40:
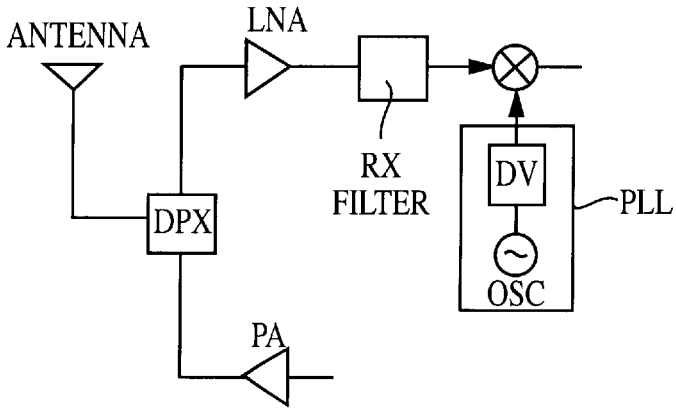
Figure 41:
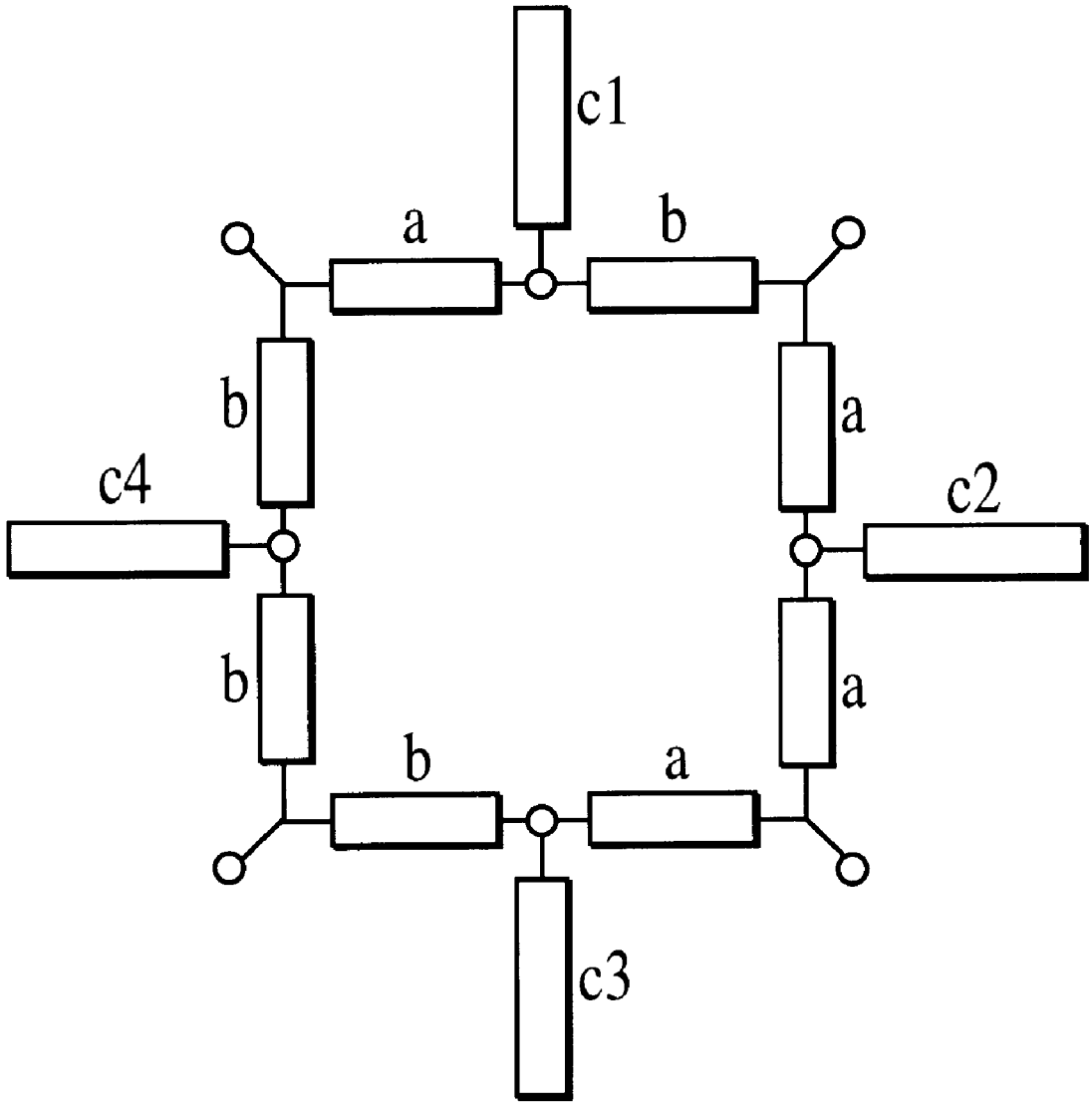
Figure 42A:
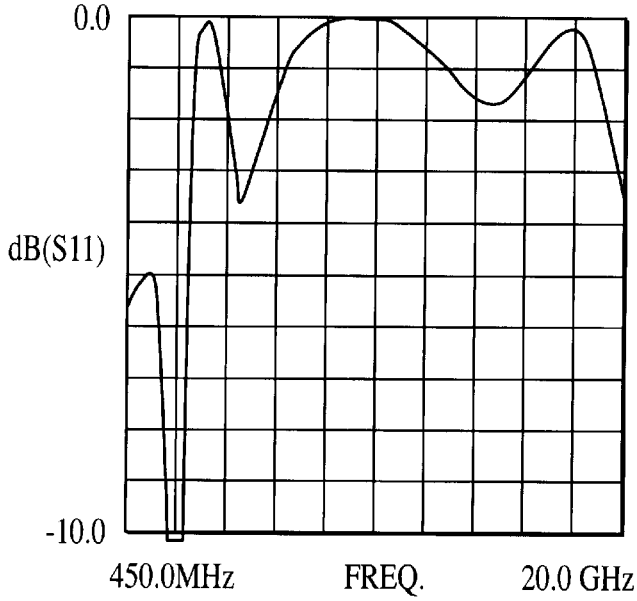
Figure 42B:
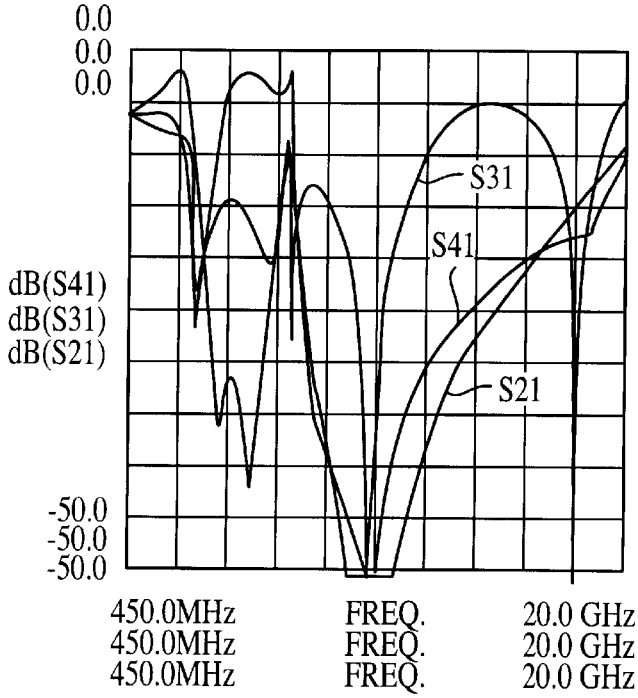
Figure 43A:
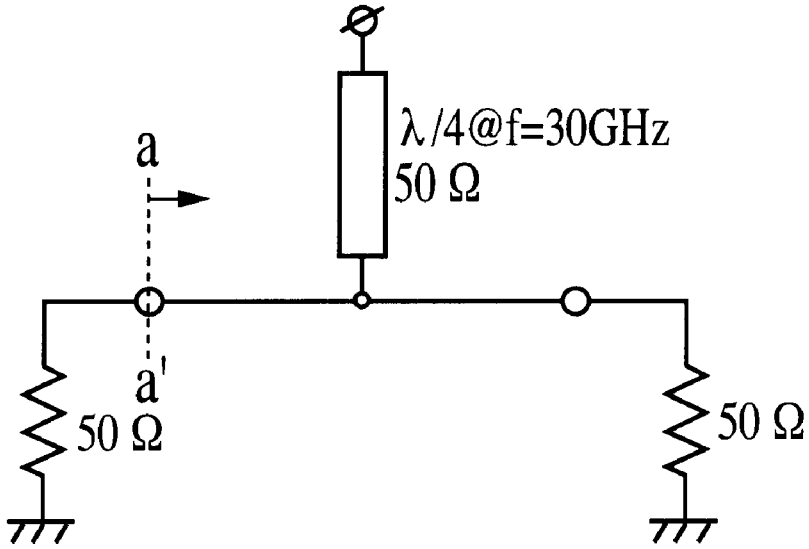
Figure 43B:
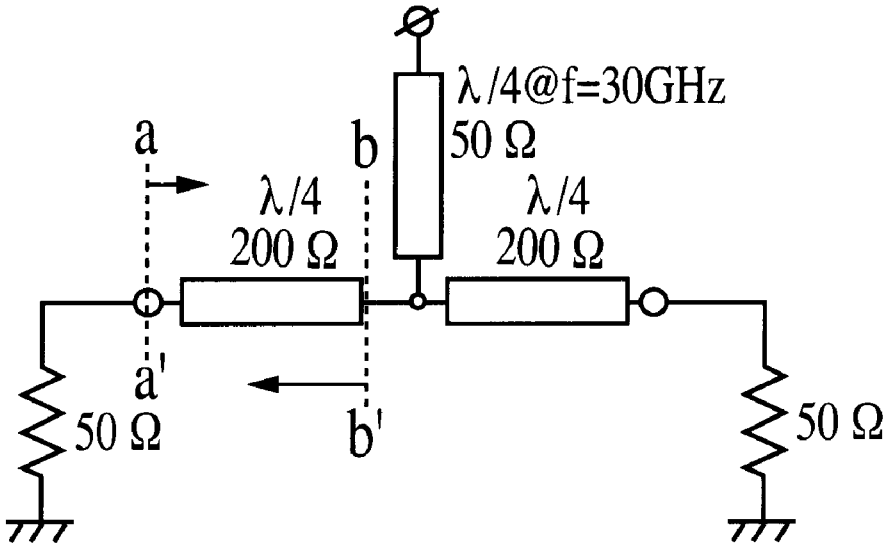
Figure 44A:
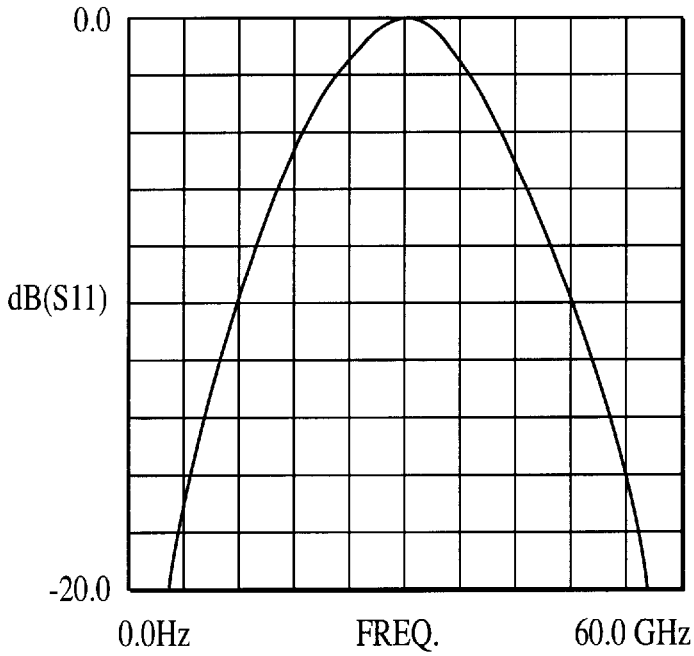
Figure 44B:
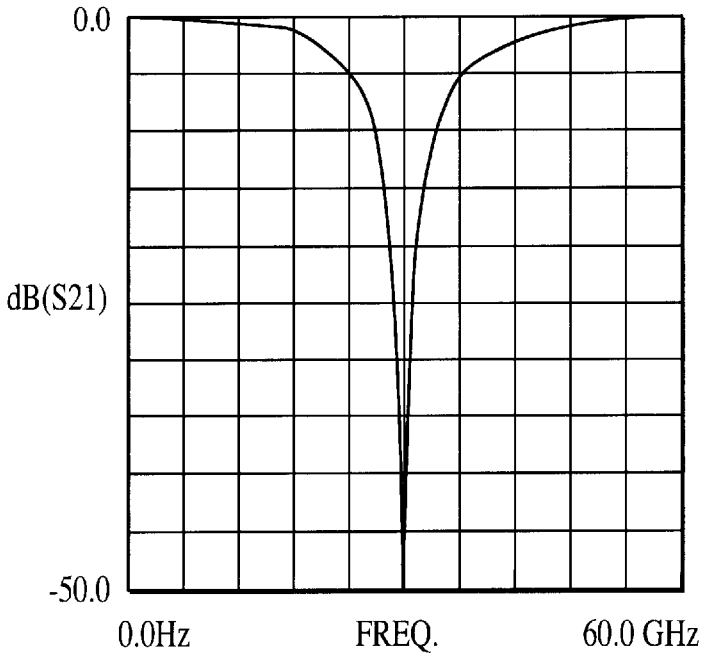
Figure 45:
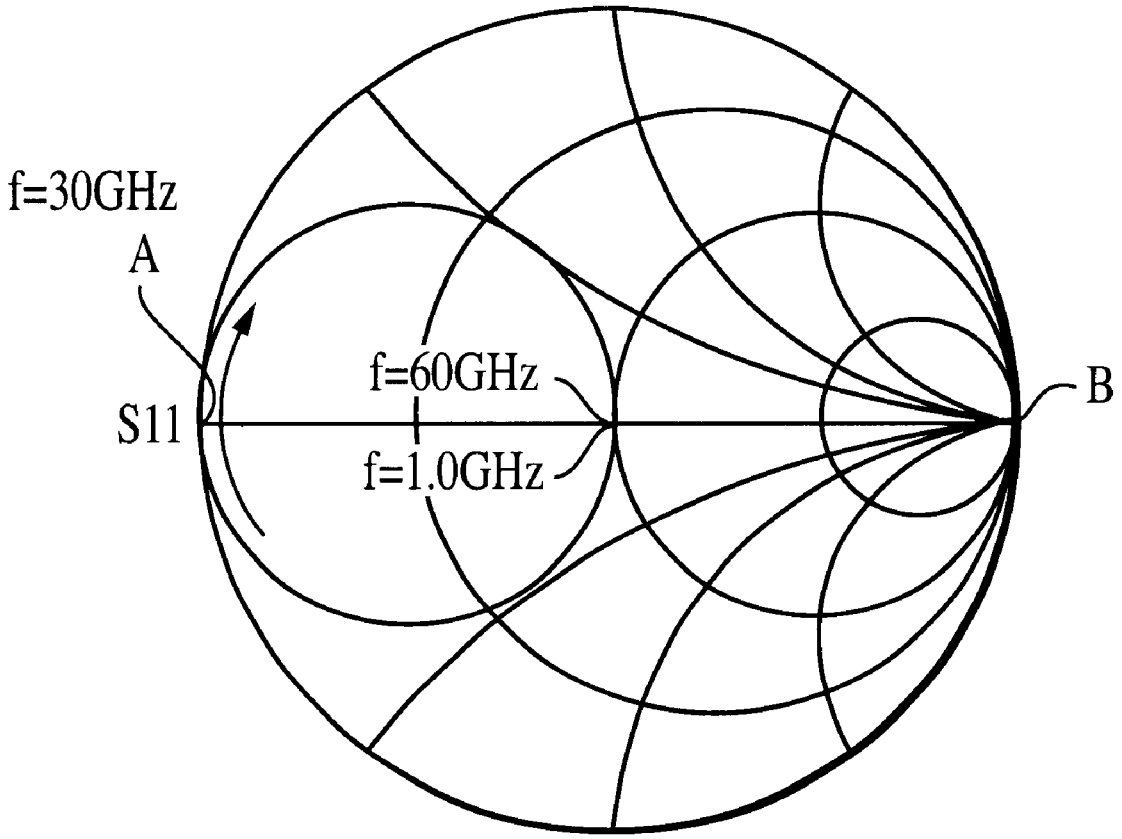
Figure 46A:
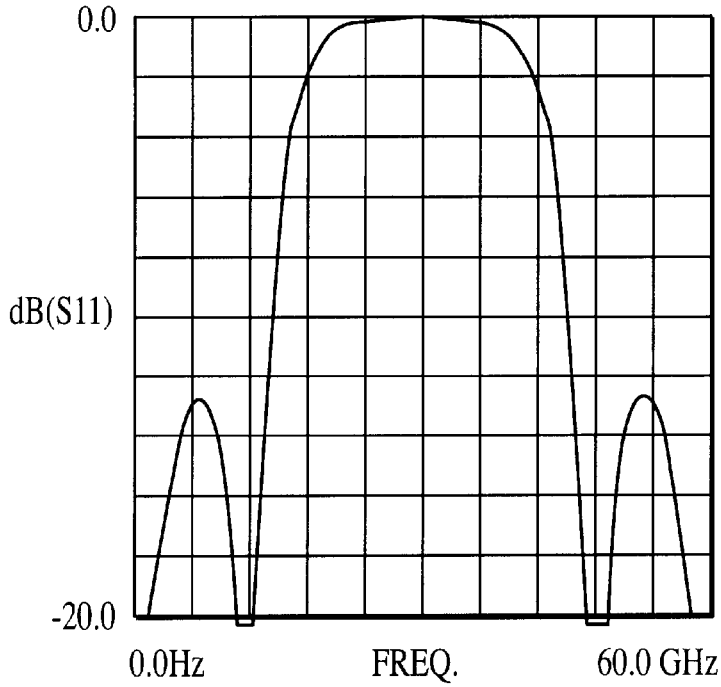
Figure 46B:
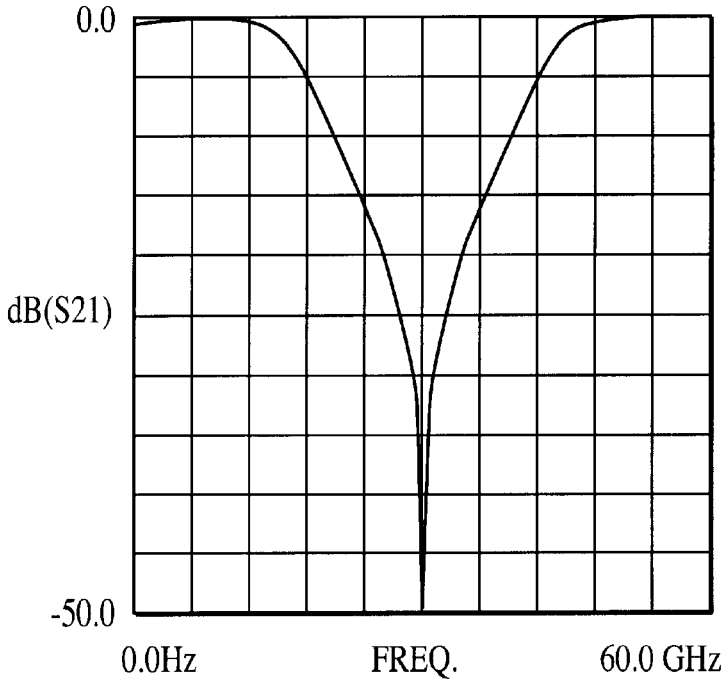
Figure 47:
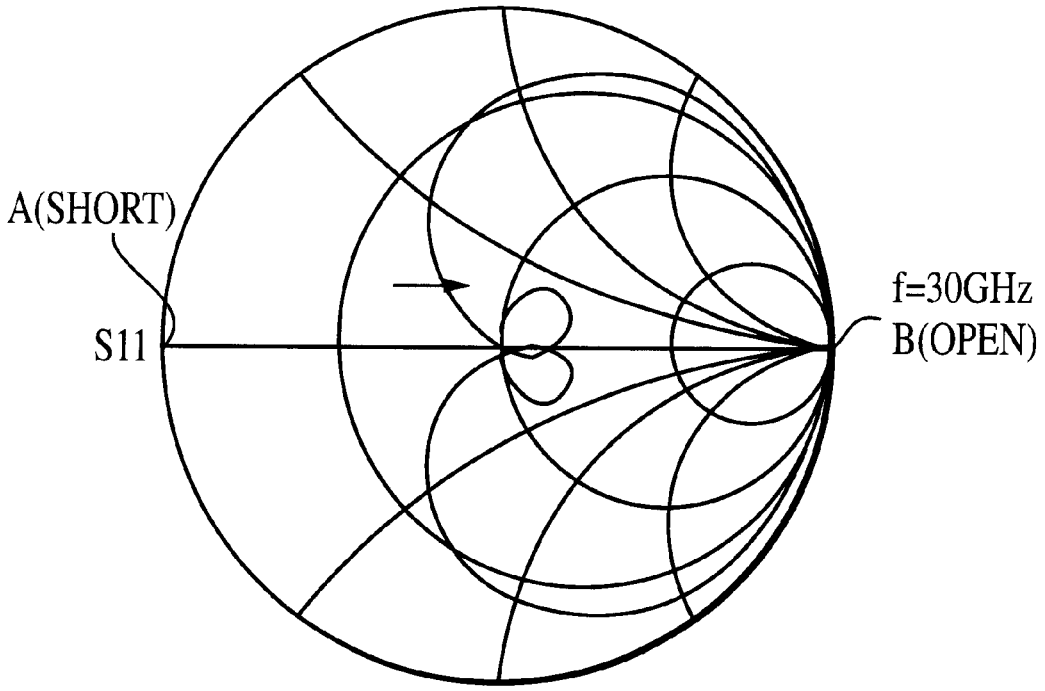
Figure 48:
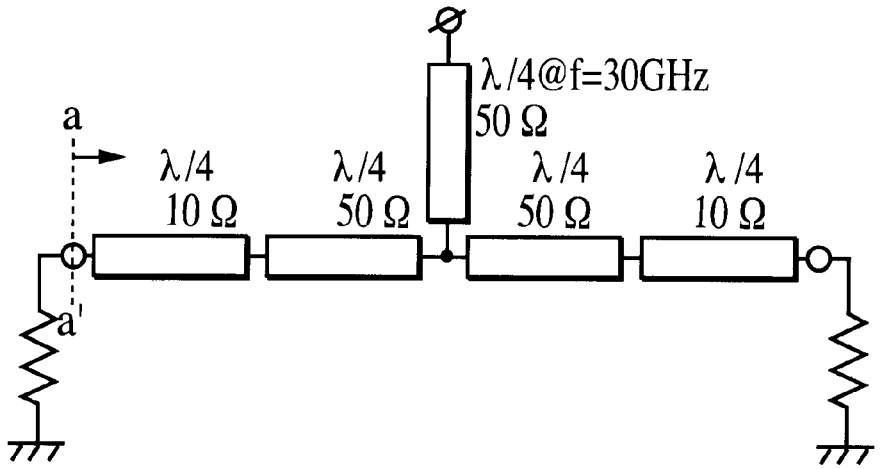
Figure 49A:
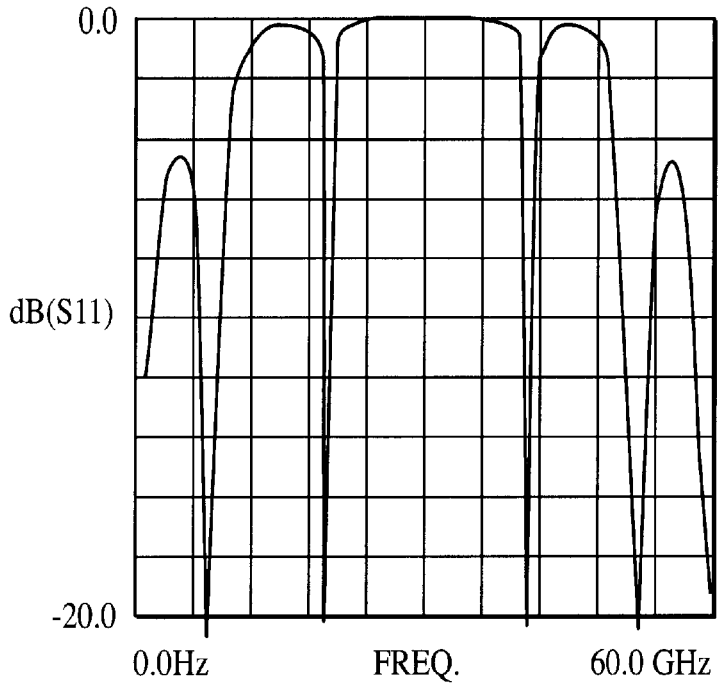
Figure 49B:
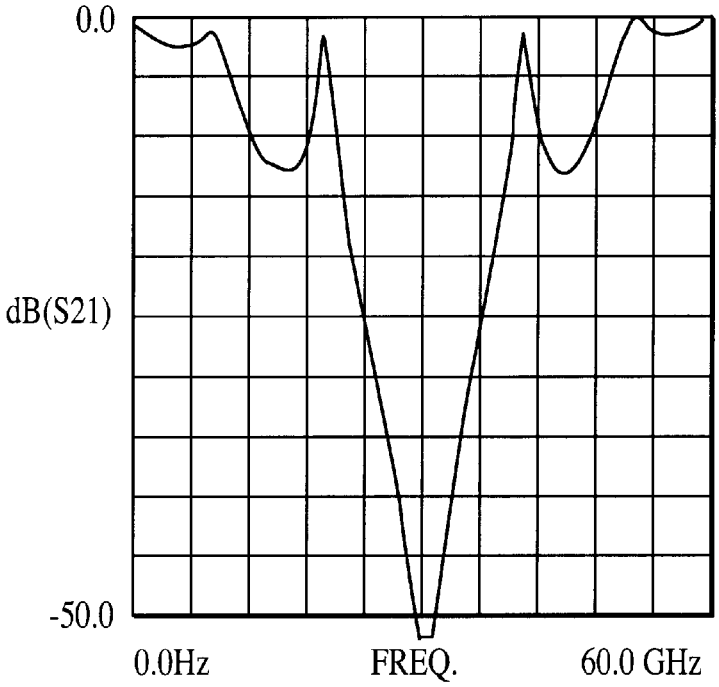
Figure 50:
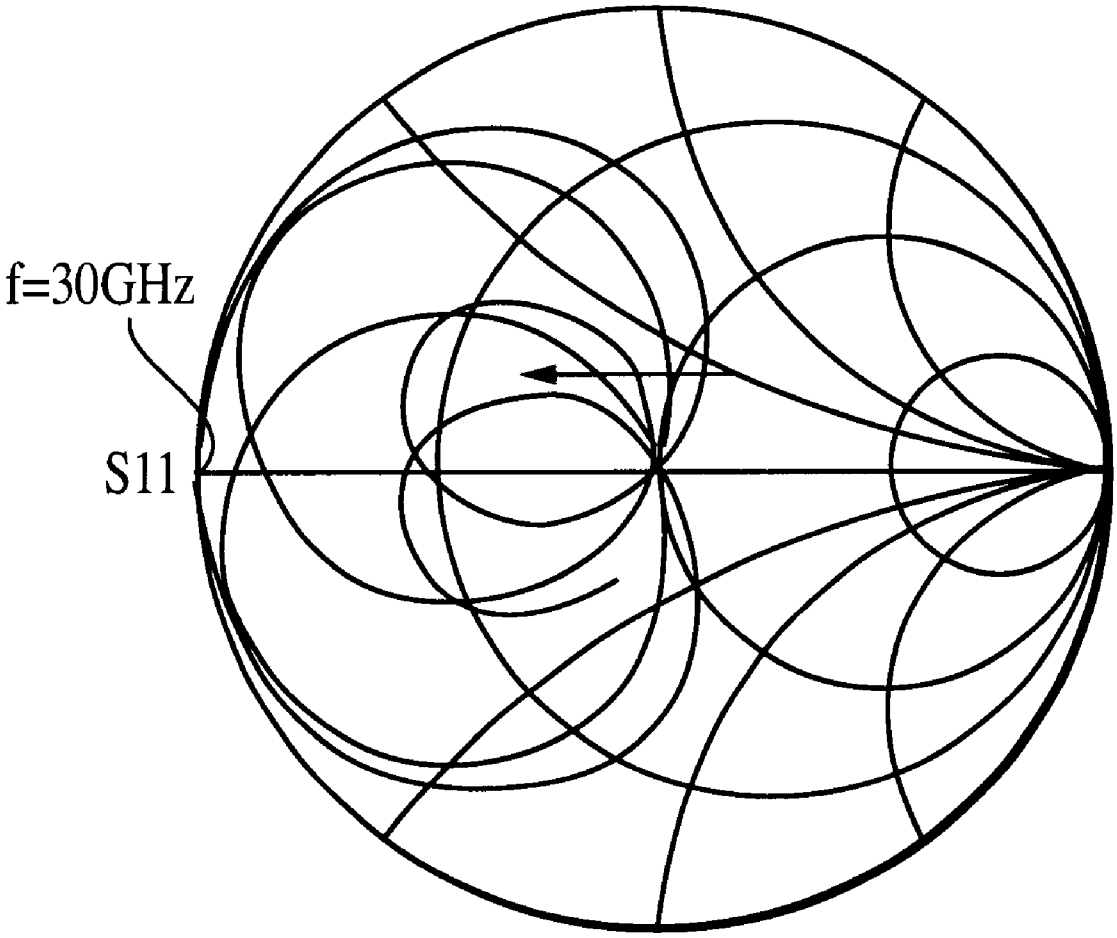
Figure 51A:
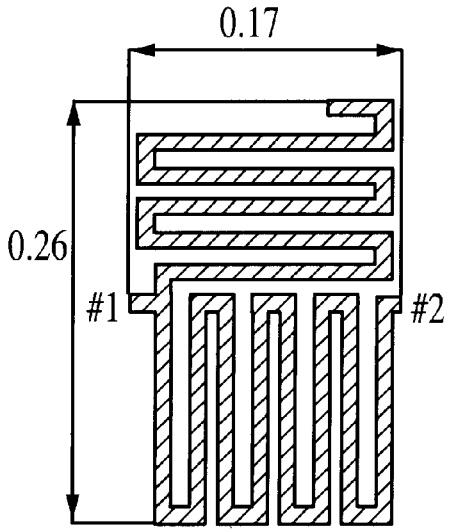
Figure 51B:
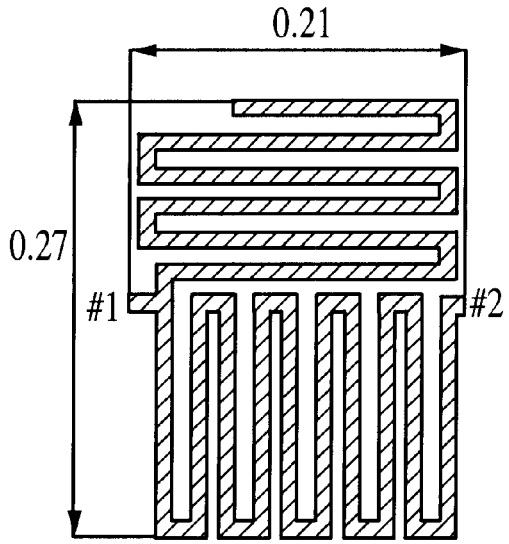
Figure 51C:
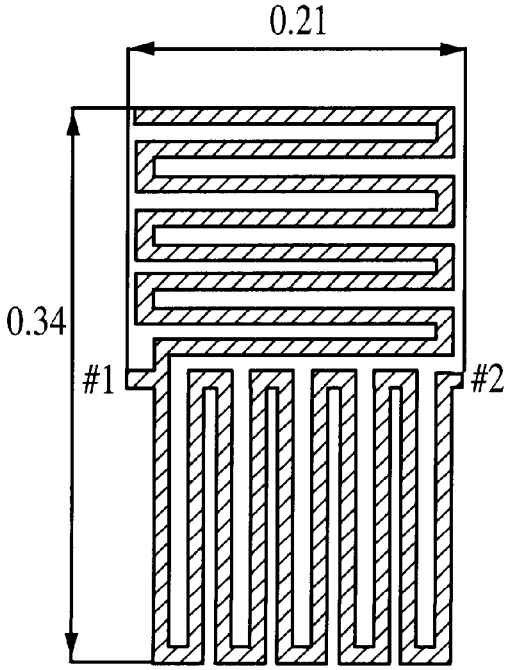
Figure 52A:
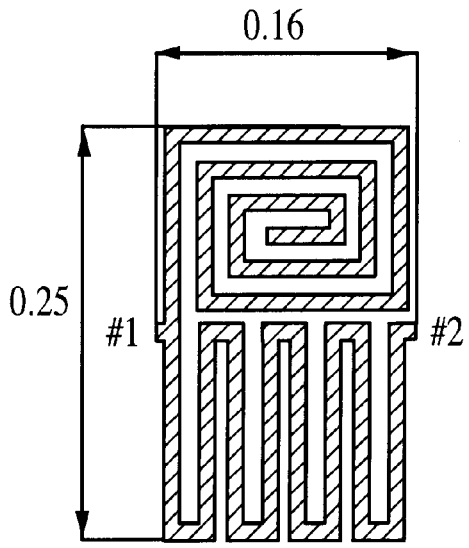
Figure 52B:
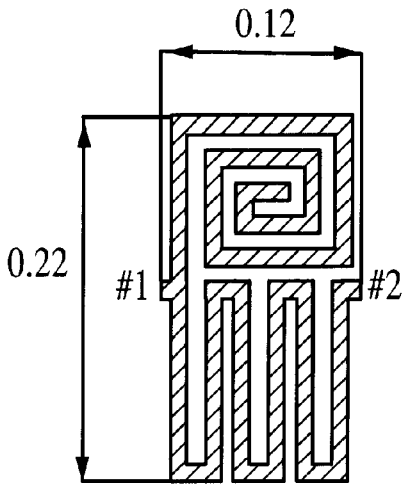
Figure 53A:
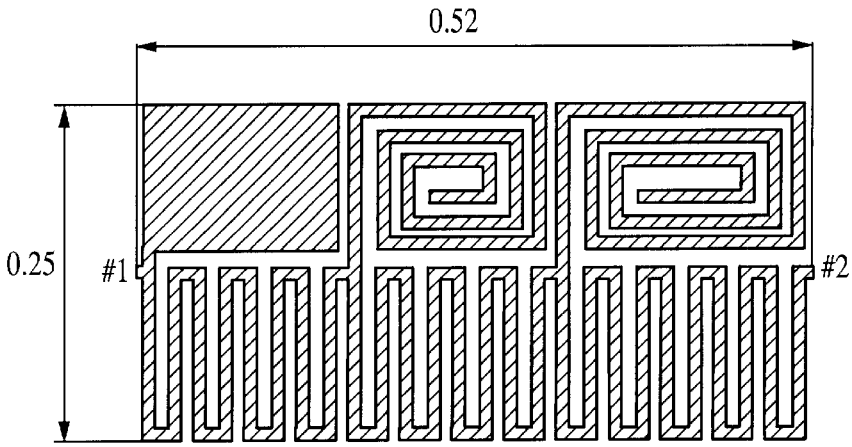
Figure 53B:
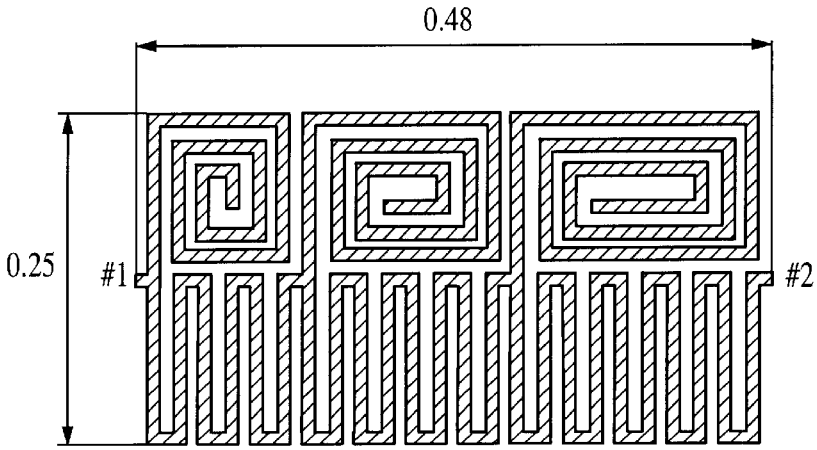
Figure 54:
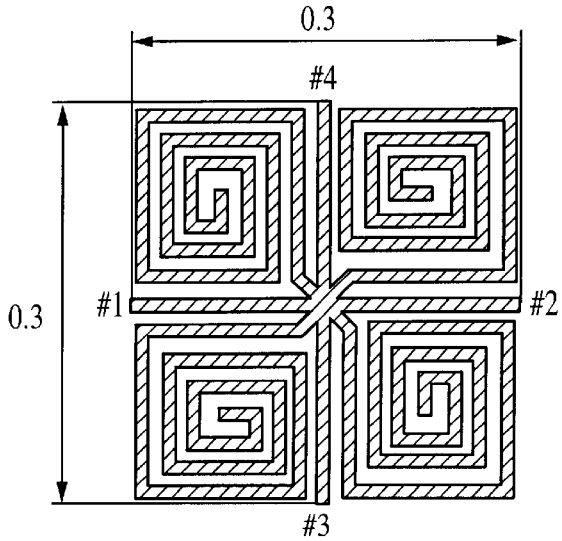
Figure 55:
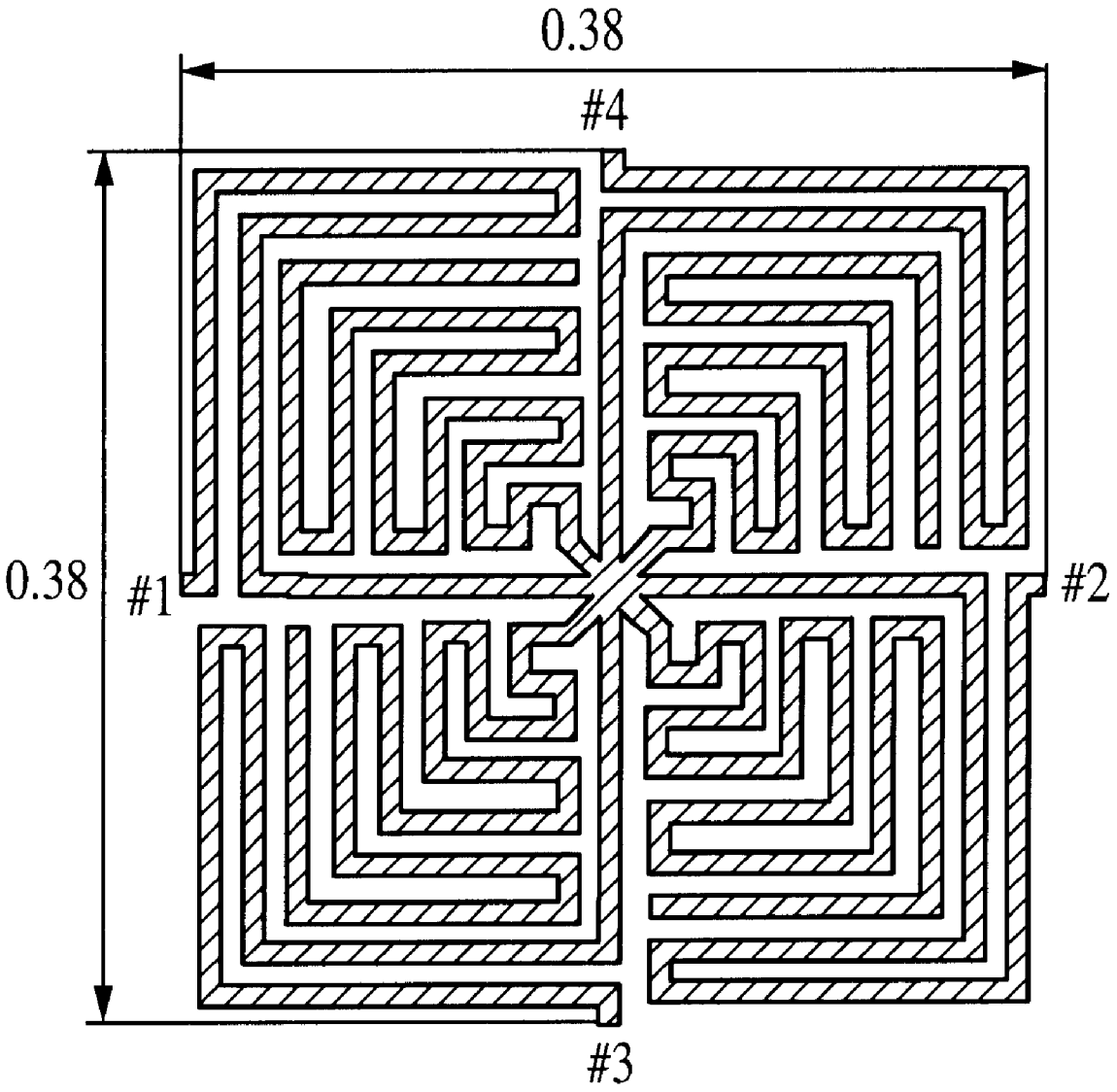
Figure 56A:
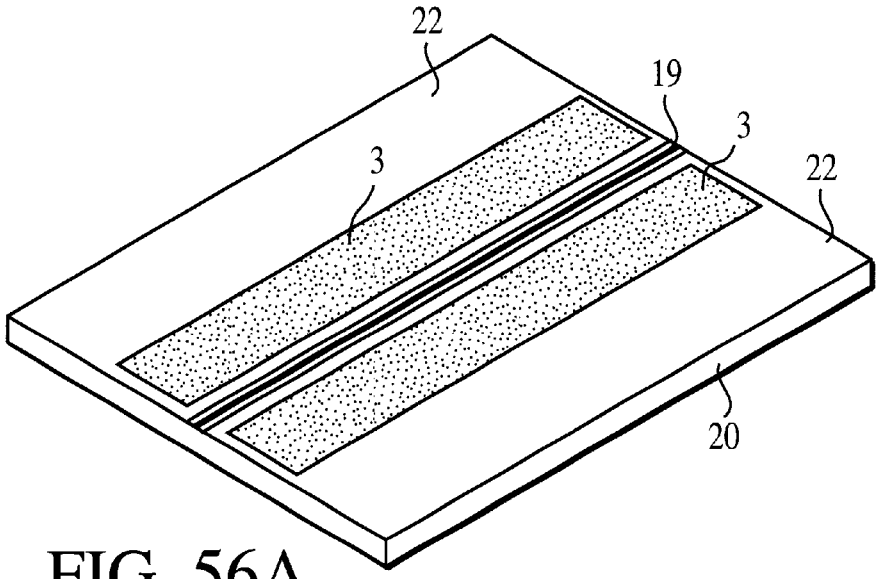
Figure 56B:
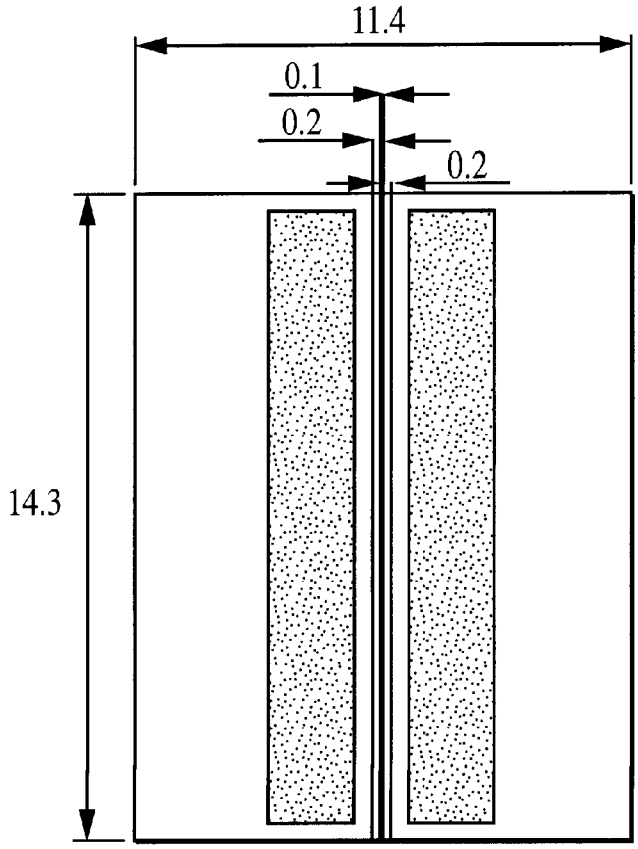
Figure 57A:
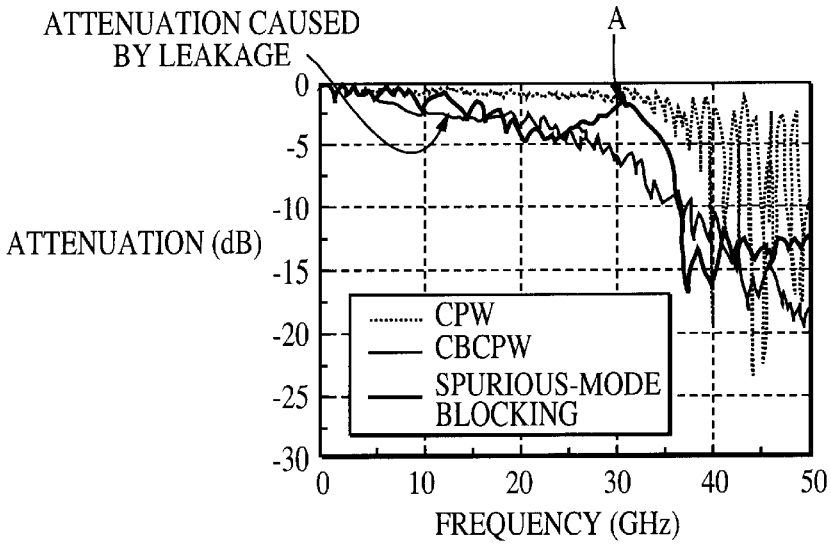
Figure 57B:
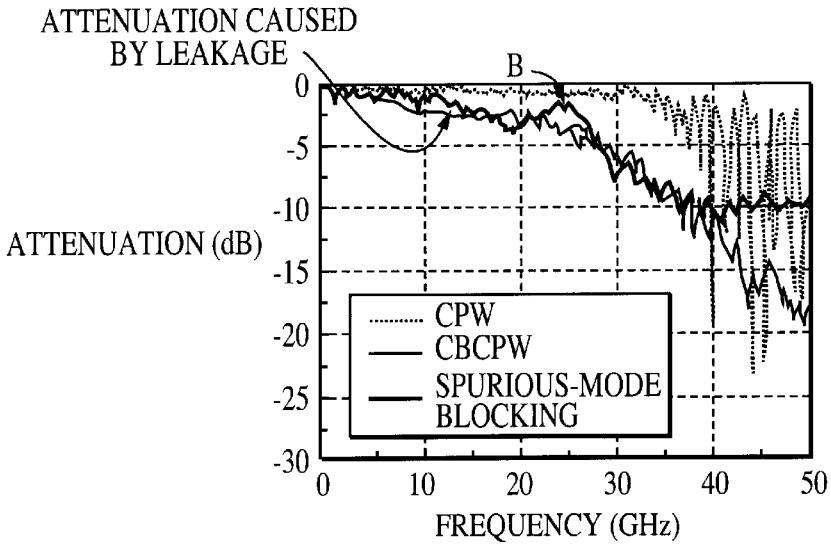
Figure 57C:
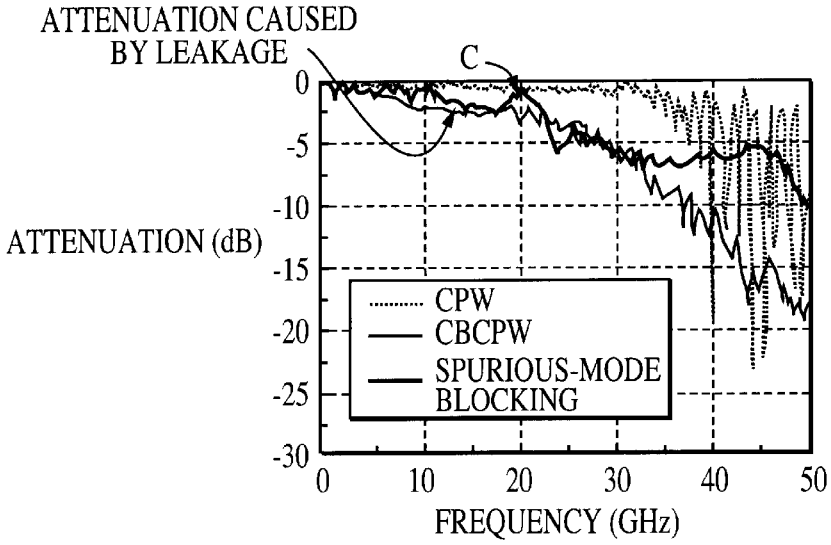
Figure 58A:
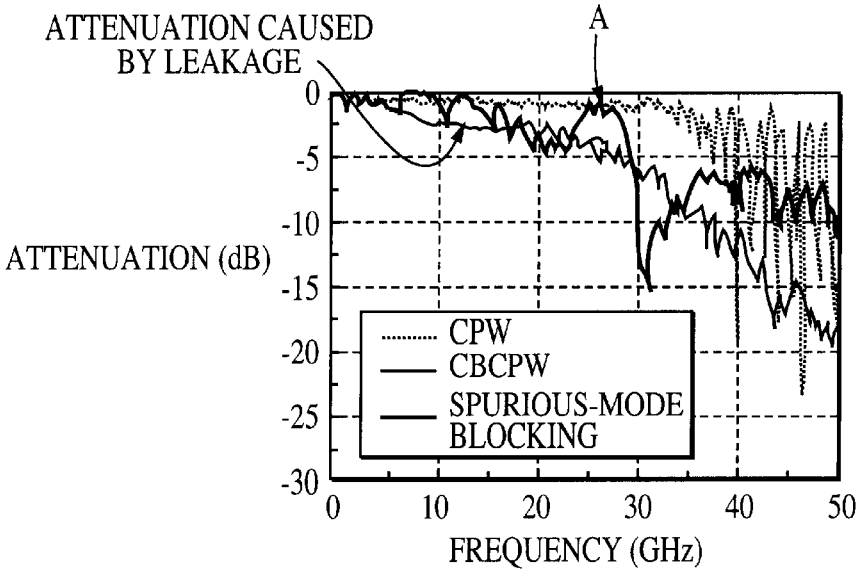
Figure 58B:
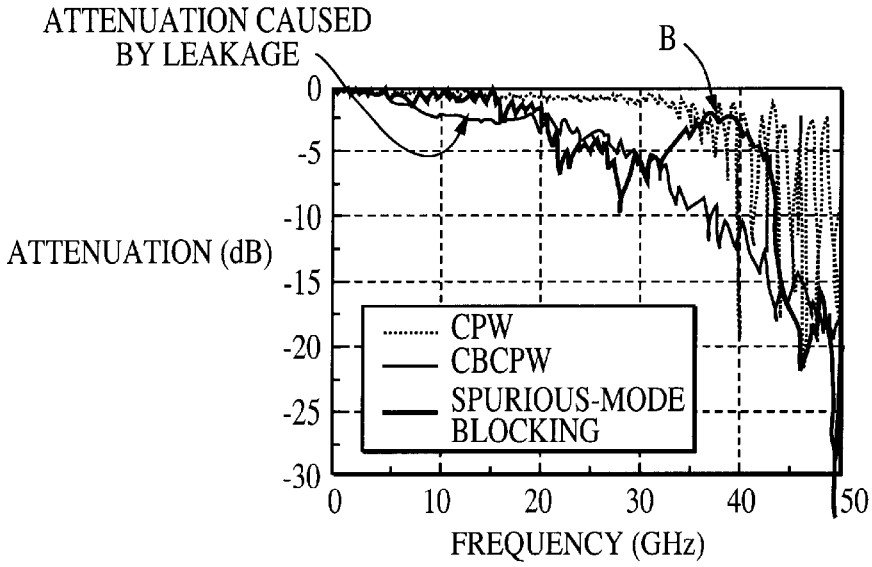
Figure 59A:
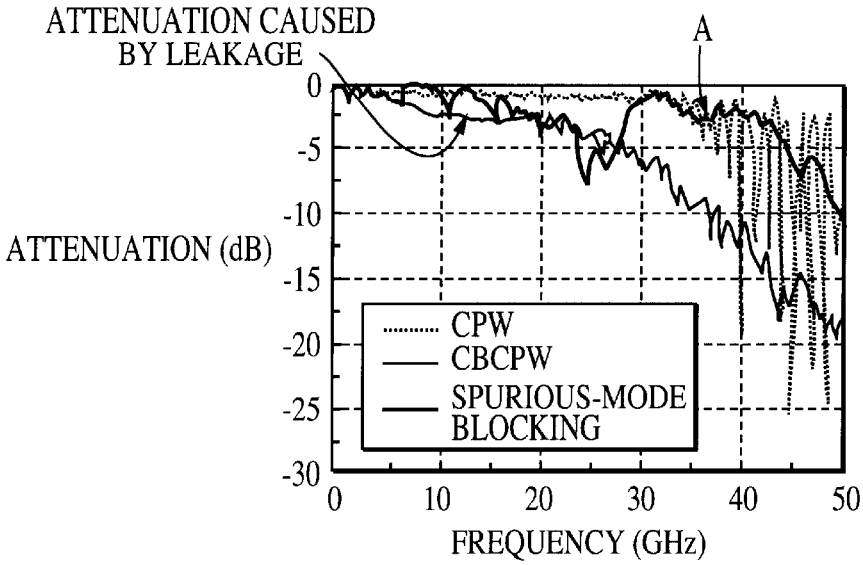
Figure 59B:
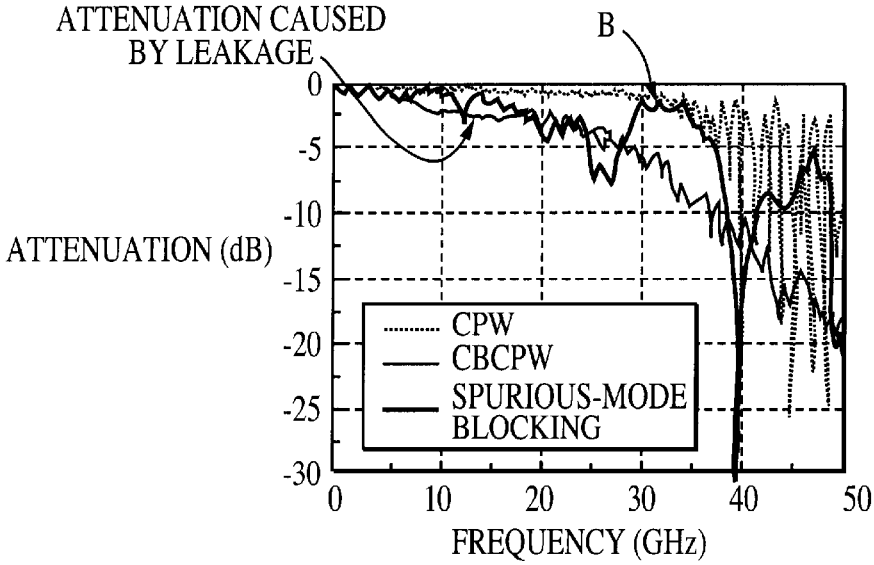
Figure 60:
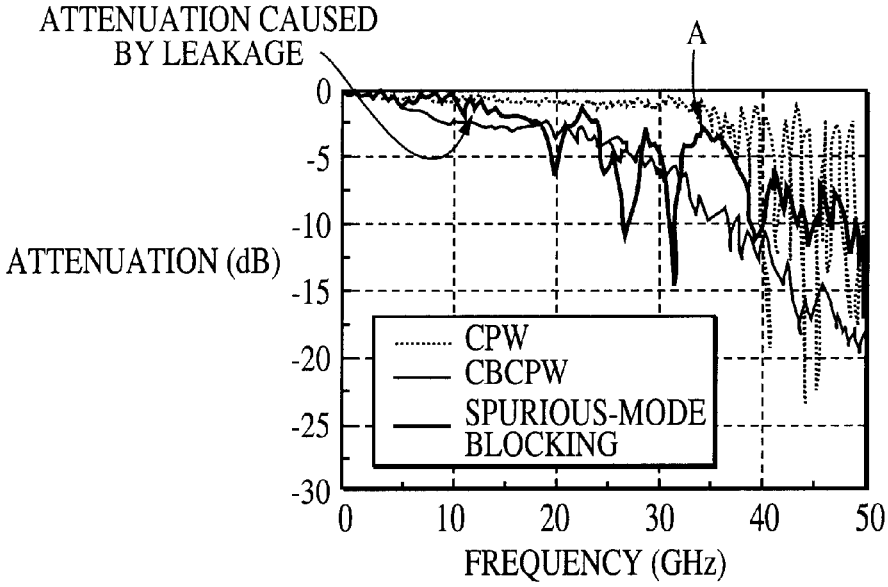
Figure 61:
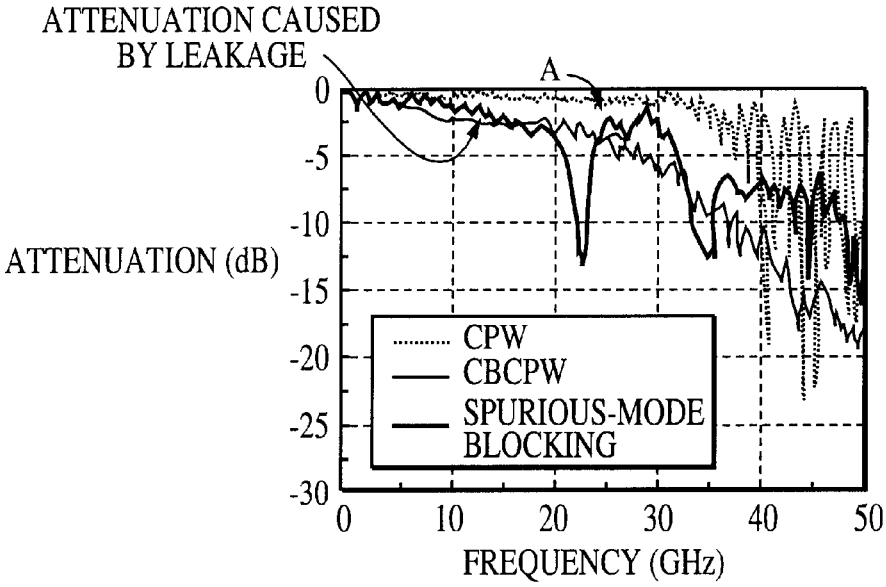
Figure 62:
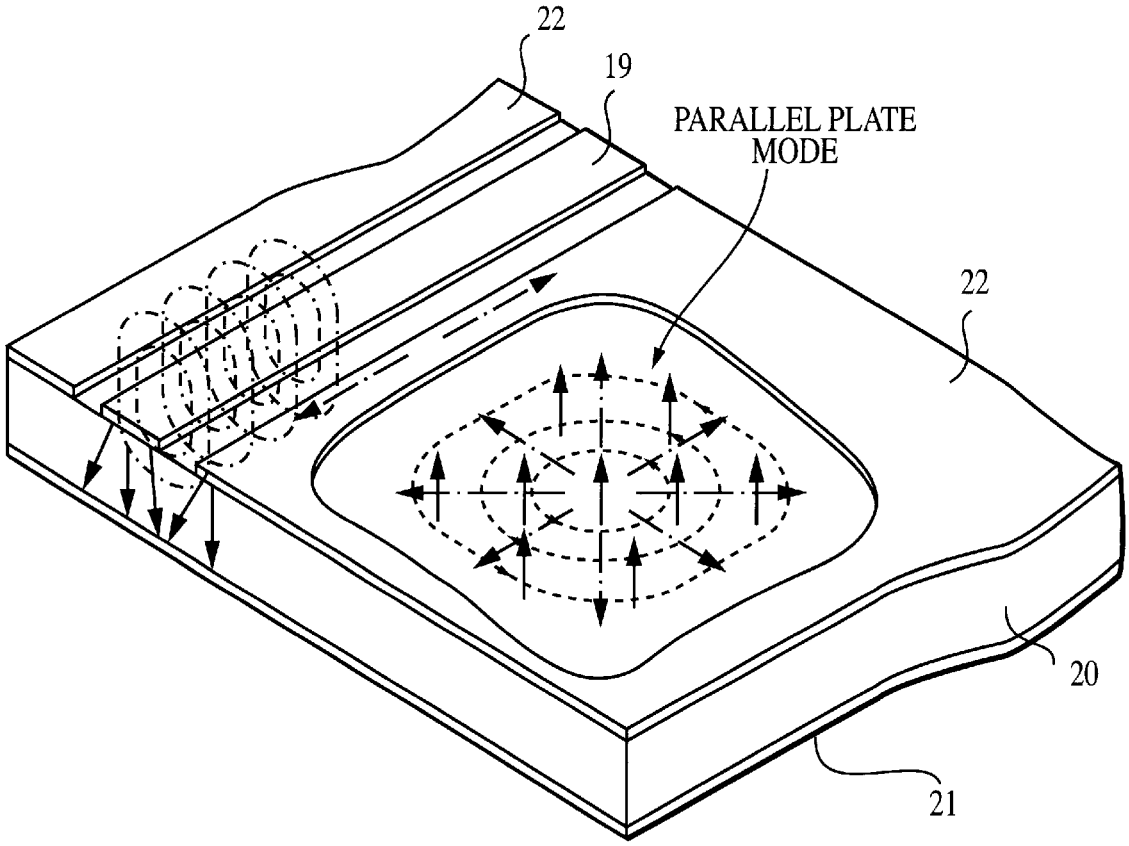
FIG. 62 PRIOR ART

FIG. 28 is an example of the fundamental patterns arranged longitudinally and transversely;

FIGS. 29A and 29B illustrate another fundamental pattern and an equivalent circuit of the pattern;

FIG. 30A illustrates a fundamental pattern of a three-port circuit and FIG. 30B illustrates the arrangement patterns of the fundamental patterns;

FIG. 31 illustrates another fundamental pattern of a four-port circuit;

FIG. 32 is an equivalent circuit diagram of a fundamental pattern of another four-port circuit;

FIG. 33 illustrates an example wherein the present invention is applied to a grounded slot transmission line;

FIG. 34 illustrates an example wherein the present invention is applied to a grounded coplanar transmission line;

FIGS. 35A and 35B illustrate an example wherein that the present invention is applied to a plane dielectric transmission line;

FIGS. 36A and 36B illustrate an example wherein the present invention is applied to a dielectric transmission line;

FIG. 37 illustrates an example wherein the present invention is applied to a high frequency circuit device provided with a resonator;

FIG. 38 illustrates an example of the structure of a voltage variable oscillator;

FIGS. 39A and 39B illustrate an example of a high frequency module provided with a spurious mode wave propagation-blocking circuit;

FIG. 40 illustrates an example of the configuration of a communication device;

FIG. 41 illustrates an example of an unsymmetrical four-port circuit pattern;

FIGS. 42A and 42B illustrate the frequency characteristic of the parameters produced between two arbitrary ports in a multi-port circuit;

FIG. 43A is an equivalent circuit diagram of a fundamental two-port circuit;

FIG. 43B is an equivalent circuit diagram of the fundamental two-port circuit and that of a two-port circuit having a ¼ wavelength transmission line added thereto;

FIGS. 44A and 44B illustrate the frequency characteristics of the parameters of the fundamental two-port circuit;

FIG. 45 illustrates the impedance locus of the fundamental two-port circuit;

FIGS. 46A and 46B illustrate the frequency characteristics of the parameters of the two-port circuit having a ¼ wavelength transmission line added thereto;

FIG. 47 illustrates an impedance locus of the two-port circuit having the ¼ wavelength transmission line added thereto;

FIG. 48 illustrates an equivalent circuit diagram of the two-port circuit having two ¼ wavelength transmission lines therein;

FIGS. 49A and 49B illustrate the frequency characteristics of the parameters of the above circuit;

FIG. 50 illustrates the impedance locus of the above circuit;

FIGS. 51A, 51B, and 51C illustrate examples of fundamental patterns for constituting two-port circuits;

FIGS. 52A and 52B illustrate other fundamental patterns for constituting two-port circuits;

FIGS. 53A and 53B illustrate examples of other fundamental patterns for constituting two-port circuits;

FIG. 54 illustrates an example of fundamental patterns for constituting a four-port circuit;

FIG. 55 illustrates an example of other fundamental patterns for constituting a four-port circuit;

FIG. 56A is a perspective view showing the configuration of a circuit to be measured;

FIG. 56B is a plan view of the circuit;

FIGS. 57A, 57B, and 57C illustrate characteristics of spurious mode wave propagation-blocking circuits formed of the fundamental patterns shown in FIGS. 51A, 51B, and 51C;

FIGS. 58A and 58B illustrate the characteristics of spurious mode wave propagation-blocking circuits formed of the fundamental patterns shown in FIGS. 52A and 52B;

FIGS. 59A and 59B illustrate the characteristics of the spurious mode wave propagation-blocking circuits formed of the fundamental patterns shown in FIGS. 53A and 53B;

FIG. 60 illustrates the characteristics of spurious mode wave propagation-blocking circuits formed of the fundamental patterns shown in FIGS. 54A and 54B;

FIG. 61 illustrates the characteristics of the fundamental patterns shown in FIG. 55; and FIG. 62 is a partially broken-away perspective view showing a spurious parallel plate mode wave.

DESCRIPTION OF EMBODIMENTS OF THE INVENTION

Principle

The total reflection condition of a four-port circuit as an example of a circuit pattern for use in a spurious suppression mechanism is determined based on a characteristic value theory by using the periodicity of the circuit pattern and moreover, the condition that an input wave is totally reflected.

Figure 5:
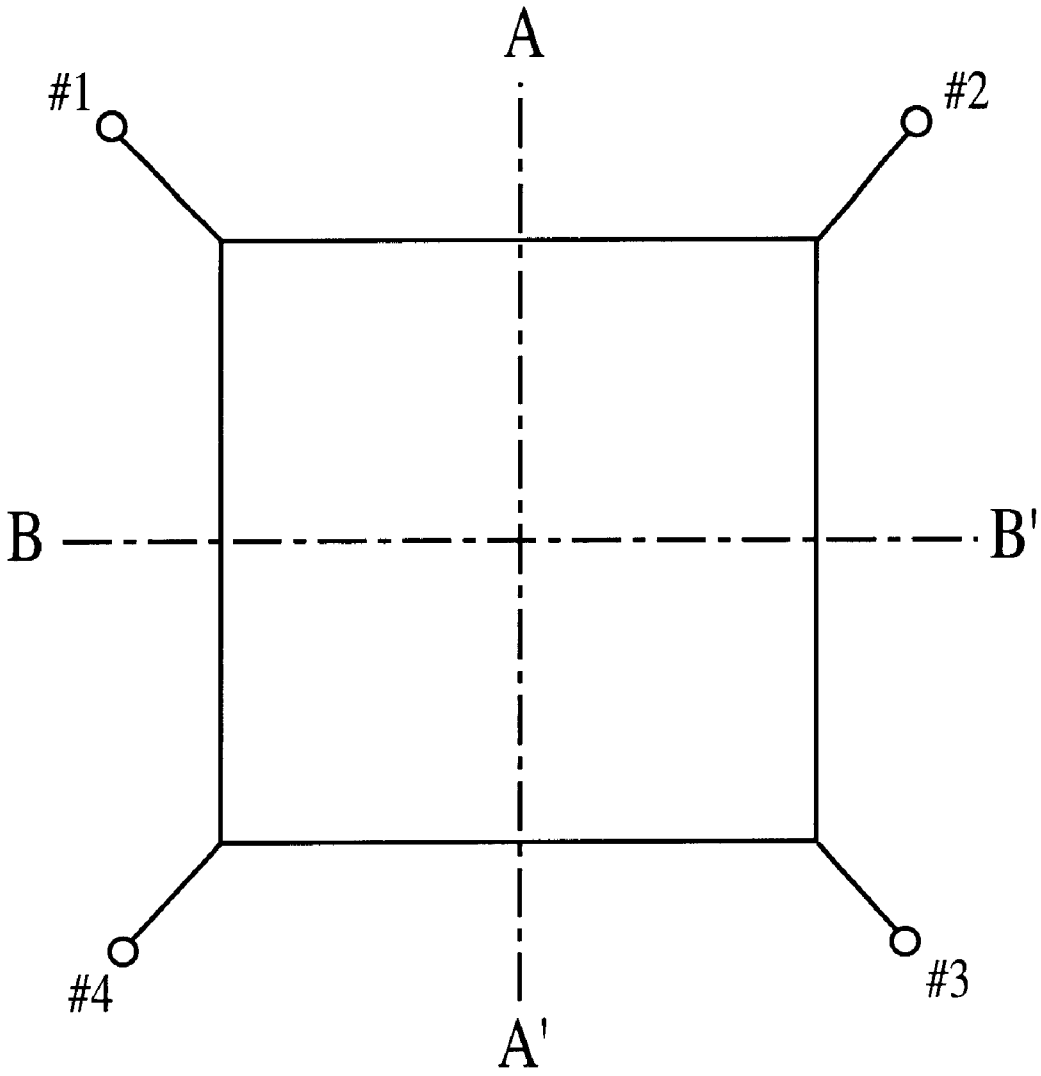
FIG. 5 illustrates a fundamental form of a four-port circuit symmetric about two axes.
Figure 6A:
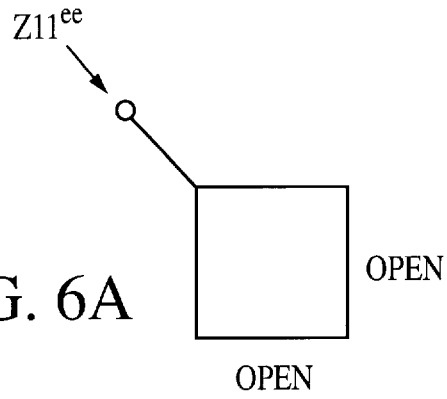
Figure 6B:
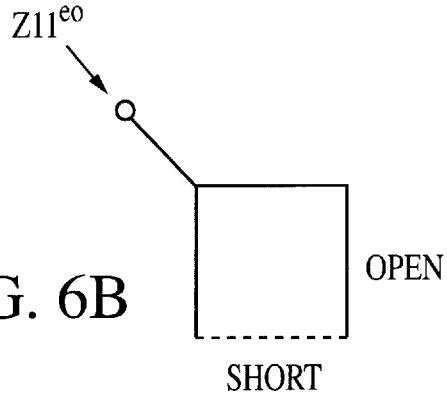
Figure 6C:
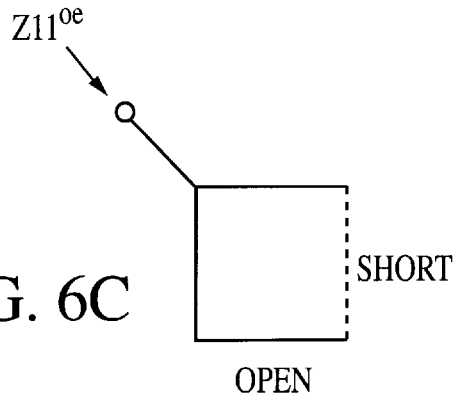
Figure 6D:
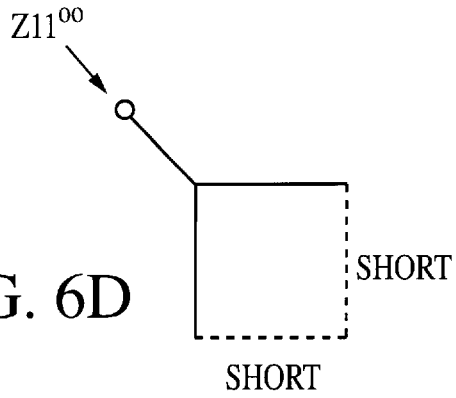

First, an arbitrary four-port circuit is simply expressed as in FIG. 5. Assuming that there is no loss in the circuit, the unitary condition is valid. The respective parameters of $S_{11}$, $S_{12}$, $S_{13}$, $S_{14}$, $S_{21}$, $S_{22}$, $S_{23}$ . . . $S_{42}$, $S_{43}$, $S_{44}$ can be reduced to the four parameters, that is, $S_{11}$ to $S_{41}$. The scattering matrix can be expressed as follows.

$$[S] = \begin{bmatrix} S_{11} & S_{21} & S_{31} & S_{41} \\ S_{21} & S_{11} & S_{41} & S_{31} \\ S_{31} & S_{41} & S_{11} & S_{21} \\ S_{41} & S_{31} & S_{21} & S_{11} \end{bmatrix} \quad \text{(Numerical Formula 1)}$$

The symmetric condition of the circuit is applied to this scattering matrix. In the case in which the circuit is symmetric about two axes A-A' and B-B', as shown in FIG. 5, the whole of the four-port circuit can be analyzed by analysis of the one-port circuits in which even excitation or odd excitation occurs on the two symmetric planes, respectively. In particular, in the modes in which even excitation (hereinafter, referred to as even, briefly) or odd excitation (hereinafter, referred to as odd, briefly) occurs on the two symmetric planes, the reflection coefficients at the respective terminals are equal to each other, and thus, these modes become characteristic excitation modes.

Based the above modes, the following four conditions can be supposed to exist.

(1) A-A' plane even mode, B-B' plane even mode (2) A-A' plane even mode, B-B' plane odd mode (3) A-A' plane odd mode, B-B' plane even mode (4) A-A' plane odd mode, B-B' plane odd mode As seen in FIGS. 6A to 6D, the one-port circuits formed by cutting the four-port circuit along the symmetric axes shown in FIG. 5 correspond to the above-described four conditions (1) to (4), respectively.

The characteristic excitation modes caused via the respective ports to realize the above four modes are shown as follows.

TABLE 1

| mode | port #1 | port #2 | port #3 | port #4 |
|---|---|---|---|---|
| (1) | +1 (V) | +1 (V) | +1 (V) | +1 (V) |
| (2) | +1 (V) | +1 (V) | −1 (V) | −1 (V) |
| (3) | +1 (V) | −1 (V) | −1 (V) | +1 (V) |
| (4) | +1 (V) | −1 (V) | +1 (V) | −1 (V) |

In Table 1, (V) means voltage, and +1 (V) and −1 (V) mean that the voltages have opposite polarities. The contents of Table 1 show the characteristic vectors corresponding to the above conditions (1) to (4), respectively.

By use of the above-mentioned characteristic vectors, the corresponding characteristic values can be defined. If the characteristic reflection coefficients corresponding to the conditions (1) to (4) are represented by $S_{11}^{ee}$, $S_{11}^{eo}$, $S_{11}^{oe}$, and $S_{11}^{oo}$, the S parameters of the whole of the circuit, that is, $S_{11}$, $S_{21}$, $S_{31}$, and $S_{41}$, are expressed by the following formulae.

$$S_{11}=(S_{11}^{ee}+S_{11}^{eo}+S_{11}^{oe}+S_{11}^{oo})/4$$
$$S_{21}=(S_{11}^{ee}+S_{11}^{eo}-S_{11}^{oe}-S_{11}^{oo})/4$$
$$S_{31}=(S_{11}^{ee}-S_{11}^{eo}-S_{11}^{oe}+S_{11}^{oo})/4$$
$$S_{41}=(S_{11}^{ee}-S_{11}^{eo}+S_{11}^{oe}-S_{11}^{oo})/4$$

When the total reflection condition becomes valid, namely, when the condition that $S_{ij}=0$ at $i\neq j$, and $S_{ij}=1$ at $i=j$ is valid, then $S_{11}^{ee}=S_{11}^{eo}=S_{11}^{oe}=S_{11}^{oo}$ is derived from the above formulae.

The relation between the above-described characteristic reflection coefficients and the characteristic impedances $Z_{11}^{ee}$, $Z_{11}^{eo}$, $Z_{11}^{oe}$, and $Z_{11}^{oo}$ can be expressed as follows:

$$S_{11}^{ij}=(Z_{11}^{ij}-Zo)/(Z_{11}^{ij}+Zo)$$

in which $Z_{11}^{ee}$, $Z_{11}^{eo}$, $Z_{11}^{ee}$, and $Z_{11}^{oo}$ are characteristic impedances standardized by input-output impedances, respectively, and Zo represents the input-output impedance when the ports are defined. Accordingly, regarding the circuit satisfying the above-mentioned relation formula, the following two conditions are obtained. That is, from $Z_{11}^{eo}=Z_{11}^{oe}$, Condition 1 can be obtained, namely that the one-port circuit formed by cutting, based on symmetry, is symmetric about the center line containing the port.

From $Z_{11}^{oo}=Z_{11}^{ee}$, Condition 2 can be obtained, namely that the ⅛ circuits formed by cutting along the symmetric planes have the same impedance, irrespective of whether the symmetric planes are open or short-circuited.

FIGS. 7A to 7D illustrate the above two conditions. The ¼ circuit part of FIG. 7B is obtained by cutting the pattern of FIG. 7A in quarters. The circuit part of FIG. 7B is symmetric about the center line C-C'. Moreover, for the ⅛ circuit cut along the center line and shown in FIG. 7C, the impedance $Z_{open}$, seen from the port when the symmetric plane is open, is equal to the impedance $Z_{open}$, of the ⅛ circuit shown in FIG. 7D, seen from the port when the symmetric plane is short-circuited. The $Z_{open}=Z_{short}$ is equivalent to the total reflection condition when the area between two ports is considered as a band-stop filter.

As described above, the total reflection condition of the four-port circuit of which the symmetry of the circuit is assumed is valid in the case of three or more-port circuits. Hereinafter, the basis of the validity will be described.

First, FIG. 8A shows a symmetric two-port circuit to demonstrate that the above-described condition 2 is coincident with the total reflection condition of a two-port circuit. Moreover, FIGS. 8B and 8C show two equivalent circuits of the one-port circuit formed by cutting along the symmetric plane shown in FIG. 8A, obtained when the respective symmetric planes are open or short-circuited.

If the reflection coefficients in the even and odd modes of these two one-port circuits are represented by $S_{11}^{e}$ and $S_{11}^{o}$, $S_{11}$ and $S_{21}$ of the equivalent circuit shown in FIG. 8A are expressed as follows.

$$S_{11}=(S_{11}^{e}+S_{11}^{o})/2$$
$$S_{21}=(S_{11}^{e}-S_{11}^{o})/2$$

Accordingly, for the total reflection condition, $S_{21}$ is equal to 0. Thus, $S_{11}^{e}=S_{11}^{o}$, that is, $Z_{open}=Z_{short}$ is obtained. Accordingly, in other words, the total reflection condition of a two-port circuit is that the one-port circuits formed by cutting along the symmetric plane have an equal impedance, irrespective of whether the symmetric planes are open or short-circuited.

If the total reflection condition can be satisfied between arbitrary two-port circuits in a multi-port circuit, the total reflection condition of the whole of the multi-port circuit can be satisfied, as seen in the above description.

The above description has been based on symmetric circuits. For an asymmetrical multi-port circuit (in this case, a four-port circuit), circuit-simulation is conducted in practice. As regards the asymmetrical circuit, it will be demonstrated that the total reflection condition of the whole of the circuit can be satisfied by setting arbitrary two-port circuits to satisfy the total reflection condition.

FIG. 41 shows the equivalent circuit in which the simulation was made. In the circuit, a transmission line a has θ=75°, z=200 Ω, and a transmission line b has θ=10° and z=0 Ω. Moreover, for transmission lines c1, c2, c3, and c4, θ is π/2, and z=10 Ω, 50 Ω, 100 Ω and 200 Ω, respectively.

FIG. 42A and 42B shows examples of the characteristics of $S_{11}$, $S_{21}$, $S_{31}$, and $S_{41}$in the above-described circuit. A large reflection coefficient can be obtained over a wide band even in the asymmetrical circuit, as seen in the characteristic of $S_{11}$ shown in FIG. 42A and 42B.

The results show that the total reflection condition of the multi-port circuit can be satisfied by satisfying the total reflection condition between any two arbitrary ports, irrespective of the symmetry of the multi-port circuit.

For example, as a multi-port circuit in which the one-port circuits satisfy the above-described conditions 1 and 2, fundamental patterns shown in FIGS. 9A to 9B can be formed. The example of FIG. 9A is a three-port circuit, that of FIG. 9B is a five-port circuit, and that of FIG. 9C is a six-port circuit.

Figure 11A:
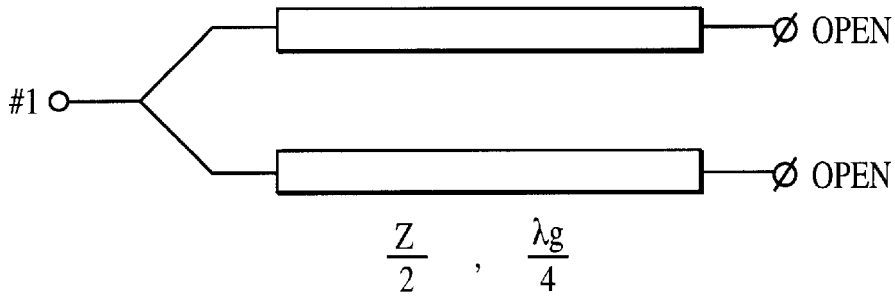
Figure 11B:
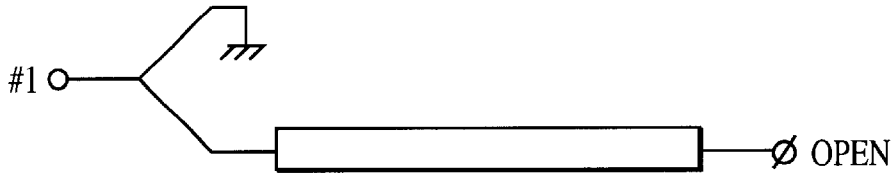
Figure 11C:
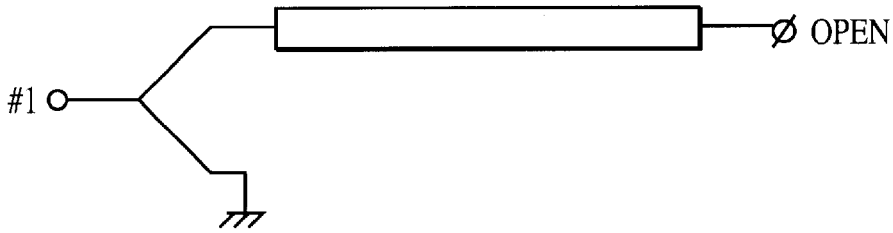
Figure 11D:
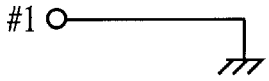
Figure 12A:
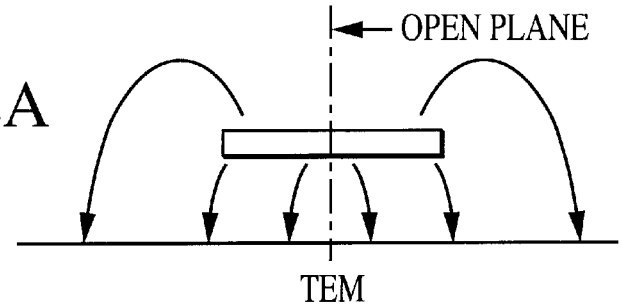
Figure 12B:
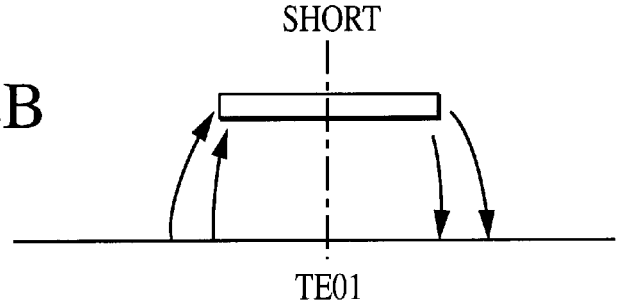
Figure 12C:
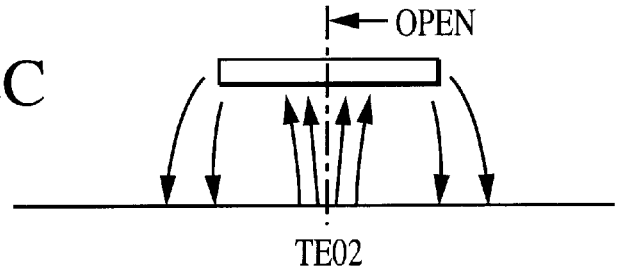
Figure 12D:
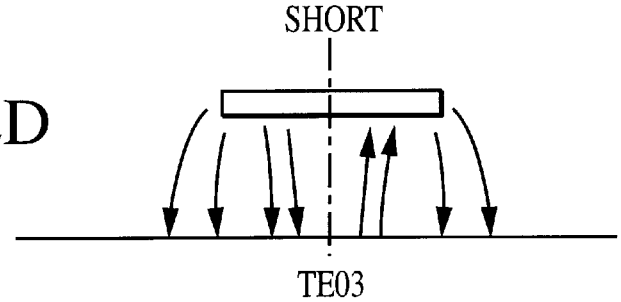
Figure 12E:
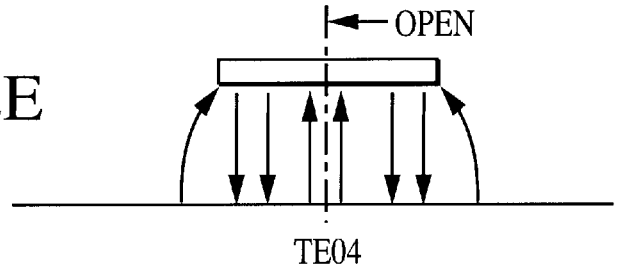

Next, FIG. 10B shows an example of one-port circuit satisfying the conditions 1 and 2. That is, FIG. 10B shows the one-port circuit formed by cutting the circuit of FIG. 10A along the two symmetric planes A-A' and B-B'. The one-port circuit has the configuration in which two ¼ wavelength stubs having an open terminal are connected to the transmission line connected to a port #1, respectively. The impedances of the two stubs are changed, depending on the state, in which the two symmetric planes are open or short-circuited. Thus, FIGS. 11A to 11B show equivalent circuits corresponding to the state of the two symmetric planes. FIG. 11A, 11B, 11C, and 11D show the states wherein the plane A-A' is open, and the plane B-B' is open; wherein the plane A-A' is open, and the plane B-B' is short-circuited; wherein the plane A-A' is short-circuited, and the plane B-B' is open, and that the plane A-A' is short-circuited, and the plane B-B' is short-circuited, respectively. Here, the circuits are equivalent to the circuits in which no stub exists when a symmetric plane is short-circuited, respectively. The reason lies in that the mode present in the stub is assumed to be is only a TEM mode, and furthermore, it is presumed that the waves in the TE01 and TE03 modes in which the symmetric planes are open are evanescent waves, and effects of the waves are estimated to be extremely small. Moreover, regarding the mode of a wave propagating in a strip conductor, such modes as shown in FIGS. 12A–12E are exemplified. These modes correspond to elimination of the presence condition of the TEM wave, TE02, and TE04 modes wherein the symmetric plane is assumed to be a short-circuit plane. Thus, it can be assumed that the mode present in the stub is only the TEM wave mode.

As seen in the above-described results, all of the input impedances of FIGS. 11A to 11D become zero, and satisfy the total reflection condition. Accordingly, all of the incident waves from the respective ports shown in FIG. 10 are totally reflected.

FIG. 13 shows a modification example of the fundamental pattern shown in FIG. 10A. In this example, the respective stubs shown in FIG. 10A have a meandering shape so that the whole of the fundamental pattern is formed within a square area.

FIGS. 14A and 14B show the S parameters of the circuit of FIG. 13. In this example, the optimum frequency is set at 32 GHz. That is, at 32 GHz, the electrical length of the stub becomes ¼ wavelength. For this reason, the total reflection characteristic is presented over a predetermined band having this frequency at the center.

FIGS. 15A and 15B show the case in which the application frequency is set at 20 GHz in the pattern of FIG. 13. In this case, the electrical length of the stub becomes ¼ wavelength at 20 GHz. For this reason, the total reflection characteristic is presented in a band having this frequency as the center.

FIG. 16 shows a pattern as a comparative example, shown in Japanese Patent Application No. 11-025874. FIGS. 17A and 17B show the frequency characteristics of the S parameters. When the designed frequency band is set to be 32 GHz, as in the cases of FIGS. 13, 14A, and 14B, one side of the square fundamental pattern has a length of 0.8 mm in the example of FIG. 16, while one side of the square pattern has a length of 0.25 mm in the example of FIG. 13. The example of FIG. 13 is very small in size, and the reflection characteristic is excellent. It can be seen that the propagation blocking ability for a spurious mode wave is very high.

Next, FIG. 18 shows an example of another fundamental pattern. This fundamental pattern is formed by connecting ¼ wavelength transmission lines in series with the input-output ports of the pattern of FIG. 13. FIG. 19 shows the frequency characteristics of the S parameters. Like this, by adding the transmission lines each having predetermined impedance and electrical length, the bandwidth can be increased.

Next, the principle of increasing a bandwidth will be described. In the above-description, it has been explained that the operation of a multi-port circuit can be understood as that of a two-port circuit. Thus, the principle will be described by way of a two-port circuit.

First, FIG. 43A shows a fundamental two-port circuit. The circuit has the reflection characteristic shown in FIGS. 44A and 44B. When a ¼ wavelength high impedance transmission line is added to the circuit of FIG. 43A to form a circuit as shown in FIG. 43B, the the characteristic can be presented with a wide band width as shown in FIGS. 46A snd 46B. The physical meaning of the characteristic presented with a wide band width will be described by use of Smith charts.

As regards the locus of the impedance, as viewed from the broken line a-a', obtained when the frequency is changed from 1.00 GHz to 60.00 GHz in the circuit shown in FIG. 43A, loops are drawn in the Smith chart as shown in FIG. 45.

As regards the locus of the impedance, as viewed from the broken line a-a', obtained when a ¼ wavelength high impedance transmission line is connected to the circuit shown in FIG. 43A to form the circuit shown in FIG. 43B, and the frequency is changed from 1.0 GHz to 60.0 GHz, the reflection coefficient at 30 GHz, positioned at point A in FIG. 45 is shifted to point B, as shown in FIG. 47. Moreover, the high impedance transmission line enhances the standardized apparent impedance, viewed from line b-b', so that the whole of the characteristic is shifted to the right-hand side (in the direction indicated by the arrow in FIG. 47). The change of the imaginary part in the Smith chart is small on the open side and is large on the short side. By shifting the whole of the impedance locus toward the open side, the change of the frequency is increased, so that the wide band width can be realized.

FIG. 48 shows an example in which, in addition, 90° phase shifters are added to the input and output of the circuit shown in FIG. 43B, so that the input-output impedance becomes a low impedance. The band-width of the reflection characteristic of this circuit is increased as shown in FIG. 49A ans 49B. The locus of the impedance, as viewed from the broken line a-a', obtained when the frequency is changed from 1.0 GHz to 60.00 GHz, makes a round figure in the Smith chart, as shown in FIG. 50. Moreover, the whole of the characteristic is shifted toward the left side, due to the low impedance transmission line. Thereby, the resonance loop (impedance locus) originally drawn in the left direction is wholly pushed in the outer peripheral direction of the circle. Thus, it is presumed that the wide band width can be realized.

As described above, a bandwidth can be increased by adding a transmission line having an appropriate impedance and an adequate electrical length to an input and to an output.

FIGS. 10A, 13, 18, and so forth show examples based on a four-port circuit. However, similarly, the present invention can be applied to a three-port circuit as shown in FIG. 20, and moreover, can be applied to a multi-port circuit having at least five ports.

Next, FIGS. 21A and 21B show examples of another fundamental pattern satisfying the above-described total reflection condition. In this structure, a ¼ wavelength stub having an open end is provided for a strip conductor connecting two adjacent ports, as shown in FIG. 21A, which is formed from the state shown in FIG. 10A via the state shown in FIG. 21B. The length of the strip conductors connecting the two ports and the connection positions of the stubs to the strip conductors have no relation to the above-described total reflection condition.

FIG. 22 shows yet another fundamental circuit pattern satisfying the above-described total reflection condition. The pattern is an concrete example in which two strip conductors having a electrical length difference of a half wavelength are connected in parallel to each other between two-port circuits. For example, between the two ports, that is, the ports #1 and #4, strip conductors SL1 and SL2 are provided. The electrical length difference between the conductors is π (½ wavelength). This is true as well of the circuits between the other pairs of two adjacent ports.

Figure 24A:
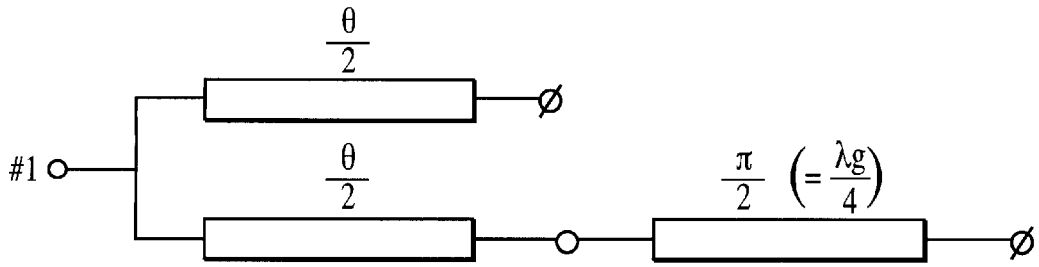
Figure 24B:
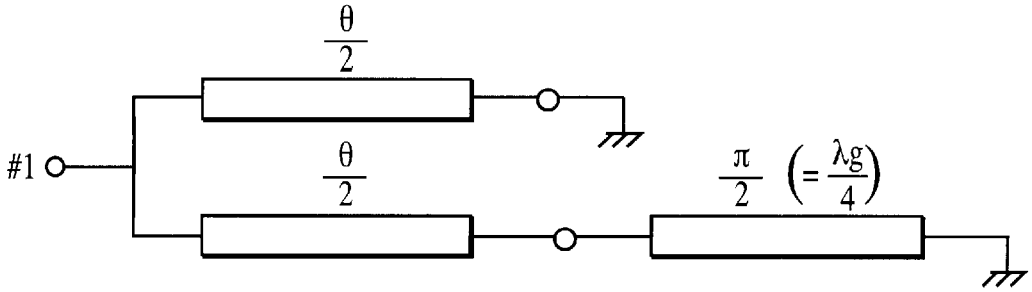
Figure 24C:
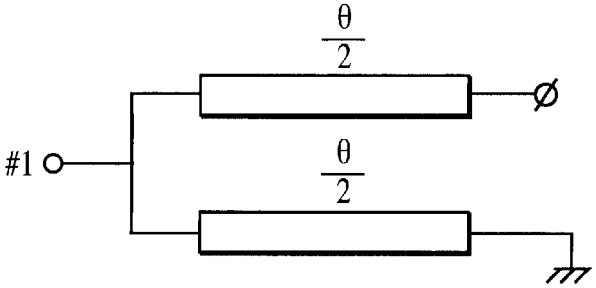
Figure 24D:
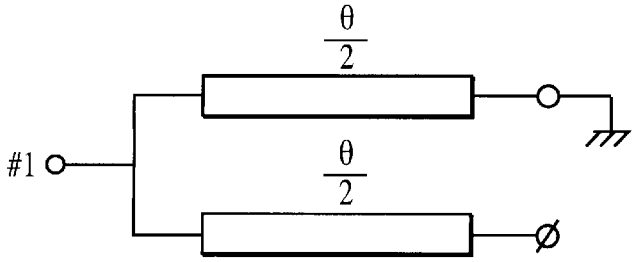

In the description using FIGS. 7A to 7D, according to the total reflection condition, the ⅛ circuits formed by cutting, along the symmetric plane, each of the ¼ circuits which are formed by cutting along the symmetric planes A-A' and B-B' about the two axes have an equal impedance ($Z_{open}=Z_{short}$) under the boundary condition that the symmetric plane B-B' becomes even•odd. When this is applied to the example shown in FIG. 22, the ⅛ circuit is expressed by the equivalent circuit shown in FIG. 23. In the case in which the symmetric plane B-B' is open, the equivalent circuit is shown, e.g., in FIG. 24A. When the symmetric plane B-B' is short-circuited, the equivalent circuit is expressed as shown in FIG. 24B. Moreover, the circuits of FIGS. 24A and 24B can be rewritten to become the circuits of FIGS. 24C and 24D. As easily seen by comparing FIGS. 24C and 24D to each other, the input impedances, obtained when the symmetric planes are open and short-circuited, are equal to each other. Therefore, the circuit satisfies the total reflection condition.

In the pattern shown in FIG. 22, it is not needed to use a stub having an open end. Therefore there is less influence due to coupling to other circuits. The circuit design can more be easily performed.

In the above respective embodiments, the four-port circuits having a symmetry about two axes and the multi-port circuits having increased symmetric axes have been described as examples. An advantageous feature of the present invention lies in that a spurious mode wave propagating between two planar conductors is suppressed. Thus, a spurious mode propagation suppression circuit pattern may not have symmetry. It is true that the circuit patterns of the respective embodiments shown in FIG. 10A to 21 each comprise a two-port band-stop filter connected between adjacent ports. From this viewpoint, other different types of embodiments will be shown, below.

First, for example in the four-port circuit shown in FIG. 25, the respective ports are connected by the transmission lines made of strip conductors having an electrical length, and the stubs having open ends are provided for the transmission lines so as to break the symmetry of the circuit, respectively. In this circuit, the circuits between two adjacent ports, that is, those between the ports #1 and #2, between the ports #2 and #3, between the ports #3 and #4, and between the ports #4 and #1 satisfy the total reflection condition, independently. Accordingly, a characteristic similar to that of the circuit shown in FIG. 10A or 21A can be obtained.

Figure 1:
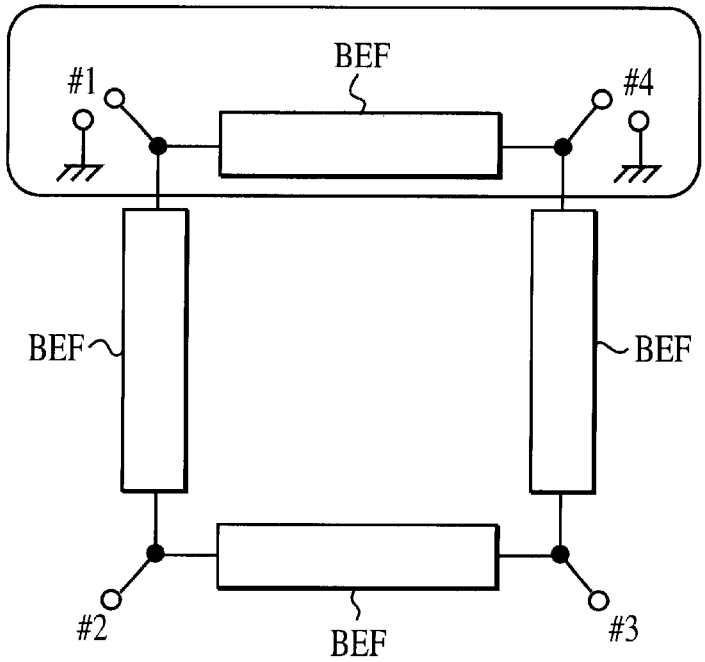
FIG. 1 is an equivalent circuit diagram of a fundamental pattern in a spurious mode wave propagation-blocking circuit.
Figure 2:
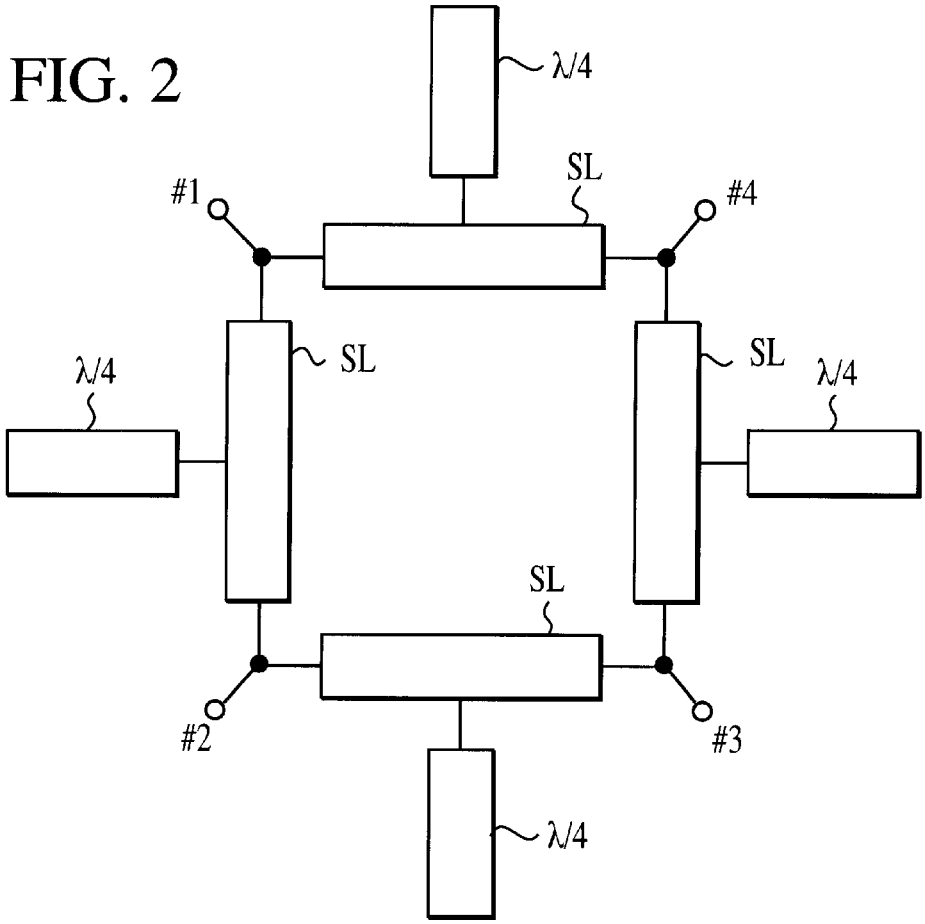
FIG. 2 is an equivalent circuit diagram of another fundamental pattern in a spurious mode wave propagation-blocking circuit.
Figure 3:
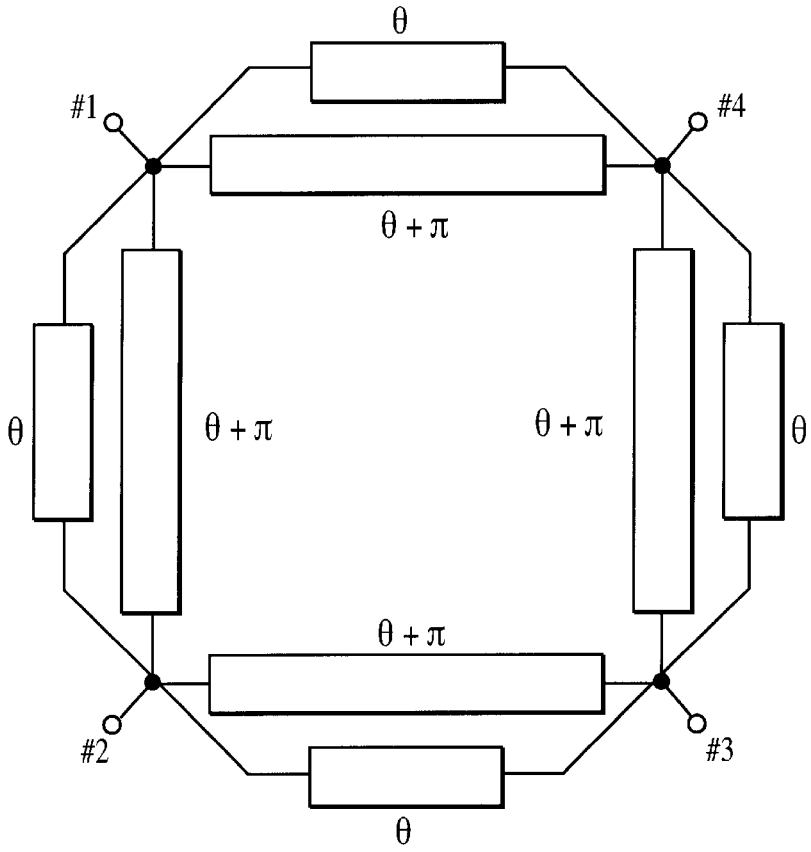
FIG. 3 is an equivalent circuit diagram of still another fundamental pattern in a spurious mode wave propagation-blocking circuit.
Figure 4:
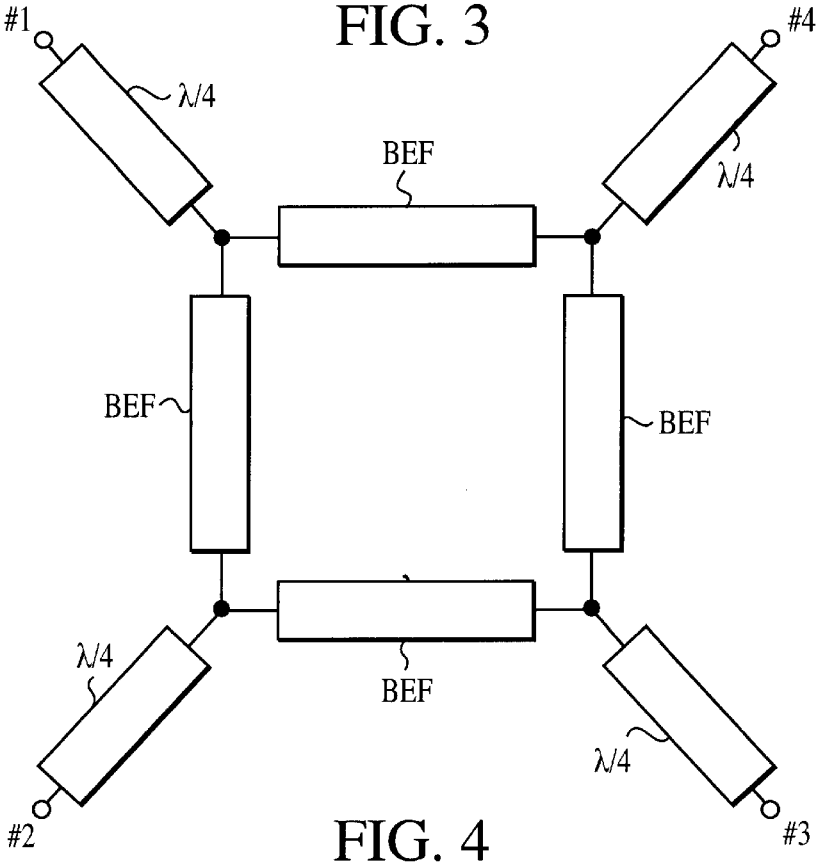
FIG. 4 is an equivalent circuit diagram of yet another fundamental pattern in a spurious mode wave propagation-blocking circuit.

FIG. 26 shows a modification example of the circuit of FIG. 3, in which the four band-stop filters made of strip conductors having an electrical length difference equal to a half wavelength are provided. In this example, by shifting the frequencies of the two band-stop filters from each other by a predetermined amount, the width of the frequency band in which the total reflection condition is substantially satisfied can be increased.

Next, the patterns shown in FIGS. 10A and 10B are expressed in the form of equivalent circuits, and are simplified. FIGS. 27A, 27B, and 27C show examples of the fundamental patterns having the same characteristics as the obtained equivalent circuit patterns.

FIG. 27A shows the equivalent circuit of the pattern shown in FIG. 10A. FIG. 27B shows the equivalent circuit obtained by simplifying the pattern. FIG. 27C shows a concrete circuit example of the equivalent circuit of FIG. 28B. In the circuit pattern shown in FIG. 27C, a stub is provided between the ports #2 and #3. Electrically, the circuit pattern has the structure in which the stub is connected in parallel to the strip conductor connecting the two ports. That is, the circuit pattern has the structure in which the stubs are connected near to the crossing point of the four ports, and therefore, between any two of the ports, that is, between the ports #1 and #2, between the ports #2 and #3, between the ports #3 and #4, between the ports #4 and #1, between the ports #1 and #3, or between the ports #2 and #4, a stub is connected in parallel to the strip conductor connecting the two ports. The above-described stubs are strip transmission lines each having an electrical length of ¼ wavelength and having an open end. Accordingly, the present invention includes the structure in which a band-stop single stub is connected to a strip conductor connecting at least two ports, as described above.

FIG. 28 shows a spurious mode wave propagation blocking circuit pattern comprising a plurality of the fundamental patterns each shown in FIG. 27C and arranged in the longitudinal and transverse directions. In this circuit, one of the fundamental patterns shown in FIG. 27C, the port #1 is connected to the port #3 of a neighboring fundamental pattern, and the port #2 is connected to the port #4 of another neighboring fundamental pattern.

Moreover, FIGS. 29A and 29B show an example of another simplified pattern obtained from the equivalent circuit shown in FIG. 27A as a starting equivalent circuit. In this example, in the equivalent circuit shown in FIG. 29A, two stubs each having an open end with a length of ¼ wavelength are provided for a strip conductor connecting two ports. FIG. 29B is a concrete circuit pattern. In the case in which the patterns are arranged in the longitudinal and transverse directions, the port #1 is connected to the port #3 of a neighboring pattern, and the port #2 is connected to the port #4 of another neighboring pattern.

FIGS. 30A and 30B show a concrete example of a three-port circuit. FIG. 30A shows the fundamental pattern. In this pattern, the respective stubs as shown in FIG. 20 are formed into a meander shape. FIG. 30B shows that the fundamental patterns of FIG. 30A are arranged in a two dimensional plane shape, and the three ports are connected in common to each other, correspondingly.

As shown in FIG. 30B, the profile of the fundamental pattern is triangular. Accordingly, in the case in which a spurious mode wave propagation-blocking circuit is formed in a space sandwiched between two transmission lines or electrode patterns, and the angle between the two transmission lines or electrode patterns is 60° or an angle near to 60°, the fundamental patterns can be arranged at a high packing ratio.

FIG. 31 shows another example of the fundamental pattern formed by modifying the fundamental pattern of FIG. 10A. This fundamental pattern has the structure in which neighboring ports are connected to each other at an arbitrary point, and a respective band-stop filter comprising a ¼ wavelength stub with an open end is inserted between the connection point and each port. In this pattern, the circuit between neighboring ports exhibits the band-stop filter characteristic. Thus, by arranging a plurality of the fundamental patterns, a spurious mode wave blocking circuit can be formed.

FIG. 32 shows yet another fundamental pattern formed by modifying the fundamental pattern shown in FIG. 10A as well. Also in this circuit, neighboring ports are connected to each other at an arbitrary point, and band-stop filters each comprising two strip conductors having an electrical length difference of a half wavelength, connected in parallel to each other, are inserted between the connection point and each respective port. That is, in FIG. 32, the band-pass filter comprises a strip conductor with an electrical length $\theta$ and a strip conductor with an electrical length of $(\theta+\pi/2)$. Thereby, similarly to the circuit of FIG. 31, two band-stop filters are inserted between neighboring ports.

Next, some examples in which plural fundamental patterns each constituting a two-port circuit are arranged will be described.

FIGS. 51A, 51B, and 51C show the fundamental patterns, respectively. The patterns of FIGS. 51A, 51B, and 51C basically have the same structure, except that the dimensions are different from each other. Here, #1 and #2 designate ports, respectively. To the port #1, a strip conductor (stub) in a meander shape having an open end is connected. The strip conductor connecting the ports #1 and #2 has an electrical length equal to ¼ wavelength at a service frequency. The strip conductor connecting the ports #1 and #2 are formed in a meander shape as shown in FIGS. 51A, 51B, and 51C, and are arranged in a limited space.

When a spurious mode wave blocking circuit is formed by arranging plural fundamental patterns shown in FIGS. 51A, 51B, and 51C, the port #1 of a fundamental pattern is connected to the port #2 of a neighboring fundamental pattern, which is repeated sequentially. The number of the arranged patterns is determined so that a required length is obtained. In this arrangement structure, the transmission line has the stubs each having an open end and depending therefrom at intervals of an electrical length equal to ¼ wavelength, which act as a band-stop filter for blocking a predetermined frequency band. Thus, the blocked frequency band is made coincident with the frequency of a spurious mode wave.

If the range of the spurious mode wave propagation-blocking circuit is desired to be widened perpendicular to the arrangement direction of the fundamental patterns, the fundamental patterns are sequentially connected, e.g., in the lateral direction. Plural sets of patterns each comprising the fundamental patterns connected in the lateral direction are arranged in the longitudinal direction. In this case, it is not needed that the respective sets of are electrically connected to each other in the patterns in the longitudinal direction.

The fundamental pattern of FIG. 52A is different from that of FIG. 51A. The basic structure of FIG. 52A is the same as that of FIG. 52B, but the sizes of these structures are different. In this example, the strip conductor with an open end is formed into a rectangular spiral shape, and is connected to the port #1.

FIGS. 53A and 53B each show one fundamental pattern set formed by combining three fundamental patterns with each other. That is, in the example of FIG. 53B, three fundamental patterns as shown in FIGS. 52A and 52B are combined. In this case, three fundamental patterns having different sizes are combined. Moreover, in the example shown in FIG. 53A, one of the three strip conductors with open ends, not formed into a spiral shape, simply has a rectangular pattern.

As seen in the above-description, by differentiating the sizes of the above three fundamental patterns, the blocked frequency bands of the respective fundamental patterns become different from each other. Accordingly, the overall pattern can black spurious mode waves over a wide band.

Next, a fundamental pattern constituting a four-port circuit will be described.

FIG. 54 shows an example of the fundamental pattern constituting the four-port circuit. Here, #1, #2, #3, and #4 designate the ports, respectively. To the middle point of strip conductors connecting these four ports, four strip conductors (stubs) each having an open end and in a rectangular spiral shape are connected, respectively. The electrical lengths of these strip conductors are set at ¼ wavelength at a service frequency.

FIG. 55 shows an example of another fundamental pattern constituting a four-port circuit. Here, #1, #2, #3, and #4 designate the ports, respectively. To the middle point of the strip-conductors connecting these four ports, four strip conductors (stubs) each having an open end, in a meander line shape, are connected, respectively. The electrical lengths of these strip conductors are set at ¼ wavelength at a service frequency. In this example, the lengths from the ports #1, #2, #3, and #4 to the connection point of the stubs are set approximately at ¼ wavelength. By adding transmission lines having a predetermined impedance and a predetermined electrical length to the input-output ports, the bandwidth can be increased.

Next, a method of measuring the characteristics of a spurious mode wave propagation-blocking circuit containing each of the patterns shown in FIGS. 51 to 55, and the measurement results, will be described.

FIG. 56A is a perspective view of either a coplanar waveguide CPW or a conductor backed coplanar waveguide CBCPW (grounded coplanar waveguide). FIG. 56B is a plan view of the waveguide. As shown in FIGS. 56A and 56B, an electrode 22 and a strip conductor 19 are formed on the upper face of a dielectric plate 20. In the electrode 22 on both sides of the strip conductor 19, a spurious mode wave propagation-blocking circuit 3 is formed. In the case of a CPW, no electrode is formed on the under face of the dielectric plate 20. In the case of a CBCPW, a ground electrode is present on the under face of the dielectric plate 20.

The sizes of the respective portions are shown in FIG. 56B (wherein the unit of numerical values is mm).

In FIG. 56A and 56B, the spurious mode wave propagation-blocking circuit 3 is simplified.

FIGS. 57A, 57B, and 57C show the characteristics of the spurious mode wave propagation-blocking circuits comprising the fundamental patterns shown in FIGS. 51A, 51B, and 51C, respectively. In the graphs, the abbreviations "CPW" and "CBCPW" represent the characteristics of the CPW and the CBCPW, obtained when the spurious mode wave propagation-blocking circuits are not provided. The term "spurious-mode blocking" represents the characteristics of the CBCPW's provided with the spurious mode wave propagation-blocking circuits, respectively. The parts of the characteristics obtained when the spurious mode wave propagation-blocking circuits are provided, indicated by the downward arrows A, B and C, respectively, are the frequency ranges in which the leakage is especially suppressed. These are the same ranges in FIGS. 58A to 61 used in the description made later.

As seen in FIGS. 57A–57C, for CBCPW, attenuation occurs, caused by spurious mode wave leakage in contrast to CPW. With the spurious mode wave propagation-blocking circuit provided, the spurious mode wave leakage is suppressed in a particular frequency band, so that the attenuation in the frequency band is suppressed. The attenuation is suppressed in the 30 GHz band for FIG. 57A, in the 25 GHz band for FIG. 57B, and in the 20 GHz for FIG. 57C, respectively.

FIGS. 58A and 58B show the characteristics of the spurious mode wave propagation-blocking circuits comprising the fundamental patterns shown in FIGS. 52A and 52B. As seen in the graphs, attenuation occurs, caused by a spurious mode wave leakage in contrast to CPW. With the spurious mode wave propagation-blocking circuit provided, the spurious mode wave leakage is suppressed in a particular frequency band, so that the attenuation in the frequency band is suppressed. As shown by the arrows A and B, the attenuation is suppressed in the 27 GHz band for FIG. 58A and in the 36 GHz band for FIG. 58B, respectively.

FIGS. 59A and 59B show the characteristics of the spurious mode wave propagation-blocking circuits comprising the fundamental patterns shown in FIGS. 53A and 53B, respectively. As clearly seen when FIGS. 59A and 59B are compared with each other, the particular frequency band in which the spurious mode wave leakage is suppressed is increased in width, due to the spurious mode wave propagation-blocking circuit provided.

FIG. 60 shows the characteristic of the spurious mode wave propagation-blocking circuit comprising the fundamental patterns shown in FIG. 54, and FIG. 61 shows the characteristic of the spurious mode wave propagation-blocking circuit comprising the fundamental patterns shown in FIG. 55. As shown at the arrow A in each figure, the attenuation is suppressed in the 35 GHz band for the former and in the 27 GHz band for the latter.

Some examples of a high frequency circuit device provided with a transmission line will be described with reference to FIGS. 33 to 36.

FIG. 33 is a perspective view of a high frequency circuit device provided with a slot transmission line. In this example, electrodes 21 and 22 are formed on the under and upper faces of a dielectric plate 20, respectively, and a slot is formed in a predetermined position, whereby a grounded slot transmission line 4 is formed. Spurious mode wave propagation-blocking circuits 3 as shown in FIG. 28 or one of the other figures, are formed on both sides of the slot transmission line. In FIG. 33, the spurious mode wave propagation-blocking circuits 3 are shown in a simplified form.

Since the spurious mode wave propagation-blocking circuits 3 are provided on both sides of the slot transmission line and along the slot transmission line, parallel plate mode waves, generated by coupling to the slot mode wave, are converted to the microstrip transmission line mode waves of the spurious mode wave propagation-blocking circuits and totally reflected. Thereby, on the outside of the respective spurious mode wave propagation-blocking circuits 3, substantially no parallel plate mode waves are propagated. Thus, no undesired coupling to adjacent transmission line waves occurs.

In the example shown in FIG. 33, the spurious mode wave propagation-blocking circuits are formed in the electrode having the slot formed therein. Or, the spurious mode wave propagation-blocking circuits 3 may be formed on the ground electrode 21 side. Moreover, the spurious mode wave propagation-blocking circuits may be provided in both the ground electrode 21 and the electrode 22 in which the slot is formed.

In the example of FIG. 34, the ground electrode 21 is formed on the under face of the dielectric plate 20, and the electrode 22 and a strip conductor 19 are formed on the upper face. A part of the strip conductor 19 is a grounded coplanar transmission line 1. The spurious mode wave propagation-blocking circuits 3 are formed on both sides of the electrode 22 along the grounded coplanar transmission line 1. In FIG. 34, the spurious mode wave propagation-blocking circuits 3 are shown in a simplified form.

Thus, in the case in which the present invention is applied to the grounded coplanar transmission line as described above, propagation of a parallel plate mode wave can be suppressed.

The spurious mode wave propagation-blocking circuits 3 may be formed on the ground electrode 21 side or in both the ground electrode 21 and the electrode 22 on the upper face.

FIGS. 35A and 35B show the example in which the present invention is applied to a plane dielectric transmission line (PDTL). FIG. 35A is a perspective view of the plane dielectric transmission line. FIG. 35B shows the under side of the dielectric plate. Electrodes 23 and 24 are formed on the upper and under faces of the dielectric plate 20, which have slots opposed to each other through the dielectric plate 20, respectively. Conductor plates 27 and 28 are arranged in parallel to the upper and under sides of the dielectric plate 20, at a predetermined interval therefrom. The spurious mode wave propagation-blocking circuits 3 similar to those in FIG. 28 or in other figures are formed on both sides of slot 26 by patterning the electrode 24 on the upper face of the dielectric plate 20. In FIG. 35A, the spurious mode wave propagation-blocking circuits are shown in a simplified form.

With the above structure, any parallel mode is converted to the semi-TEM mode of the microstrip in the spurious mode wave propagation-blocking circuits, and is totally reflected. This includes the parallel mode in which a wave is propagated between the electrodes 23 and 24 on the upper and under faces of the dielectric plate 20, the parallel plate mode in which a wave is propagated in the space between the electrode 24 and the conductor plate 28, and/or the parallel plate mode in which a wave is propagated in the space between the electrode 23 and the conductor 27. Thereby, propagation of spurious mode waves is blocked.

FIGS. 36A and 36B show the example in which the present invention is applied to a dielectric transmission line. FIG. 36A is a partially exploded perspective view of a major part thereof, and FIG. 36B is a cross sectional view thereof. In FIGS. 36A and 36B, dielectric strips 35 and 36 and a dielectric plate 33 having an electrode 34 formed on the upper face thereof are provided between conductor plates 31 and 32, so as to form a non-radiative dielectric transmission line for propagating an electromagnetic wave with the electromagnetic field energy being confined in the dielectric strips 35 and 36.

In general, in a dielectric transmission line, an electromagnetic field is disturbed in discontinuous parts of the dielectric strip such as joints, bends, and so forth, so that spurious mode waves such as parallel plate mode waves or the like are propagated between the upper and lower conductor plates.

The dielectric plate 33 is provided with the spurious mode wave propagation-blocking circuits 3 on both sides of the dielectric strips 35 and 36 by patterning the electrode 34 on the upper face of the dielectric plate 33. Thereby, as shown in FIG. 36B, parallel plate mode electromagnetic waves in the space A1 propagating between the electrode 34 and the upper conductor plate 32 and in the space A2 between the electrode 34 and the lower conductor plate 31 are converted to semi-TEM mode waves by means of the microstrip transmission lines of the spurious mode wave propagation-blocking circuits 3 and are totally reflected. Accordingly, no interference occurs between the dielectric transmission lines and the dielectric transmission lines of the adjacent dielectric strips, which may be caused by leakage waves.

Hereinafter, an example of a high frequency circuit device provided with a resonator will be described with reference to FIG. 37.

In the example of FIG. 37, circular electrode non-formation portions 30 opposed to each other through a dielectric plate 29 are provided in electrodes on the upper and lower faces of the dielectric plate 29. With this structure, a dielectric resonator having the electrode non-formation portions 30 as magnetic walls is formed. In this example, the resonator functions as a TE010 mode resonator. A spurious mode wave propagation-blocking circuit 3 is formed by patterning the electrode on the upper face of the dielectric plate 29. It should be noted that the pattern is simplified to be shown in FIG. 37. The spurious mode wave propagation-blocking circuit 3 is the same as that shown in FIG. 28 or FIG. 30B. When the spurious mode wave propagation-blocking circuit 3 is formed around the circular electrode non-formation portion 30 as described above, a pattern corresponding to the pattern shown in FIG. 28 or FIG. 30B, of which the coordinate system, if it is a rectangular coordinate system, is converted to the polar coordinate system, may be used.

Referring to FIG. 37, apart of the electromagnetic field energy confined in the dielectric resonator part is radially extended as a parallel plate mode wave from the dielectric resonator as a center between the electrodes provided above and under the dielectric plate 29. The parallel plate mode is converted to the mode of the microstrip transmission line by means of the spurious mode wave propagation-blocking circuit 3, and the wave is totally reflected. Accordingly, substantially no parallel plate mode waves are leaked to the outside of the spurious mode wave propagation-blocking circuit 3. Contrarily, substantially no spurious mode waves are leaked from the outside of the spurious mode wave propagation-blocking circuit 3 into the inside thereof (in the direction toward the resonator). Accordingly, no interference occurs between the spurious mode wave propagation-blocking circuit 3 and transmission lines or other resonators on the outside of the spurious mode wave propagation-blocking circuit 3, if they are provided, which may be caused by coupling of leakage waves.

Hereinafter, an example of the configuration of a voltage controlled oscillator will be described with reference to FIG. 38.

FIG. 38 is a exploded perspective view showing the configuration of the voltage controlled oscillator. The dielectric plate 20 is provided between upper and lower conductor plates 41 and 44 (the upper conductor plate 41 is shown at a distance from the dielectric plate 20 for convenience of the drawing). Different types of conductor patterns are formed on the upper and lower faces of the dielectric plate 20. A slot transmission line input type FET (millimeter wave GaAsFET) 50 is mounted onto the upper face of the dielectric plate 20. Slots 62 and 63 formed of two electrodes, respectively, are arranged at a predetermined interval on the upper face of the dielectric plate 20. The slots on the upper face, together with the slots on the lower face, form a plane dielectric transmission line. A coplanar transmission line 45 supplies a gate bias voltage and a drain bias voltage to the FET 50.

Reference numeral 61 designates a thin film resistor. The terminal portion of the slot 62 formed on the upper face of the dielectric plate 20 is formed to become thinner toward the top thereof, and the thin film resistor 61 is provided on the upper side of the terminal portion of the slot 62. Another slot 65 is formed on the upper face of the dielectric plate 20. A slot is also formed on the back side so that the slots sandwich the dielectric plate 20, and thereby, a plane dielectric transmission line is formed. A variable capacitance element 60 is mounted so as to extend over the slot 65. The capacitance is varied, depending on an applied voltage. Furthermore, in FIG. 38, a conductor non-formation portion 64 for forming a dielectric resonator is provided on the upper face of the dielectric plate 20, and together with a conductor non-formation portion for a dielectric resonator, formed on the back side opposed to the above portion 64 through the dielectric plate 20, constitutes a TE010 mode dielectric resonator in the relevant portion thereof.

The spurious mode wave propagation-blocking circuits 3 are formed in the cross-hatched portions of the dielectric plate 20 in FIG. 38. Also on the lower face side of the dielectric plate 20, spurious mode wave propagation-blocking circuits are formed in the area thereof opposed to the spurious mode wave propagation-blocking circuits on the upper face. Since the spurious mode wave propagation-blocking circuits 3 are formed as described above, interference between the plane dielectric transmission line comprising the slot 63, the plane dielectric transmission line comprising the slot 65, and the dielectric resonator comprising the conductor non-formation portion 64, which may be caused by leakage waves, is prevented.

FIGS. 39A and 39B show an example of a high frequency module using a spurious mode wave propagation-blocking circuit comprising the conductor patterns shown in FIG. 30B and arranged two-dimensionally. FIG. 39A is a perspective view showing the whole of the high frequency module. In the high frequency module, plural chip integrated circuit parts are mounted onto a substrate 70. Thus, the high frequency module may be operated, e.g., in a 2 to 30 GHz frequency band. FIG. 39B is an enlarged plan view showing one of the integrated circuit parts. In this integrated circuit part, a spiral inductor and a slot transmission line are formed on the substrate. Equivalently, the parts form a matching circuit in which the inductor is connected in parallel to the transmission line. The above spurious mode wave propagation-blocking circuit is formed in the area of the module excluding the area where the slot transmission line and the spiral slot inductor are formed.

In the case in which a branched portion or a bend portion are provided in a slot transmission line, as described above, a spurious mode wave is generated in that portion. If the above spurious mode wave propagation-blocking circuit is not provided, and the part simply comprises plane conductors, the above spurious mode wave propagates between the parallel plane conductors, so that it couples to the spiral inductor and causes the parasitic capacity to increase. As a result, phenomena such as interference or the like, e.g., in a communication module, occurs, or the problem may arise that the characteristics of the respective parts significantly depart from their designed values, which makes it difficult to carry out the design of the whole of the communication module.

On the contrary, as shown in FIG. 39A and 39B, if the above spurious mode wave propagation-blocking circuit is formed in the area excluding where the slot transmission line and the spiral slot inductor are formed as shown in FIG. 39, spurious mode waves, generated in the branched portion and the bend portion of the slot transmission line, can be absorbed in the spurious mode wave propagation-blocking circuit. Accordingly, the spurious mode waves do not couple to the spiral inductor, and the parasitic capacitance is not increased. Thus, the above problems can be solved.

FIG. 40 is a block diagram showing an example of the configuration of a communication device using the above voltage controlled oscillator. In FIG. 40, a transmission signal is input to an antenna sharing device DPX from a power amplifier PA. A reception signal is supplied to a mixer via a low noise amplifier LNA and an RX filter (reception filter). On the other hand, a local oscillator PLL which may comprise a phase-locked loop comprises an oscillator OSC and a frequency divider DV for dividing an oscillation signal. The local signal is given to the above mixer. The above-described voltage controlled oscillator is used as the oscillator OSC.

According to an aspect of the present invention, the circuit is formed of a strip conductor. Accordingly, the parallel, plane conductors between which a spurious mode wave is to be propagated is simply patterned, which eliminates such problems as arise in formation of conventional through-holes. Moreover, it is not needed especially to provide an inductor and a capacitor as a lumped circuit. Since the circuit can be formed of a strip conductor, the fundamental patterns can be reduced in size and packed to be arranged at a high density in a limited area. Thus, the spurious mode wave propagation-blocking characteristic can be enhanced.

Especially, the frequency band in which a band-stop characteristic is presented can be increased in width, so that propagation of a spurious mode wave can be blocked over a wide band.

According to the present invention, in a propagation section for propagating a communication signal and in a signal processing section for passing or blocking a predetermined frequency band of communication signals such as a filter or the like, interference can be securely prevented between transmission lines or between transmission lines and a resonator, even if the arrangement intervals of the transmission lines and the resonator are reduced. Thus, the communication device can be reduced in size as a whole.

What is claimed is:

1. A high frequency circuit device comprising:

at least two parallel plane conductors, a circuit for exciting an electromagnetic wave, provided between the two plane conductors, and a spurious mode wave propagation-blocking circuit for coupling to a spurious mode wave propagating between the two plane conductors to block the propagation of the spurious mode wave, formed on either or both of said at least two plane conductors, said spurious mode wave propagation-blocking circuit comprising a plurality of arranged fundamental patterns each made exclusively of one strip conductor and constituting a multi-port circuit having at least two ports, said strip conductor of the propagation-blocking circuit being determined so that each two-port circuit of the respective fundamental patterns has a band-stop filter characteristic.

2. A high frequency circuit device according to claim 1, wherein the multi-port circuit has at least three ports.

3. A high frequency circuit device according to one of claims 1 and 2, wherein the two-port circuit comprises a strip conductor connecting the two ports of the two-port circuit and a strip transmission line with an open end, having an electrical length equal to ¼ wavelength at a service frequency and connected in parallel to the strip conductor.

4. A high frequency circuit device according to claim 3, wherein a transmission line having a predetermined impedance and a predetermined electrical length is connected to each of the ports of the fundamental pattern.

5. A communication device comprising one of a signal propagation section and a signal processing section which includes the high frequency circuit device of claim 3.

6. A high frequency circuit device according to one of claims 1 and 2, wherein the two-port circuit comprises at least two strip conductors having an electrical length difference equal to a half wavelength at a service frequency and connected in parallel to each other between the two ports of the two-port circuit.

7. A high frequency circuit device according to claim 6, wherein a transmission line having a predetermined impedance and a predetermined electrical length is connected to each of the ports of the fundamental pattern.

8. A communication device comprising one of a signal propagation section and a signal processing section which includes the high frequency circuit device of claim 6.

9. A high frequency circuit device according to one of claims 1 and 2, wherein a transmission line having a predetermined impedance and a predetermined electrical length is connected to each of the ports of the fundamental pattern.

10. A communication device comprising one of a signal propagation section and a signal processing section which includes the high frequency circuit device of claim 9.

11. A communication device comprising one of a signal propagation section and a signal processing section which includes the high frequency circuit device of one of claims 1 to 2.

12. A high frequency circuit device according to one of claims 1 and 2, wherein said fundamental patterns are conductively interconnected.

* * * * *